US012654913B2

(12) United States Patent
Hayashi

(10) Patent No.: US 12,654,913 B2
(45) Date of Patent: Jun. 16, 2026

(54) LID, COMBINATION OF CONTAINER AND LID, AND CONTAINER WITH LID

(71) Applicant: KY7 INC., Tokyo (JP)

(72) Inventor: Hiroyoshi Hayashi, Tokyo (JP)

(73) Assignee: KY7 INC., Tokyo (JP)

( * ) Notice: Subject to any disclaimer, the term of this patent is extended or adjusted under 35 U.S.C. 154(b) by 202 days.

(21) Appl. No.: 18/570,206

(22) PCT Filed: Jun. 14, 2022

(86) PCT No.: PCT/JP2022/023868
§ 371 (c)(1),
(2) Date: Dec. 14, 2023

(87) PCT Pub. No.: WO2022/265027
PCT Pub. Date: Dec. 22, 2022

(65) Prior Publication Data

US 2024/0270455 A1 Aug. 15, 2024

Related U.S. Application Data

(60) Provisional application No. 63/344,399, filed on May 20, 2022.

(30) Foreign Application Priority Data

Jun. 15, 2021 (JP) ..... 2021-099797
Aug. 13, 2021 (JP) ..... 2021-132093
(Continued)

(51) Int. Cl.
*B65D 51/18* (2006.01)
*B65D 77/20* (2006.01)

(52) U.S. Cl.
CPC ..... *B65D 51/18* (2013.01); *B65D 77/2068* (2013.01); *B65D 2251/0009* (2013.01); *B65D 2251/0018* (2013.01)

(58) Field of Classification Search
CPC ..... B65D 51/18; B65D 77/2068; B65D 2251/0009; B65D 2251/0018;
(Continued)

(56) References Cited

U.S. PATENT DOCUMENTS 4,231,487 A * 11/1980 Hasegawa ..... B65D 17/4012 220/269
4,253,582 A 3/1981 Shields
(Continued)

FOREIGN PATENT DOCUMENTS

CN 112707030 A * 4/2021 ..... B65D 43/06
JP S57-163641 A 10/1982
(Continued)

OTHER PUBLICATIONS

Mar. 23, 2021 International Search Report issued in International Patent Application No. PCT/JP2021/000737.
(Continued)

*Primary Examiner* — Nathan J Jenness
*Assistant Examiner* — Madison L Poos
(74) *Attorney, Agent, or Firm* — Oliff PLC

(57) ABSTRACT

A lid that enables easy and hygienic opening and closing of a spout in a lid, is formed for opening and closing an open mouth part of a container, and has a top surface part formed so as to cover the open mouth part when the lid is closed. The top surface part includes a small lid piece and an opening part formed when the small lid piece is lifted, a joint part joined to one end part of a tab member is formed near a tip end of the small lid piece, and the tab member has a knob part formed at the other end part.

20 Claims, 56 Drawing Sheets

(30) Foreign Application Priority Data

| | | |
|---|---|---|
| Nov. 10, 2021 | (JP) | 2021-183765 |
| Jan. 1, 2022 | (JP) | 2022-000005 |
| Feb. 8, 2022 | (JP) | 2022-018335 |
| May 21, 2022 | (JP) | 2022-083460 |
| May 30, 2022 | (JP) | 2022-088116 |
| Jun. 1, 2022 | (JP) | 2022-089977 |
| Jun. 8, 2022 | (JP) | 2022-093354 |

(58) Field of Classification Search

CPC ..... B65D 43/0222; B65D 47/0847; B65D 77/2032; B65D 77/206; B65D 2517/0013; B65D 2517/0028; B65D 2517/0029; B65D 2517/0035; B65D 2517/0053; B65D 2517/0061; B65D 2517/0085; B65D 2517/5089; B65D 2543/00037; B65D 2543/00046; B65D 2543/00092; B65D 2543/00268; B65D 2543/00527; B65D 2543/00537; B65D 17/4012; B65D 17/02; B65D 17/34; B65D 47/36; B65D 3/00; B65D 41/04; B65D 43/08; B65D 47/06; B65D 51/24; B65D 53/08; B65D 47/103; B65D 43/0212; B65D 43/0204

USPC ..... 220/254.1, 266, 268, 269, 270

See application file for complete search history.

(56) References Cited

U.S. PATENT DOCUMENTS

| | | | |
|---|---|---|---|
| 4,433,808 | A | 2/1984 | Gordon et al. |
| 4,773,557 | A | 9/1988 | Ohta |
| 5,411,159 | A | 5/1995 | Fan |
| 5,647,500 | A | 7/1997 | Konno et al. |
| 6,062,414 | A | 5/2000 | Mongarli et al. |
| 6,471,122 | B1 | 10/2002 | Stewart et al. |
| 8,336,727 | B2 | 12/2012 | Linden et al. |
| 11,685,576 | B2 | 6/2023 | Takano |
| 2014/0054306 | A1 | 2/2014 | Panek et al. |
| 2018/0194517 | A1 | 7/2018 | Brooks |
| 2020/0239199 | A1 | 7/2020 | Kuo et al. |
| 2021/0316912 | A1 | 10/2021 | Yamada |
| 2022/0135289 | A1 | 5/2022 | Li |
| 2022/0258932 | A1 | 8/2022 | Yamada |

FOREIGN PATENT DOCUMENTS

| | | | |
|---|---|---|---|
| JP | S59-37151 | A | 2/1984 |
| JP | H01-182269 | A | 7/1989 |
| JP | H07-17554 | A | 1/1995 |
| JP | 2006-248530 | A | 9/2006 |
| JP | 2008-062952 | A | 3/2008 |
| JP | 2015-529602 | A | 10/2015 |
| JP | 2020-116366 | A | 8/2020 |
| JP | 6942285 | B1 | 9/2021 |
| WO | 2011/082486 | A1 | 7/2011 |
| WO | 2016/069755 | A1 | 5/2016 |
| WO | 2020/100316 | A1 | 5/2020 |
| WO | 2020/166715 | A1 | 8/2020 |
| WO | 2021/020511 | A1 | 2/2021 |

OTHER PUBLICATIONS

Mar. 23, 2021 Written Opinion issued in International Patent Application No. PCT/JP2021/000737.
Translation of Apr. 6, 2021 Office Action issued in Japanese Patent Application No. 2021-514434.
Translation of Aug. 10, 2021 Notice of Allowance issued in Japanese Patent Application No. 2021-514434.
Aug. 3, 2022 Office Action issued in U.S. Appl. No. 17/637,131.
Jun. 23, 2022 Office Action issued in Korean Patent Application No. 10-2022-7008156.
Aug. 5, 2022 Office Action issued in India Patent Application No. 202247020345.
Nov. 14, 2022 Examination Report in Australian Application 2021206361.
Oct. 17, 2022 Office Action issued in Canadian Application No. 3,164, 181.
Oct. 31, 2022 Search Report issued in European Application No. 21738581.4.
Sep. 26, 2022 Decision for Grant of Patent in Korean Application No. 10-2022-7008156.
Nov. 2, 2022 Examination Report in New Zealand Application No. 791181.
Jan. 3, 2023 Office Action Issued In U.S. Appl. No. 17/637,131.
Jan. 23, 2023 Office Action issued in Brazilian Patent Application No. BR112022013610-2.
Apr. 12, 2023 Notice of Allowance issued in U.S. Appl. No. 17/637,131.
Sep. 14, 2022 Decision to Grant issued in Japanese Patent Application No. 2022-093354.
Jul. 4, 2022 Notice of Reasons for Refusal issued in Japanese Patent Application No. 2022-093354.
Aug. 9, 2022 Written Opinion issued in International Patent Application No. PCT/JP2022/023868.
Aug. 9, 2022 International Search Report issued in International Patent Application No. PCT/JP2022/023868.
Apr. 4, 2023 Notice of Allowance issued in Canadian Patent Application No. 3,164,181.
Jul. 21, 2023 Office Action issued in Indonesian Patent Application No. P00202203339.
May 12, 2023 Examination Report issued in Philippine Patent Application No. PH1/2022/550628.
U.S. Appl. No. 17/637,131, filed on Feb. 22, 2022 in the name of Takano.
Mar. 17, 2026 Office Action issued in Canadian Patent Application No. 3,215,999.

* cited by examiner (a)

(b)

(a)

(b)

(a)

(b)

(a)

(b)

(c)

(a)

(b)

(a)

(b)

(c)

(d)

(a)

(b)

(c)

(d)

(e)

(a)

(b)

(c)

(d)

(e)

(a)

(b)

(c)

(d)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

LID, COMBINATION OF CONTAINER AND LID, AND CONTAINER WITH LID

TECHNICAL FIELD

The present invention relates to a lid, a combination of a container and a lid, and a container with a lid.

BACKGROUND ART

Conventionally, it has been widely practiced to provide food in a container with a lid closed. Furthermore, in recent years, for example, in convenience stores, it has been widely practiced to provide beverages such as coffee in the above-described new form. As described above, in a case where the food and drink (hereinafter also referred to as "content") to be accommodated in the container is a beverage such as coffee, the purchaser makes a movement such as taking the container with the lid on and tilting the container to drink the content. Therefore, it is common to form an opening part, which is also referred to as a spout, in a lid, so that the content flows out to the outside of a container when the container is tilted. However, simply forming the opening of the spout may cause dust or the like to enter the container from the spout, which is not very hygienic. Therefore, in a state before use, the spout in the lid is prevented from being opened, and the opening of the spout is formed for the first time when the user drinks the content.

Examples of such a lid include those disclosed in Patent Literature 1 and Patent Literature 2 described below. The lid disclosed in Patent Literature 1 includes a side wall and a top lid part, and a tab is formed on the top lid part. The lid is configured such that a bell-shaped or guitar-shaped hole is opened to form a spout when a user pinches and pulls up the tab. In addition, in a beverage cup lid disclosed in Patent Literature 2, an opening part (spout) is formed on a top surface (top lid part), and a small lid that closes and opens the opening part is provided. In addition, the small lid is provided with a protrusion, and is configured to keep the small lid open by fitting the protrusion of the small lid into a recess in a top surface part.

CITATION LIST

Patent Literature

Patent Literature 1: WO 2016/069755 A
Patent Literature 2: JP 2008-062952 A

SUMMARY OF INVENTION

Technical Problem

However, the lid bodies disclosed in Patent Literatures 1 and 2 described above have a problem that the movement of directly gripping the tab or the small lid to form the opening of the spout and the movement of inserting the tab into the tab hole or fitting the protrusion of the small lid into the recess in the top surface cannot be smoothly performed, and the movement of forming the opening of the spout is very difficult to perform. This problem is likely to be solved by devising the structure and shape of the lid itself, but in this case, there is another problem that the structure and shape of the lid itself need to be made complex. In addition, in the lid described above, since the protrusion serving as the tab or the knob is directly formed on the top lid part, the user has to directly touch the lid when forming the opening of the spout, and there is also a problem in terms of hygiene. In addition, in such a conventional lid, in a case where the opening of the spout is once formed and then the spout is closed again, it is necessary to operate the tab or the small lid by touching the tab or the small lid with fingers. Therefore, after closing the spout, the surface touched by the fingers is located on the side with which the beverage comes into contact, and there is also a problem that it is not hygienic.

The present invention has been made in view of such problems, and an object of the present invention is to provide a lid, a combination of a container and a lid, and a container with a lid that enable easy and hygienic opening and closing of a spout in a lid.

Solution to Problem

The gist of the present invention is the following (1) to (16).

(1) A lid formed for opening and closing an open mouth part of a container, wherein
the lid comprises a top surface part formed to cover the open mouth part in a state of being attached to the container to close the container,
the top surface part includes a small lid piece and an opening part formed when the small lid piece is lifted;
a tab member is joined to the small lid piece;
a joint part joined to one end part of the tab member is formed in the small lid piece; and
a knob part is formed at the other end part of the tab member, (2) a lid having a joining region joined to a peripheral edge of an open mouth part of a container, wherein
the lid has a shape that covers the open mouth part at the time of being joined to the container,
the lid comprises a small lid piece, a tab member joined to the small lid piece, and an opening part formed when the small lid piece is lifted, in which:
the small lid piece is provided inside the joining region;
one end part of the tab member and the small lid piece are joined to each other; and
when a joining part between the one end part and a part close to the tip end is defined as a joint part,
a knob part is formed at the other end of the tab member, (3) the lid according to (1) above, in which:
the tab member has a holding piece formed between the joint part and the knob part, and is formed such that the holding piece protrudes from the tab member when the knob part is pinched to open the small lid piece;
an insertion part into which the protruding holding piece is to be inserted is formed in the top surface part; and
the holding piece is configured for being inserted into the insertion part to keep the small lid piece open, (4) the lid according to (2) above, in which:
the tab member has a holding piece formed between the joint part and the knob part, and is formed such that the holding piece protrudes from the tab member when the knob part is pinched to open the small lid piece;
an insertion part into which the protruding holding piece is to be inserted is formed; and
the holding piece is configured for being inserted into the insertion part to keep the small lid piece open, (5) the lid according to (3) or (4) above, in which the knob part is formed so as to rise when the holding piece is inserted into the insertion part, (6) the lid according to any one of (3) to (5) above, in which the holding piece is formed so as to protrude from the knob part side toward the joint part side, (7) the lid according to any one of (3) to (6) above, in which the insertion part includes a main part into which the holding piece is to be inserted and an auxiliary part intersecting with the main part, (8) the lid according to any one of (3) to (7) above, in which the tab member is provided with a pattern imitating an expression of a person on the knob part, (9) the lid according to (8) above, in which the pattern changes three-dimensionally before and after the holding piece is protruded,

(10) the lid according to (2) above further comprising, in a state of being joined to the container, an exposed surface, in which at least a part of an outer peripheral edge of the small lid piece extends along an inner edge of the joining region, and is formed outside an intersection position between the exposed surface in a state of being joined to the container and an extended surface of an inner peripheral surface of the container,

(11) the lid according to any one of (1) to (10) above further comprising, in a closed lid state in which the small lid piece is closed, a facing surface facing an outer peripheral end surface of the small lid piece, in which at least a part of the outer peripheral end surface and the facing surface rub against each other when the small lid piece is opened from the closed lid state,

(12) the lid according to any one of (1) to (11) above, in which a window part is formed in the top surface part,

(13) the lid according to any one of (1) to (12) above, in which the top surface part has a raised part in which at least a part of the top surface part is raised,

(14) the lid according to any one of (1) to (13) above, in which the lid is formed of a paper-based material,

(15) a combination of a container and a lid, comprising a container having an open mouth part and the lid according to any one of (1) to (14) above, and

(16) a container with a lid, comprising a container having an open mouth part and the lid according to any one of (1) to (14) above, in which the open mouth part of the container is covered with the lid.

Advantageous Effects of Invention

According to the present invention, a small lid piece joined to a tab member can be easily opened by pinching and lifting a knob piece of the tab member. In addition, in a case where the tab member is provided with a holding piece and a top surface part is provided with an insertion part, by inserting the holding piece formed in the tab member into the insertion part formed in the top surface part while pinching the knob part of the tab member to lift the small lid piece, a state in which the small lid piece is open, that is, a state in which the opening part is formed, can be maintained. Therefore, according to the lid of the present invention, the user can perform the movement of forming the opening part without directly touching the small lid piece. Furthermore, according to the present invention, in the case where the holding piece is formed in the tab member and the insertion part is formed in the top surface part, the movement of holding the small lid piece in the opened state can be smoothly performed, and the opening and closing of the small lid piece can be facilitated. Further, according to the lid of the present invention, it is possible to drink a content or the like while maintaining a very hygienic state. In addition, even in a case where the opening part is closed again, the small lid piece can be closed to a state where the opening is closed by operating the tab member, so that it is possible to reduce the possibility of an attachable matter or the like, which tends to adhere to the small lid piece due to steam or the like, touching the user's finger, and it is possible to reduce the possibility of making the user feel discomfort. In addition, since the small lid piece can be opened and closed only by operating the tab member in this manner, it is possible to comfortably use the small lid piece without feeling complexity when the user operates the small lid piece.

BRIEF DESCRIPTION OF DRAWINGS

FIG. 6(*b*) is a partially enlarged view of FIG. 6(*a*).

FIG. 23(*b*) is an external perspective view illustrating a configuration of another mode of the lid.

FIG. 24(*b*) is an external perspective view of the lid illustrated in FIG. 24(*a*).

FIG. 25(*b*) is an external perspective view of the lid illustrated in FIG. 25(*a*).

FIG. 26(*b*) is an external perspective view of the lid illustrated in FIG. 26(*a*).

FIG. 28(*b*) is a longitudinal sectional view taken along line B-B in FIG. 28(*a*).

FIG. 30(*b*) is a longitudinal sectional view taken along line C-C in FIG. 30(*a*).

FIG. 33(*b*) is a longitudinal sectional view taken along line D-D in FIG. 33(*a*).

FIG. 37(*b*) is a longitudinal sectional view taken along line E-E in FIG. 37(*a*).

FIG. 40(*b*) is a partially enlarged view in which the range indicated by X in FIG. 40(*a*) is enlarged.

FIG. 41(*b*) is a longitudinal sectional view taken along line F-F in FIG. 41(*a*).

FIG. 46(*b*) is a cross-sectional view for explaining an example of a lid according to Modification 6 of the second embodiment of the present invention.

FIG. 53(*b*) is a view for explaining a usage example of the lid having the tab member illustrated in FIG. 53(*a*).

FIG. 55(*b*) is a longitudinal sectional view taken along line H-H in FIG. 55(*a*).

DESCRIPTION OF EMBODIMENTS

Figure 1:
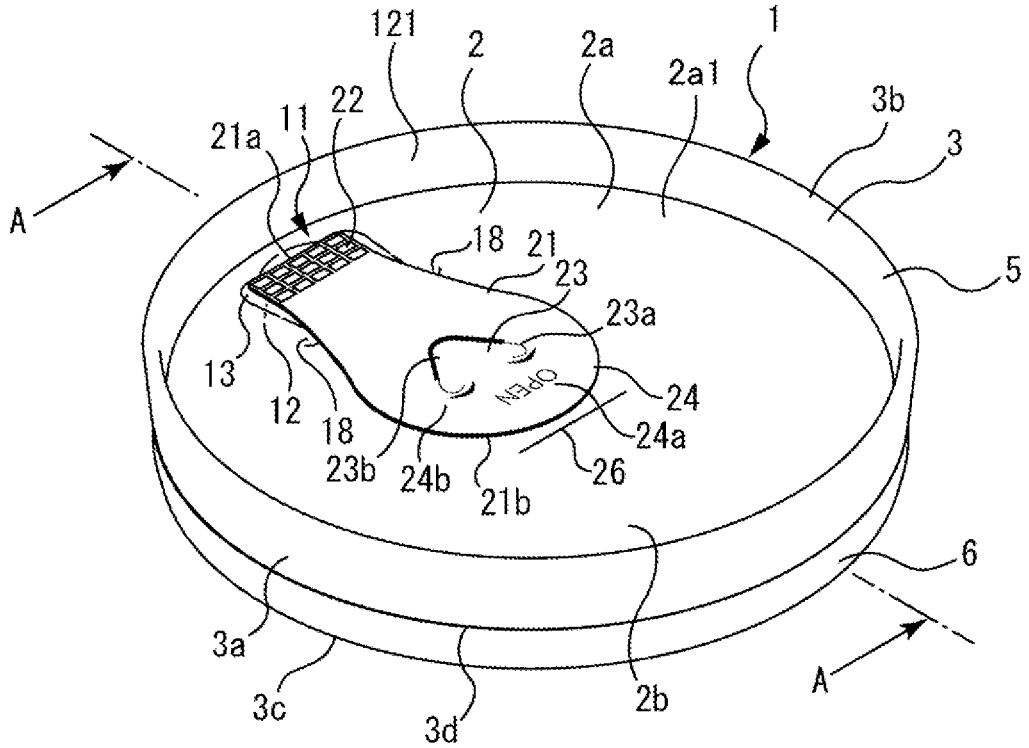
FIGS. 1(*a*) and 1(*b*) are external perspective views illustrating an embodiment (first embodiment) of a lid of the present invention.
Figure 1:
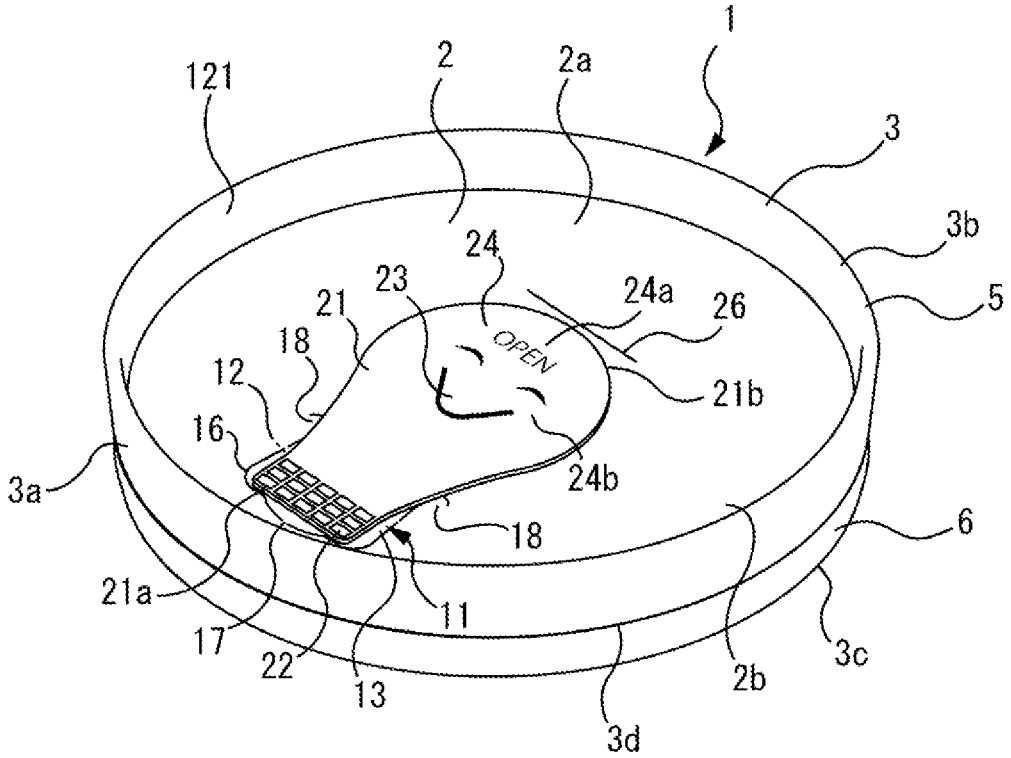

Hereinafter, a lid according to the present invention will be described in detail with reference to the drawings. Note that the lid according to the present invention will be described by exemplifying a lid used for a container (cup) for containing various beverages such as a coffee cup, but is not limited to a lid of a container for containing beverages, and can also be applied as a lid of a container for storing food items other than beverages. In addition, the lid according to the present invention can also be applied to a container capable of storing various articles other than food, such as components like bolts, nuts, and the like, and articles other than the above-described components. Furthermore, in the following description, the lid according to the present invention will be described using an example of a lid having a circular shape in plan view, but the lid is not limited to a lid having a circular shape in plan view, and can also be applied to a lid having various shapes other than a circular shape, such as an elliptical shape, a rectangular shape, a polygonal shape such as a triangular shape, a chamfered rectangular shape, a chamfered polygonal shape, and the like.

Note that in the description, a type of lid that can be fitted to a container will be described as a first embodiment, and a type of lid that is not to be fitted to a container will be described as a second embodiment. In the present specification, configurations having substantially similar features even if the embodiments are different are denoted by the same reference numerals, and detailed description of the configurations is omitted.

First Embodiment

As illustrated in FIGS. 1 to 6, a lid 1 according to the first embodiment includes a top lid part 2 and a side wall 3. The side wall 3 is formed in a cylindrical shape or an annular shape by joining both end parts of a paper-based material. The side wall 3 has an upper wall 5 and a lower wall 6. In addition, the side wall 3 is tapered from an upper end 3*b* side toward a lower end 3*c* side.

Note that here, the "tapered shape" means that the shape of an outer wall 3*a* of the side wall 3 is tapered as a whole from the upper end 3*b* side toward the lower end 3*c* side. The "tapered shape" includes a shape in which the outer wall 3*a* of the side wall 3 sequentially decreases in size from the upper end 3*b* side toward the lower end 3*c* side, and also includes a shape in which a part of the outer wall 3*a* of the side wall 3 has a bulging part, a protruding part, or the like that partially increases in size, or even if a bulging part or a protruding part is formed, the outer wall 3*a* of the side wall 3 is tapered as a whole. In the case where the outer wall 3*a* of the side wall 3 has a shape in which the size sequentially decreases from the upper end 3*b* side toward the lower end 3*c* side, the outer wall 3*a* of the side wall 3 may have a shape in which the size sequentially decreases in a curved shape or a shape in which a step 3*d* (see FIG. 6 and the like) is formed between the upper end 3*b* side and the lower end 3*c* side, in addition to the shape in which the size sequentially decreases in a linear shape from the upper end 3*b* side toward the lower end 3*c* side. Further, even if a part of the side wall 3 has a straight tubular shape or an annular shape that is not formed in a tapered shape, a shape in which the outer wall 3*a* of the side wall 3 has a tapered shape as a whole is also included in the "tapered shape". That is, the "tapered shape" here can be any shape as long as the shape of the outer wall 3*a* of the side wall 3 is a shape in which the side wall 3 is tapered as a whole, and is a concept also including a mode in which a part of the outer wall 3*a* is formed in a shape different from a tapered shape.

Figure 9:
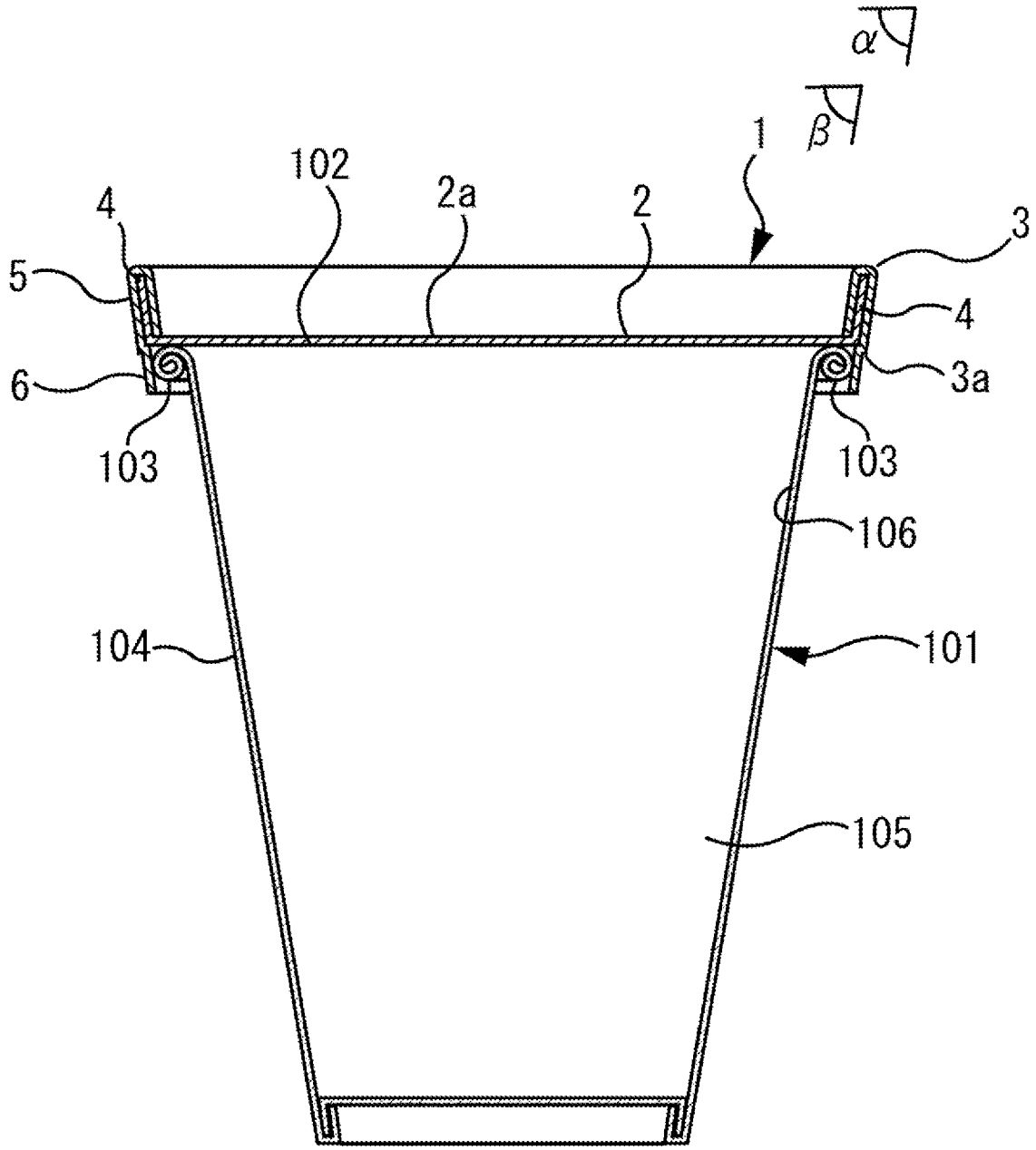
FIG. 9 is an explanatory view for explaining a state in which a lid is attached to a container.

The top lid part 2 has a top surface part 2*a* and a rising part 4. The top surface part 2*a* is a part to be a main body part of a top lid formed in a central part of the top lid part 2, and is formed in a size and shape that can cover an open mouth part 102 of a container 101 by coming into contact with at least a part of an edge part 103 formed on the peripheral edge of the open mouth part 102 when the open mouth part 102 is closed as illustrated in FIG. 9. The top surface part 2*a* includes a main body 2*al* having an opening part 12 and a small lid piece 13. The small lid piece 13 is formed to be openable and closable. When attached to a container 101, the top surface part 2*a* is located above the open mouth part 102, and covers the open mouth part 102 with the main body 2*al* and the small lid piece 13. The rising part 4 is a part formed on the peripheral edge of the top surface part 2*a*, and is formed so as to rise upward from the peripheral edge of the top surface part 2*a*. The top surface part 2*a* and the rising part 4 may be formed separately, but are preferably formed integrally from the viewpoint of manufacturing efficiency, sealability as the lid 1, and the like. In the case of integrally forming the top surface part 2*a* and the rising part 4 in the top lid part 2, the top surface part 2*a* and the rising part 4 can be formed by arbitrarily adopting a conventionally known method. From the viewpoint of ease of forming the top lid part 2, it is preferable to form the top surface part 2*a* and the rising part 4 by bending. That is, the rising part 4 is preferably formed by bending at the peripheral edge of the top surface part 2*a*.

The top lid part 2 and the side wall 3 are integrated by joining an outer surface 4*b* of the rising part 4 of the top lid part 2 to an inner surface 5*a* of the upper wall 5 of the side wall 3. An engaging part 7 formed in a shape capable of engaging with the edge part 103 (curled part formed in curled shape in FIG. 9) provided in the open mouth part 102 formed in the container 101 as illustrated in FIG. 9 is formed on an inner surface 6*a* side of the lower wall 6 of the side wall 3. The engaging part 7 can be formed in any shape as long as it can be engaged with the edge part 103 of the container 101. For example, the engaging part 7 may have a linear tapered shape as illustrated in FIG. 1, or the engaging part 7 may be formed by swelling the lower wall 6 in accordance with the shape of the edge part 103. In addition, the engaging part 7 may be formed by forming a protruding part protruding inward on the inner surface 6*a* side of the lower wall 6, or the protruding part described above may be formed as a part of the engaging part 7. As described above, in the case where the engaging part 7 is formed by forming the protruding part protruding inward on the inner surface 6*a* side, the protruding part may be formed so as to be continuous with the inner surface 6*a*, or protruding parts may be formed intermittently by alternately forming a part where the protruding part is formed and a part where the protruding part is not formed. In addition, in the case where the protruding parts are formed intermittently, the sizes and lengths of the protruding parts may be the same or may be different.

The engaging part 7 may be formed by pressing an inner peripheral surface of the lower wall 6 of the side wall 3. In particular, in a case where the engaging part 7 is formed in an annular recessed groove shape or the like, by pressing the inner peripheral surface of the lower wall 6, it is possible to reduce a step at a joining part of the engaging part 7 formed on the lower wall 6 of the side wall 3 formed by joining both end parts of a rectangular or fan-shaped paper-based material, and a gap is hardly formed between the lid 1 and the container 101, so that sealability by the lid 1 at the time of closing the lid is improved.

In the lid 1 according to the present embodiment, the side wall 3 is formed in a cylindrical shape or an annular shape by joining both end parts of a fan-shaped blank material (not illustrated) in which the length of the arc on the upper end 3*b* side is longer than the length of the arc on the lower end 3*c* side. Therefore, the side wall 3 is formed such that the side surface is tapered as a whole (inclined as a whole in direction of arrow a in FIG. 6) from the upper end 3*b* side toward the lower end 3*c* side (toward open mouth part 102 of container 101), and the inner dimension of the lower end side of the engaging part 7 is smaller than the inner dimension of the upper end side of the engaging part 7.

Figure 11:
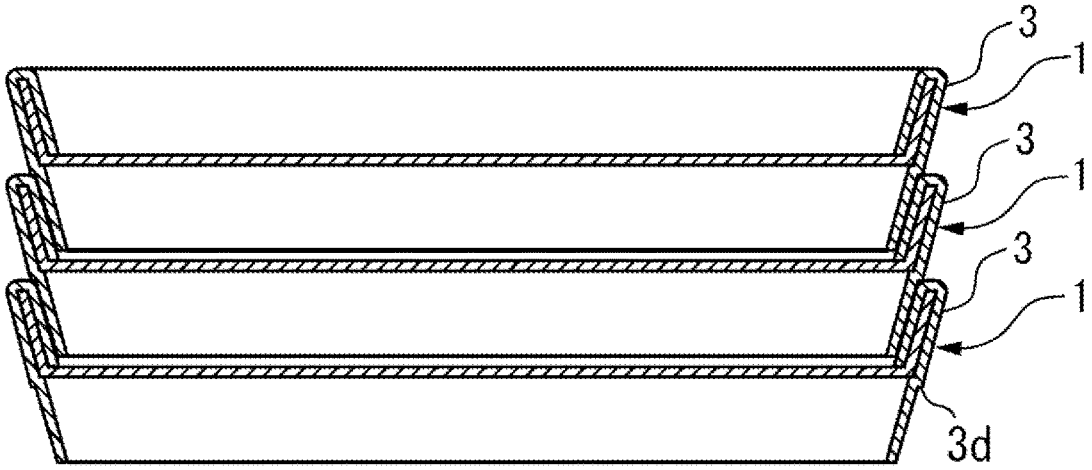
FIG. 11 is an explanatory view illustrating a state in which the lid is stacked.

In the lid 1 according to the present embodiment, since the side wall 3 is formed in an inclined shape tapered from the upper end 3*b* side toward the lower end 3*c* side, the stacking property when a plurality of lid bodies 1 are stacked is excellent as illustrated in FIG. 11. That is, the lid 1 according to the present embodiment can be stored and transported in a small space by vertically stacking the plurality of lid bodies 1, and the cost for storage and transportation can be reduced. The side wall 3 is not limited to the case where an entire side surface of the outer wall 3*a* is formed in an inclined shape, and it is also possible to form a part of the side wall 3, such as only the upper end 3*b* side or the lower end 3*c* side of the side wall 3 in an inclined shape. In addition, the side wall 3 may be formed to have different inclination angles on the upper end 3*b* side and the lower end 3*c* side. Further, the lid 1 according to the present embodiment may be formed in a non-inclined cylindrical or annular shape by forming the side wall 3 in a surrounding shape with a rectangular paper-based material, that is, in an annular shape or a cylindrical shape so as to surround the top surface part 2*a* of the top lid part 2. Furthermore, by forming the side wall 3 with an inverse fan-shaped blank material formed of a paper-based material, the side wall 3 can be formed in a shape inclined in a direction opposite to that of the case illustrated in FIG. 11 and the like. However, it is preferable that the side wall 3 be formed in a non-inclined shape or, as illustrated in FIG. 11 and the like, be formed to be inclined in a tapered shape along the inclination angle of a side wall 104 of the container 101. In particular, by forming the side wall 3 such that the side surface of the outer wall 3*a* has an annular or cylindrical shape inclined so as to be tapered from the upper end 3*b* side toward the lower end 3*c* side, the stacking property of the lid 1 when the plurality of lid bodies 1 are stacked is improved. In addition, by forming the side wall 3 as described above, it is possible to further improve the closability and sealability with respect to the container 101 when the lid 1 is fitted to the container 101 to close the open mouth part 102 of the container 101. From the viewpoint of further improving the stacking property of the lid 1, it is preferable to form the step 3*d* on an outer surface of the side wall 3. By forming the step 3*d* on the outer surface of the side wall 3, the lower wall 6 of the lid stacked thereon at the time of stacking can enter a space surrounded by the upper wall 5 of the lid 1 located below the lower wall 6, and the lower wall 6 can enter the space with far less restriction by the inner surface of the upper wall 5. Therefore, when a plurality of lid bodies 1 are stacked, a larger number of lid bodies 1 can be stacked in a smaller space. This makes it possible to increase the number of lid bodies 1 that can be stacked when the lid 1 is stored in a container, a packing box, or the like having a fixed height, for example. Therefore, it is also possible to reduce the distribution cost such as when the lid 1 is transported.

A conventionally known joining method can be used to join both end parts of a blank material formed of a paper-based material forming the side wall 3 in the lid 1 and to join the rising part 4 and the side wall 3 in the top lid part 2. While examples of the joining method include methods such as a normal adhesive, a hot melt adhesive, a two-component adhesive, heat sealing, ultrasonic bonding, high frequency bonding, and the like, it is preferable from the viewpoint of manufacturing efficiency that the joining surfaces of the rising part 4 and the side wall 3 of the top lid part 2 are formed of a material having heat sealability and joined by heat sealing.

Figure 10:
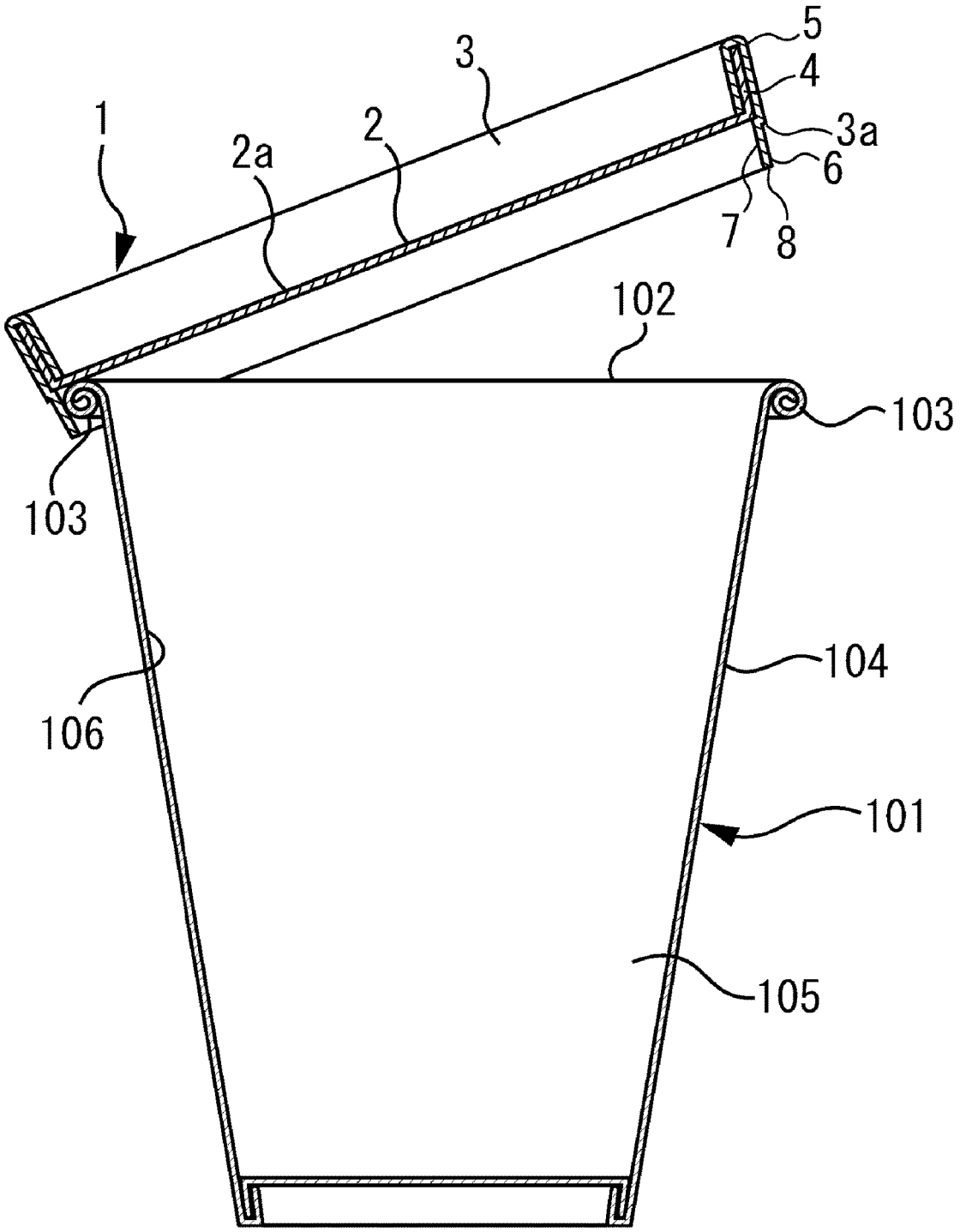
FIG. 10 is an explanatory view for explaining a function and effect when a lid is attached to a container.

FIG. 9 illustrates a state in which the lid 1 is placed on the container 101 to seal the open mouth part 102 of the container 101, and FIG. 10 illustrates a state in which the lid 1 is being placed on the container 101. The lid 1 according to the present embodiment is formed such that engaging part 7 is engaged with the edge part 103 of the container 101. The lid 1 according to the present embodiment is formed such that a lower end part 8 of the lower wall 6 does not come into contact with the side wall 104 of the container 101 when the engaging part 7 is engaged with the edge part 103 of the container 101. The lid 1 not only can close the container 101 with high sealability, but also can be easily removed from the container 101 because the lower wall 6 has elasticity. In addition, since the lower end part 8 of the lower wall 6 does not come into contact with the side wall 104 of the container 101 when the lid 1 is attached to the container 101, when the lid 1 is removed from the container 101, the lower wall 6 is pulled up by placing a finger or the like on the lower end part 8 or the like of the lower wall 6, so that the engagement between the edge part 103 of the open mouth part 102 of the container 101 and the engaging part 7 of the lid 1 is released. Then, by further pulling up the lid 1, the lid 1 can be more easily removed from the container 101.

The lid 1 has a configuration in which an engaging part 7 to be engaged with the open mouth part 102 of the container 101 is formed on the lower wall 6 of the side wall 3 formed of the paper-based material formed in a surrounding shape, that is, in an annular or cylindrical shape. In addition, the lower wall 6 of the side wall 3 provided with the engaging part 7 is excellent in elasticity as compared with a case where the lower wall 6 of the side wall 3 is folded back and joined to the top lid part 2. Therefore, even if the diameter of the engaging part 7 of the lid 1 is designed to be smaller than the outer diameter of the edge part 103 of the container 101, the lid 1 can be reliably engaged with the container 101. In addition, as described above, by designing the diameter of the engaging part 7 to be smaller than the outer diameter of the edge part 103 of the container 101, even when the pressure in a space part 105 formed in the container 101 is increased by storing content such as a liquid product like coffee, particularly a hot liquid product, in the space part 105, the lid 1 is not easily detached, and the container 101 can be closed in a state where high sealability is maintained. The side wall 3 being formed to be inclined in a tapered shape as a whole from the upper end side toward the lower end side also contributes to closing the container 101 with high sealability.

Further, in the lid 1 according to the first embodiment, since the lower wall 6 of the side wall 3 has elasticity, even if there is an error in the dimension of the open mouth part 102 of the container 101, the open mouth part 102 of the container 101 can be reliably closed to maintain high sealability. In addition, since the side wall 3 is inclined from the upper end 3*b* side to the lower end 3*c* side in a tapered manner, and the rising part 4 is joined to the inner surface 5*a* of the upper wall 5 of the side wall 3 to join and integrate the top lid part 2 and the side wall 3, the joining strength between the outer surface of the rising part 4 of the top lid part 2 and the inner surface of the upper wall 5 of the side wall 3 is increased. In particular, in the lid 1 illustrated in FIG. 1 and the like, a folded part 9 in which the upper wall 5 of the side wall 3 is folded back toward an inner surface 4*a* side of the rising part 4 is formed, and the inner surface 4*a* and a facing surface 9*a* of the folded part 9 facing the inner surface 4*a* are joined to each other. Therefore, the joining strength between the top lid part 2 and the side wall 3 is further enhanced. Therefore, even when a load force is applied to the lid 1, twisting or the like is less likely to occur in the lid body 1, there is no possibility that the engagement between the engaging part 7 and the edge part 103 of the container 101 is released, and even when the internal pressure of the sealed container 101 is increased when a hot beverage or the like is stored therein, there is very little possibility that the lid 1 is detached from the container 101.

In general, the lid 1 having a larger top lid part 2 is more likely to be twisted by a load applied to the lid 1. However, as in the lid 1 according to the first embodiment, the side wall 3 is formed to be inclined so as to be tapered from the upper end 3*b* side toward the lower end 3*c* side, and the rising part 4 formed to rise in a spreading and inclined manner is joined to the inner surface of the upper wall of the side wall 3, and further, the rising part 4 and the folded part 9 are joined to each other, whereby the possibility that the lid 1 is detached from the container 101 by a load applied to the lid 1 is reduced even when the lid 1 is large. In the lid 1, the size of a gap (in case of circular top lid part 2, diameter of lower joining point 10) of the lower joint point 10 which is a joining part between the rising part 4 of the top lid part 2 and the upper wall 5 of the side wall 3 is formed to be larger than the size of a gap (in case of circular top lid part 2, inner diameter of lower end part of engaging part 7) of the lower end part 8 of the engaging part 7, so that a reliable closed lid state can be maintained. In the lid 1 according to the present embodiment, a joint part between the upper wall 5 of the side wall 3 and the rising part 4 of the top lid part 2 is formed as a protruding wall 121 on the upper side of the top lid part 2. In a case where the content of the container 101 is a beverage such as coffee, the protruding wall can be used as a mouth pad part which is a part to which the user puts his/her mouth on when drinking the beverage, and can also be used as an overflow preventing wall for preventing the beverage from overflowing.

The container 101 is not limited to a container having a shape in which the side wall 104 is inclined, such as a container of a coffee cup or cup noodles, and may be a cylindrical container such as a container of canned nuts. The lid 1 can be used for various containers such as a paper container, a plastic container, a foamed plastic container, and a metal pipe, and is not limited to a container for storing a liquid material, and can also be used as a lid for a storage container of dried food or the like, a non-food container, or the like. In addition, the lid 1 can be used as a lid of a container such as a coffee cup, a container of cup noodles or canned nuts, or a container of soup, yogurt, ice cream, various side dishes, or a lunch box, but is not limited to a container for food and drink, and can be used as a lid of any container.

In the lid 1 of the present embodiment in which the side wall 3 is formed in a tapered shape inclined from the upper end 3*b* side to the lower end 3*c* side, an inclination angle $\alpha$ (see FIG. 9) of the side wall 3 of the lid 1 and an inclination angle $\beta$ (see FIG. 9) of the side wall 104 of the container 101 may be the same or may be different. In the case where the inclination angles are different, the inclination angle $\alpha$ of the side wall 3 may be larger or smaller than the inclination angle $\beta$ of the side wall 104 of the container 101. In a case where the inclination angle $\alpha$ is smaller than the inclination angle $\beta$ (case where inclination is large), the fitting force of the lid 1 to the container 101 becomes higher, and the sealability is further improved. The size of the inclination angle $\alpha$ of the side wall 3 of the lid 1 with respect to the inclination angle $\beta$ of the side wall 104 of the container 101 can be arbitrarily changed according to the difference in the size of the container 101 (size of lid 1) or the like in order to enhance the sealability of the lid 1. In the case of a non-circular container such as a polygonal container, by changing the inclination angle $\alpha$ of the side wall 3 of the lid 1 according to the difference in the shape of the container part into which the lid 1 is fitted, it is also possible to prevent the sealability from changing due to the difference in the part of the container.

In the lid 1 of the above embodiment, the upper wall 5 of the side wall 3 and the rising part 4 of the top lid part 2 are formed to have the same height. However, the upper wall 5 of the side wall 3 and the rising part 4 of the top lid part 2 are not limited to being formed to have the same height, and any one of the upper wall 5 of the side wall 3 and the rising part 4 of the top lid part 2 may be formed to be shorter than the other.

Examples of the paper-based material forming the side wall 3 of the lid 1 include so-called paper obtained by papermaking a slurry of fiber raw materials on a net, drying or pressure drying, and papermaking it into a sheet, so-called air-laid sheet obtained by stacking open fiber raw materials such as crushed pulp obtained by crushing raw material sheets made of pulp-based fibers and the like with a crusher by an air flow, and fixing fibers of the fibrous accumulated bodies with a binder, so-called paper produced by sticking plant fibers and other fibers, chemical fiber paper, synthetic paper, water-resistant paper, coated paper, substitute paper, parchment paper, wool paper, glass fiber paper, stone paper, porcelain paper, and the like, as well as a laminate of a plurality of these papers and the like. While the paper-based material may contain fibers such as non-pulp-based natural fibers, synthetic fibers, regenerated fibers, and the like in addition to those composed only of pulp, the paper-based material preferably contains pulp in an amount of 50 mass % or more, more preferably 70 mass % or more, further preferably 80 mass % or more, and particularly preferably 100 mass % of pulp. As the paper-based material, a film of a synthetic resin or a natural resin, a nonwoven fabric, a wood-based material or the like such as a wood foil, or a composite material with a material such as an aluminum foil can also be used. When a composite material is used as the paper-based material, the composite material preferably contains pulp in an amount of 50 mass % or more as a whole, and particularly preferably contains pulp in an amount of 80 mass % or more. The higher the content of pulp is, the more easily the paper-based material is biodegraded, which is preferable.

Examples of the pulp include wood pulp, non-wood pulp, waste paper pulp, synthetic pulp, and the like. More specifically, a mechanical pulp (MP) such as ground pulp (GP), stone ground pulp (SGP), refiner ground pulp (RGP), pressurized ground wood pulp (PGW), thermomechanical pulp (TMP), chemi-thermomechanical pulp (CTMP), and bleached chemi-thermomechanical pulp (BCTMP), chemi-groundwood pulp (CGP), semi-chemical pulp (SCP), a kraft pulp (KP) such as hardwood bleached kraft pulp (LBKP) and softwood bleached kraft pulp (NBKP), a chemical pulp (CP) such as soda pulp (AP), sulfite pulp (SP), and dissolved pulp (DP), synthetic pulp made from nylon, rayon, polyester, polyvinyl alcohol (PVA) or the like, tailings pulp (TP), a rag pulp made from cotton, flax, hemp, jute, manilla hemp, ramie, and the like, straw pulp, and those used by appropriately selecting one or several kinds from stalk pulp such as esparto pulp, bagasse pulp, bamboo pulp, and kenaf pulp and auxiliary pulp such as bast pulp. Examples of the pulp that can be used include softwood pulps such as red pine, fir tree, ezo-pine, douglas-fir, hemlock, and spruce; hardwood pulps such as beech, oak, birch, eucalyptus, poplar, and alder; wood pulps such as a mixture of softwood pulp and hardwood pulp; non-wood pulps such as kenaf, bagasse pulp, bamboo pulp, cereal pulp, straw pulp, abaca pulp, and cotton pulp; waste paper pulp, and the like. Softwood pulp has a longer fiber length than hardwood pulp, and thus the degree of entanglement between fibers is increased in a paper material using pulp having a long fiber length, such as softwood pulp. Further, crushed pulp obtained by crushing a raw material sheet using softwood pulp or the like also has a longer fiber length than crushed pulp obtained by crushing a raw material sheet made of hardwood pulp, and thus the strength of the paper-based material is improved by entanglement between fibers. As the pulp to be used, it is preferable to use biodegradable pulp among those described above.

The paper-based material preferably has water resistance, and a material to which water resistance is imparted in advance, such as water-resistant paper, may be used, or a material in which a coating layer is provided at least on a surface located on the container side of the paper-based material may be used. The coating layer can be provided by bonding a film or applying a coating agent.

Examples of the usable resin for forming the coating layer include polystyrene, polyethylene, polypropylene, polyethylene terephthalate, polyurethane, polyvinyl chloride, polyvinylidene chloride, polyvinyl acetate, cyanoacrylate, an epoxy resin, a polyacrylic acid resin, a polymethacrylic acid resin, nylon, and polycarbonate; starch-based resins such as polycaprolactone, polyhydroxyalkanoate, polyhydroxybutyrate, polylactic acid, and esterified starch, and natural degradable resins and mixtures of natural degradable resins such as cellulose acetate, polyethylene succinate, polyvinyl alcohol, polyglycolic acid, chitosan/cellulose/starch, poly (hydroxybutyrate/hydroxyhexanoate), poly (caprolactone/butylene succinate), polybutylene succinate, poly (butylene succinate/adipate), poly (butylene succinate/carbonate), poly (ethylene terephthalate/succinate), poly (butylene adipate/terephthalate), and poly (tetramethylene adipate/terephthalate); mixture of natural degradable biomass resin and natural degradable biomass resin; a fluororesin, a silicone resin, an ultraviolet curing resin, a copolymer of monomers constituting the resin, such as an ethylene-vinyl acetate copolymer, an ethylene-vinyl alcohol copolymer, an ethylene-propylene copolymer, an ethylene-propylene-butadiene copolymer, an acryl-styrene copolymer, a styrene-butadiene copolymer, or an acrylonitrile-butadiene-styrene copolymer, a natural resin, paraffin, gelatin, cellophane, polymethylpentene, and the like. The coating layer is preferably formed of natural degradable resins such as polylactic acid, polycaprolactone, polyhydroxyalkanoate, and starch-based resins, natural degradable biomass resins, and natural degradable resins such as natural resins.

Examples of the natural degradable resin include natural resins, natural degradable plastics, biomass plastics, and the like. Examples of the natural degradable plastic and the biomass plastic include starch-based resins such as polycaprolactone, polyhydroxyalkanoate, polyhydroxybutyrate, polylactic acid, and esterified starch, natural degradable resins and natural degradable resin mixtures such as cellulose acetate, polyethylene succinate, polyvinyl alcohol, polyglycolic acid, chitosan/cellulose/starch, poly (hydroxybutyrate/hydroxyhexanoate), poly (caprolactone/butylene succinate), polybutylene succinate, poly (butylene succinate/adipate), poly (butylene succinate/carbonate), poly (ethylene terephthalate/succinate), poly (butylene adipate/terephthalate), poly (tetramethylene adipate/terephthalate), and the like.

Examples of the natural degradable resin include lubricants such as stearic acid amide, fatty acid ester, fatty acid metal salt, fatty acid, fat and oil, and glycerin fatty acid ester; stabilizers such as triphenyl phosphate, phthalic anhydride, trisdibutyl phosphate, and acetic anhydride; inorganic materials such as titanium dioxide, kaolin, mica, bentonite, diatomaceous earth, magnesium oxide, quartz sand aluminum, calcium carbonate, calcium hydroxide, and seashell powder; surfactants such as higher fatty acid amides, nonionic surfactants, glycerin fatty acid esters; foaming agents such as citric acid, sodium bicarbonate, and butane; and other materials such as an antistatic agent and a hot melt adhesive, which are listed in the positive list of Japan Bioplastic Association.

In addition, the "natural degradability" refers to a property that can be decomposed by microorganisms, ultraviolet rays, changes in climate, or the like in any of air, soil, and water to reduce the environmental load. In addition, the lid is not limited by the content of the container to which the lid is attached, and can be applied to a lid that closes a container capable of containing all kinds of content.

The top lid part 2 in the lid 1 can be made of a paper-based material similar to the side wall 3, but can be made of a film or a sheet material in addition to the paper-based material. When the top lid part 2 is made of a film or a sheet material, since the top lid part 2 has higher flexibility than a case where the top lid part 2 is made of a paper-based material, fitting of the lid 1 into the container 101 becomes easier. In addition, when the top lid part 2 is made of a transparent film or sheet material, the stored object in the container 101 can be easily visually checked when the top lid part 2 is attached to the container 101. As the film and the sheet material, for example, an olefin-based resin such as polyvinyl chloride, polyvinylidene chloride, polyurethane, polyethylene terephthalate (PET), polyethylene and polypropylene, polyvinyl alcohol, polyacrylic acid which is an acrylic resin, polymethacrylic acid, an acrylonitrile-butadiene-styrene copolymer, polyethylene terephthalate, cellophane, nylon, an ethylene-vinyl alcohol copolymer, polymethylpentene, polyvinyl acetate, polylactic acid, polycaprolactone, polyhydroxyalkanoate, a starch-based resin, a composite thereof, or the like can be used, and those having biodegradability such as polyvinyl acetate, polylactic acid, polycaprolactone, polyhydroxyalkanoate, and a starch-based resin are preferable. It is also possible to use a laminate in which an aluminum layer is formed on paper or the like by vapor deposition or the like, or an aluminum layer is further provided on the surface of paper or the like, and a laminate layer or a coating layer of polyethylene, polypropylene or the like is further provided on one or both surfaces thereof. In a case where the top lid part 2 is made of a film or a sheet material, when a material such as PET which is difficult to heat-seal is used, for example, if polyethylene or polypropylene (OPP, CPP, or the like) is coated on a surface to be joined to the side wall 3, joining by heat sealing can be easily performed.

In a case where the top lid part 2 is made of a paper-based material, a film, or a sheet material, when a side of the top lid part 2 in contact with the open mouth part of the container 101 is made of a material having a heat sealability, the top lid part 2 may be joined to the edge part 103 of the container 101 by heat sealing, and the lid 1 may be removed from the container 101 while removing the seal at the time of use. In this way, it is possible to block the content of the container 101 from the outside air until the content is used. In a case where the top lid part 2 is made of a film or a sheet material, it is preferable to use a material having air permeability resistance and moisture permeability to increase the barrier property against the outside air.

In the case of closing the container 101 with the lid 1 of the first embodiment, first, as illustrated in FIG. 10, the engaging part 7 on one end side of the lid 1 is fitted into the edge part 103 of the container 101, then the engaging part 7 is sequentially fitted into the edge part 103 toward the opposite side of the lid 1, and the engaging part 7 on the other end side of the lid 1 is fitted into the edge part 103 of the container 101 so as to flex the top lid part 2, whereby the lid 1 can be fitted into the container 101 and closed as illustrated in FIG. 9. Since the lid 1 of the first embodiment has flexibility as a whole and the lower wall 6 of the side wall 3 has elasticity in the thickness direction, even when the inner dimension of the lower end part of the lower wall 6 is smaller than the outer dimension of the open mouth part of the container 101, the lid 1 can be fitted into the container 101, and the container open mouth part (edge part 103) can come into close contact with the lower wall inner surface and the top lid lower surface side of the lid 1, so that the container 101 can be reliably closed with high sealability. The lid 1 of the first embodiment can be fitted into a container open mouth part to maintain high sealability regardless of whether the container has a curled part.

Figure 3:
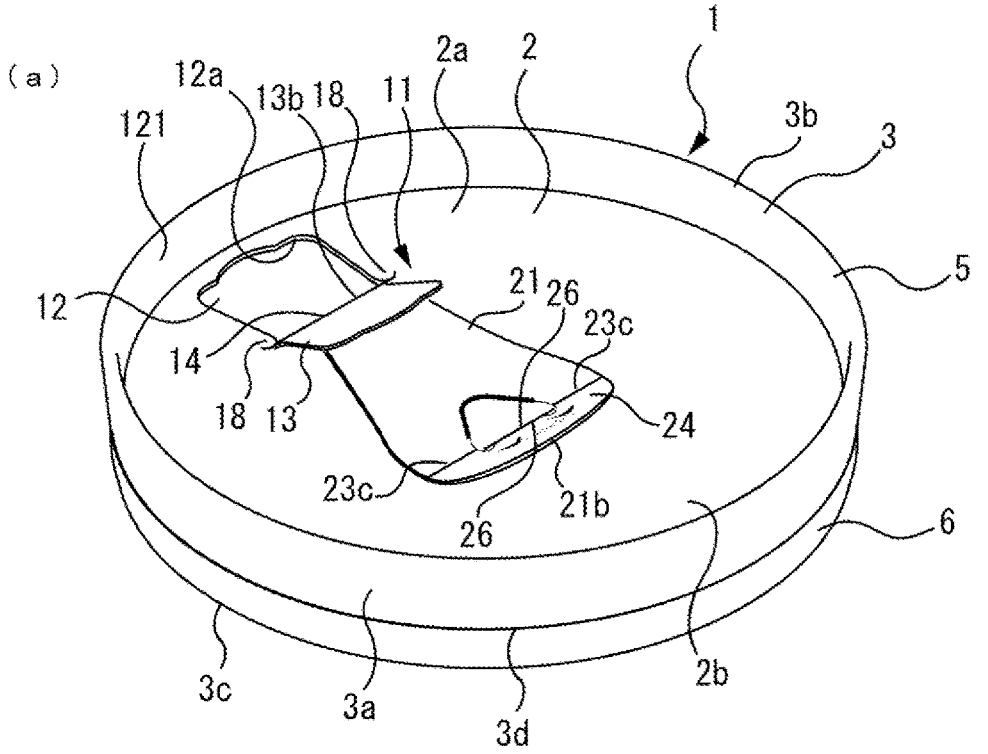
FIGS. 3(*a*) and 3(*b*) are external perspective views illustrating a lid in a state where an opening part is opened.
Figure 3:
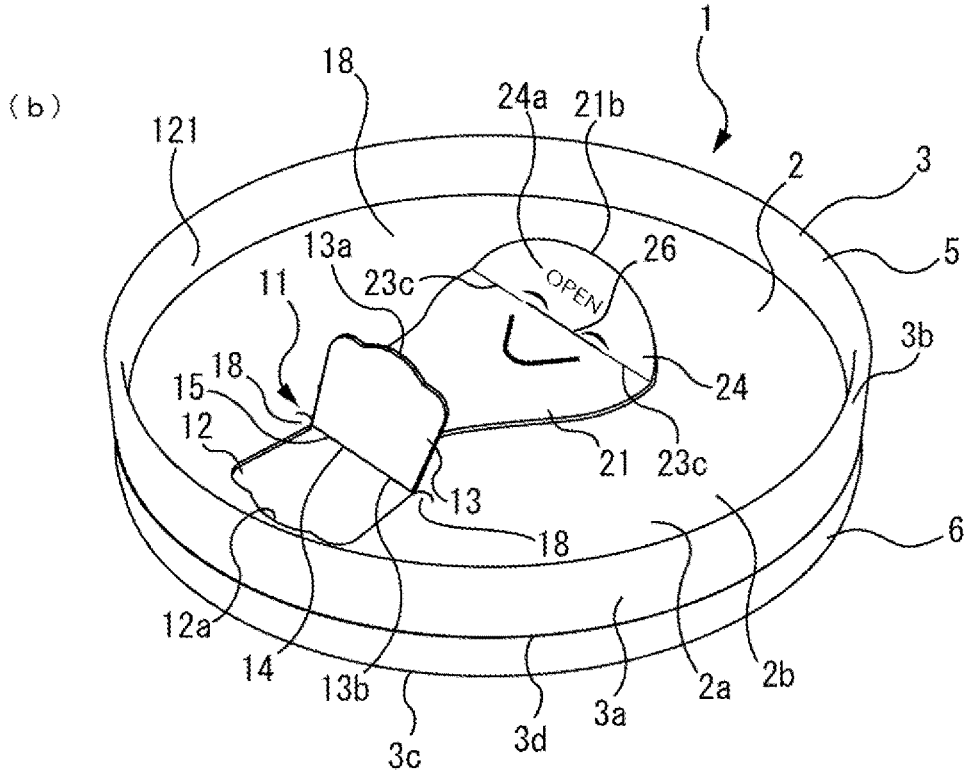
Figure 4:
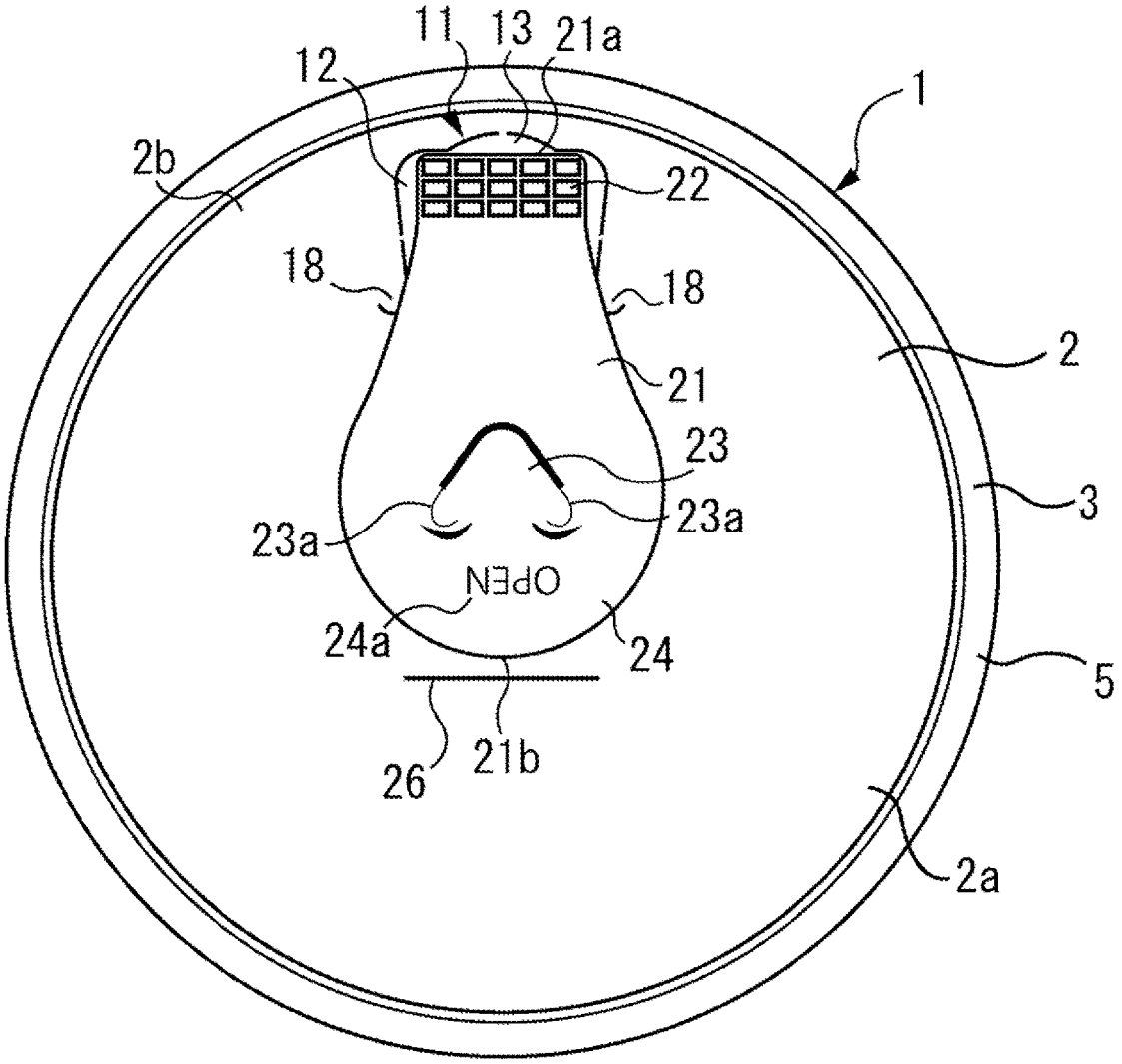
FIG. 4 is a plan view illustrating a lid in a state where a small lid piece is closed.
Figure 5:
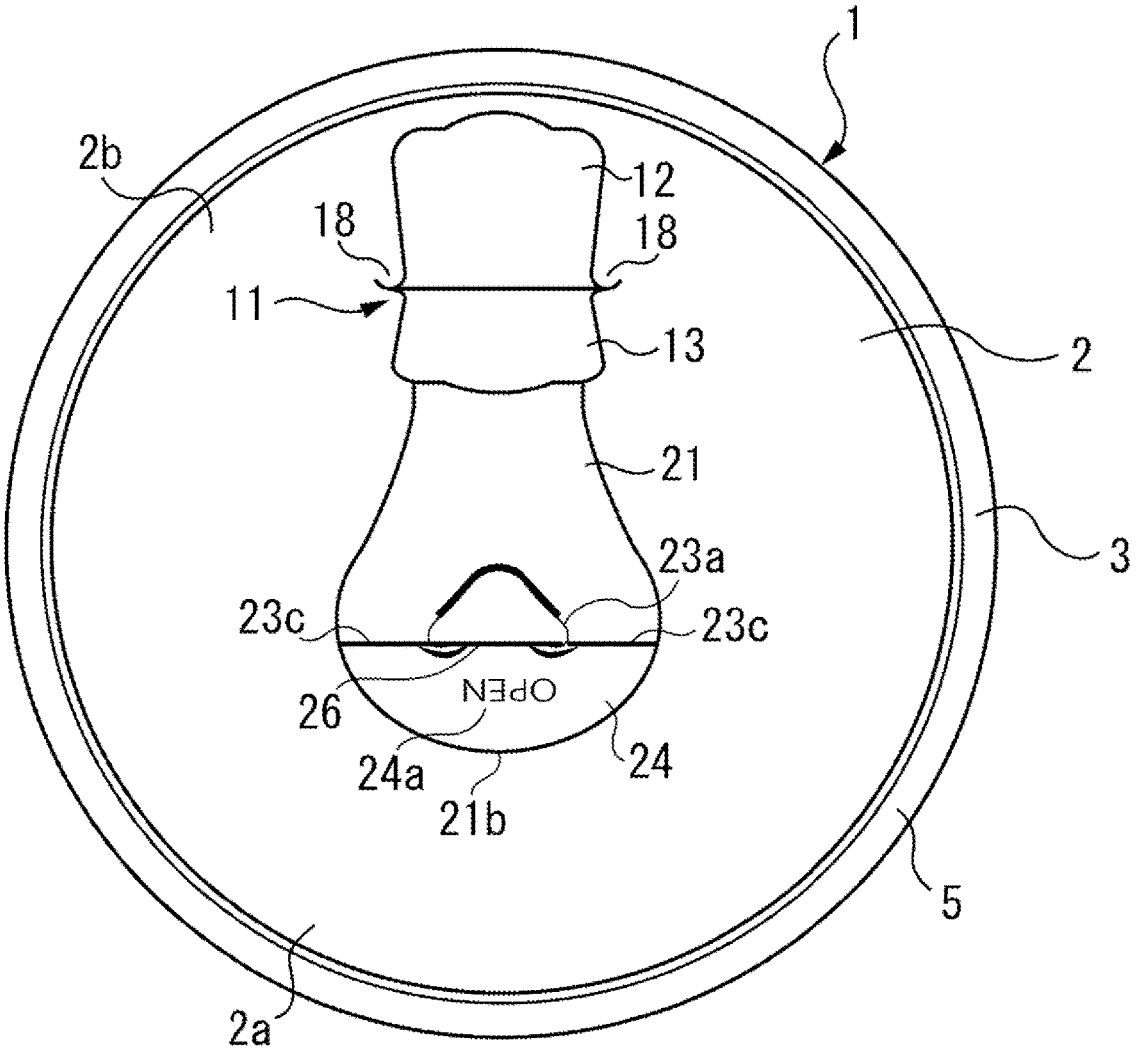
FIG. 5 is a plan view illustrating a lid in a state where a small lid piece is opened.

Next, the configuration of an opening forming part 11 and the like in the top lid part 2 will be described. As illustrated in FIG. 1 and the like, the opening forming part 11 includes the opening part 12 and the small lid piece 13. As illustrated in FIG. 1, the opening part 12 is preferably formed inside the main body 2*al* in the top surface part 2*a*. In addition, the small lid piece 13 is preferably formed so as to be able to open and close the opening part 12 of the main body 2*a*1. In this case, the small lid piece 13 and the opening part 12 are formed so that the small lid piece 13 closes the opening part 12 as illustrated in FIGS. 1 and 4, and the small lid piece 13 is opened to open the opening part 12 as illustrated in FIGS. 3 and 5. The opening part 12 constituting the opening forming part 11 is formed to communicate the inside and the outside of the top lid part 2 and penetrate a front surface 2*b* and a back surface 2*c* of the top lid part 2. For example, in a case where the lid 1 is attached to the container 101, the opening part 12 is for forming an opening of an inlet/outlet of content (for example, beverages, food, and the like) in the space part 105 of the container 101. As illustrated in FIG. 1 and the like, in the top lid part 2, the opening forming part 11 is provided at a position shifted to a predetermined position in a direction from the central part of the top lid part 2 toward the outside. In addition, the small lid piece 13 formed on the top lid part 2 is formed such that one end part 13*a* located at a position away from the central part of the top lid part 2 toward the outside by a predetermined distance is a free end, and the other end part 13*b* located closer to the center than the one end part 13*a* is a fixed end. Note that in the small lid piece 13, the one end part 13*a* is also referred to as a tip end part located near the center of the top surface part 2*a*, and the other end part 13*b* is also referred to as a tip-base end part located on the edge part side of the top surface part 2*a*. In addition, the one end part 13*a* which is the free end is also referred to as a tip end, and a position closer to the one end part 13*a*, which is the tip end, than the other end part 13*b* between the tip end and the other end part 13*b* (hinge part 14) is referred to as a "position closer to the tip end" or "close to the tip end".

The hinge part 14 is formed in the other end part 13*b*, and the small lid piece 13 is formed to be openable and closable via the hinge part 14. That is, the opening forming part 11 is configured to rotate about the hinge part 14 in the other end part 13*b* of the small lid piece 13 serving as a fulcrum, and perform a movement of opening or closing the one end part 13*a* with respect to the top lid part 2. Further, in the opening forming part 11, the opening part 12 is formed when the small lid piece 13 is opened. Note that when the small lid piece 13 is opened and closed, a bending line 15 is preferably formed on the hinge part 14 (see FIG. 12(*g*)). The bending line 15 may be formed on the front surface 2*b* side and/or the back surface 2*c* side of the top lid part 2. By forming the bending line 15 in the hinge part 14 in this way, the opening and closing movement of the small lid piece 13 can be easily performed with reference to the bending line 15. Since the other end part 13*b* of the small lid piece 13 is bent at the part where the bending line 15 is formed, the small lid piece 13 can be easily and distinctly bent when bent at the hinge part 14, that is, when opened. In other words, by forming the bending line 15, it is possible to prevent the small lid piece 13 from being bent with a part other than the part where the bending line 15 is formed as a fulcrum. The bending line 15 can be pressed in a line shape by press molding, for example. That is, the bending line 15 can be formed by performing pressing in a line shape at a predetermined part where the bending line 15 is formed by a press molding machine or the like. Since the small lid piece 13 is bent only at the specific place where the bending line 15 is formed in this way, it is possible to greatly reduce the variation in the position where the small lid piece 13 is bent. Note that any conventionally known method can be appropriately selected and used for forming the bending line 15.

In the opening forming part 11, when the small lid piece 13 is opened in a state where the lid 1 is attached to the container 101, the space part 105 of the container 101 can be visually recognized through the opening part 12. Note that the opening part 12 is desirably formed at a position where a one end-side end part 12*a* (end part on the same side as one end part of small lid piece 13) of the opening part 12 is located outside an inner wall 106 of the container 101 when the lid 1 is attached to the container 101.

In the opening forming part 11, the bending line 15 is formed at the part where the hinge part 14 is formed, and at a part other than the part where the hinge part 14 is formed, cut lines 16 are formed and a dotted joint part 17 formed between the cut lines 16 is provided. The dotted joint part 17 is for joining the small lid piece 13 to the top surface part 2*a* and keeping the opening part 12 closed. By forming the opening forming part 11 in this manner, the small lid piece 13 can be kept closed due to the presence of the dotted joint part 17 in a state before use, and the dotted joint part 17 is cut when being pulled by a tab member 21 described later or pulled up by the tab member 21, and the joining at the dotted joint part 17 is released.

Further, in addition to being formed by the cut line 16 and the dotted joint part 17 as described above, the opening forming part 11 may be formed as a half-cut part in which a cuttable line is formed entirely along the shape of the small lid piece 13 (in other words, along entire shape of opening part 12). In the case of being formed as the half-cut part, there is no cut line 16 or the dotted joint part 17 as described above, and a cut is formed along the entire shape of the small lid piece 13 (or opening part 12). The depth of the cut in the half-cut part is smaller than the overall thickness of the top lid part 2 and is formed so as not to penetrate the front surface 2*b* and the back surface 2*c* of the top lid part 2 like the cut line 16. When the cut lines 16, the dotted joint part 17, and the half-cut part are used, other than the case of forming the half-cut part in place of the cut lines 16 and the dotted joint part 17 in the lid 1, the cut lines 16 and the dotted joint part 17 may be used as well as the half-cut part.

As illustrated in FIG. 1 and the like, in the small lid piece 13, stress relieving parts 18 for relieving stress generated with respect to a force applied when the small lid piece 13 is pulled up are formed at the other end part 13*b* where the hinge part 14 is formed. In the example illustrated in FIG. 1 and the like, at a part where the hinge part 14 is formed, the stress relieving parts 18 are formed to be curved in certain directions that increase the distance between the cut lines 16 toward directions opposite to a direction in which the small lid piece 13 is formed. The stress relieving part 18 is formed such that an end part on the other end part side of the cut line 16 is at a position shifted from a radial position where the hinge part 14 is formed, that is, at a position directed radially outward of the radial position. By setting the position of the end part on the other end side of the cut line 16 in the stress relieving part 18 to the above-described position, the cut line 16 at a position adjacent to the hinge part 14 is formed, whereby the magnitude of stress applied to the position can be reduced. Note that in order to reduce the magnitude of stress generated at the position in this manner, instead of forming the position on the other end side of the cut line 16 at the same location as the location where the hinge part 14 is formed, the position of the other end side-end part of the cutting line may be formed at a position different from the position where the hinge part 14 is formed. As described above, by forming the stress relieving part 18, when the small lid piece 13 is opened, stress applied to the other end side-end part side of the cut line 16 can be reduced, and problems such as occurrence of breakage and damage in the top lid part 2 can be solved together with opening of the small lid piece 13.

Figure 6:
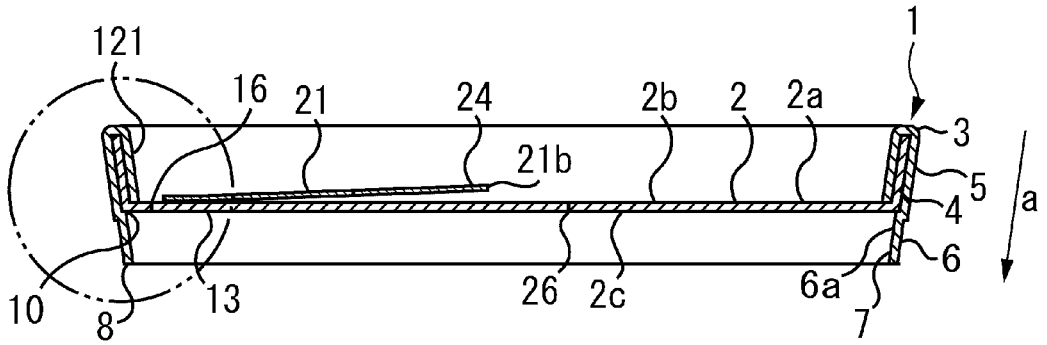
FIG. 6(*a*) is a longitudinal sectional view taken along line A-A in FIG. 1(*a*).
Figure 6:
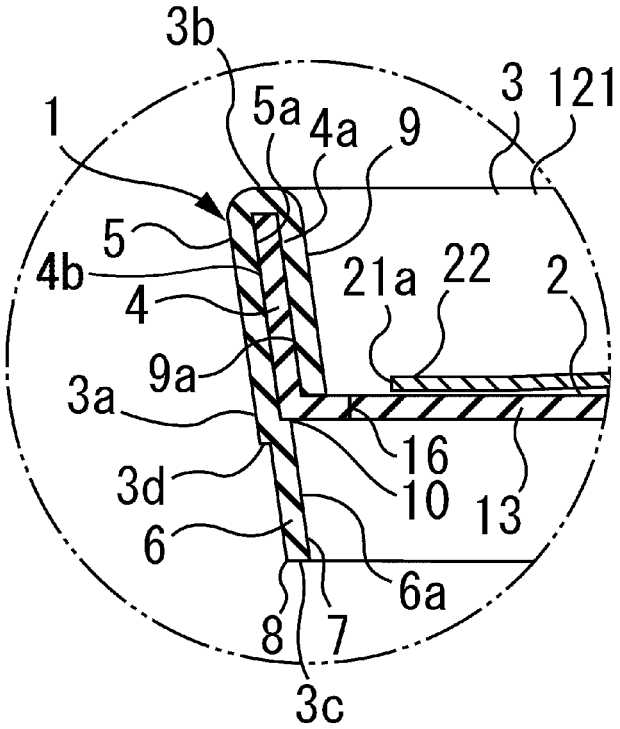
Figure 7:
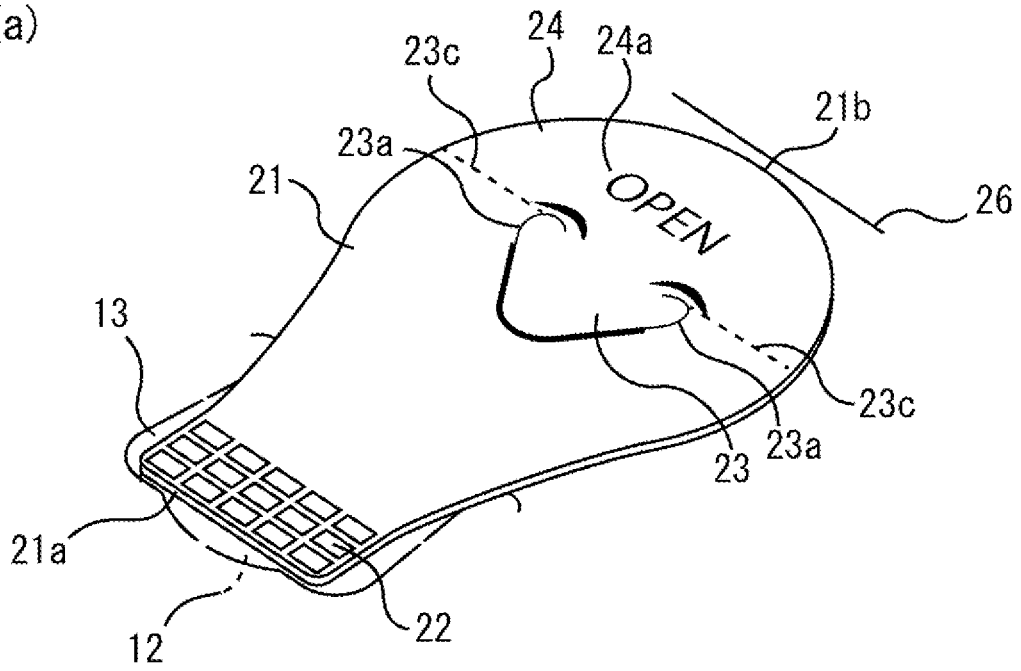
FIGS. 7(*a*) and 7(*b*) are explanatory views for explaining the configuration and effect of a tab member.
Figure 7:
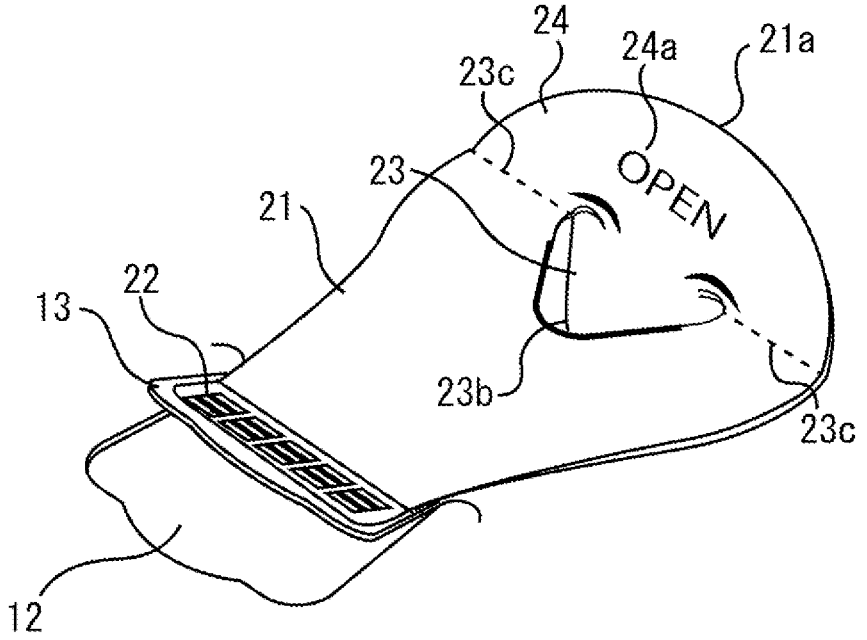

Note that as illustrated in FIG. 6, the cut line 16 may be formed perpendicularly from the front surface 2*b* to the back surface 2*c* of the top lid part 2, or may be formed so as to have a predetermined angle from the front surface 2*b* toward the back surface 2*c* of the top lid part 2. As illustrated in FIG. 6, when a cut is formed perpendicularly from the front surface 2*b* toward the back surface 2*c* of the top lid part 2, the small lid piece 13 can be relatively easily opened along the cut line 16. In addition, in a case where the cut line 16 is formed to have a predetermined angle, a cut surface formed in an inclined shape formed on the top lid part 2 side and a cut surface formed in an inclined shape formed on the small lid piece 13 side abut on each other. Therefore, even when the small lid piece 13 is about to be pulled up, or when the container 101 is closed with the lid 1 and pressed from the back surface 2*c* side toward the front surface 2*b* side of the top lid part 2 due to a change in vapor pressure in the space part 105 or the like, the cut surface on the small lid piece 13 side and the cut surface on the top lid part 2 side abut on each other, so that the small lid piece 13 can be made difficult to open. Therefore, when the lid piece is formed in this way, it is possible to more effectively prevent the small lid piece 13 from being unexpectedly opened. Note that when inclined cut surfaces are formed on the top lid part 2 side and the small lid piece 13 side, the cut surface on the top lid part 2 side is preferably an inclined surface in which a cut surface end part on the front surface side is formed closer to the center than a cut surface end part on the back surface 2*c* side. In addition, the cut surface on the small lid piece 13 side is preferably formed such that an end part of the cut surface on the back surface 2*c* side is radially outward of an end part of the cut on the front surface 2*b* side.

The opening forming part 11 can be formed by arbitrarily selecting, for example, a punching method using a Thomson type or a conventionally known method corresponding thereto. In addition, in order to form the opening forming part 11 by the method described above, the thickness of a punching blade used when performing punching is preferably 1.0 mm or less. More specifically, the thickness is more preferably 0.7 mm or less, and further preferably 0.4 mm or less. In the case where the thickness of the punching blade is 0.4 mm or less, while the cut line 16 is formed, a gap from the cut line 16 is less likely to be formed due to the characteristics of the paper material after cutting. Therefore, leakage from the cut line 16 can be greatly reduced. Note that in the present embodiment, the shape of the opening part 12 is formed to correspond to the shape of the small lid piece 13, but the shape of the opening part 12 is not limited to such a shape, and may be formed to have a shape different from the shape of the small lid piece 13. However, in this case, for example, when a gap is formed between the opening part 12 and the small lid piece 13, it is desirable to prevent dust or the like from entering the inside of the container 101 through the gap. Therefore, from the viewpoint of ease of molding of the lid 1 and eliminating the risk of foreign matter such as dust being mixed in, the opening part 12 is preferably formed to have the same shape as the shape of the small lid piece 13.

For example, in the case of the lid 1 of the container for containing a beverage as in the present embodiment, the opening part 12 is an opening formed so as to be able to function as a spout through which the beverage in the container 101 can flow out to the outside of the container 101 when the user drinks the beverage in the container 101. Furthermore, the opening part 12 may function as an insertion port through which an object such as a straw can be inserted into the space part 105 of the container 101.

As illustrated in FIG. 1 and the like, a tab member 21 is attached to the small lid piece 13. In the tab member 21, a joint part 22 joined to the small lid piece 13 at a position close to the tip end of the small lid piece 13 is formed at one end part 21*a*. That is, the joint part 22 joined to the one end part 21*a* of the tab member 21 is joined near the tip end of the small lid piece 13. The joint part 22 is for bonding to the small lid piece 13 by various methods such as ultrasonic bonding, heat sealing, and bonding with an adhesive. Among those described above, as the method of bonding in the joint part 22, it is preferable to perform ultrasonic bonding from the viewpoint of ease of bonding, strength of bonding, and the like. A part on the one end part 21*a* side where the tab member 21 is attached to the small lid piece 13 is attached to a position shifted from the central part of the small lid piece 13, a position away from the central part of the top lid part 2 in the small lid piece 13, and a position farthest from the central part of the top lid part 2. That is, the tab member 21 is attached to the small lid piece 13 at a position close to the one end part 13*a* side, that is, at a position close to the tip end of the small lid piece 13. In other words, in the small lid piece 13, the tab member 21 is formed so as to be joined to one end side of the top lid part 2. In particular, the joint part 22 where the small lid piece 13 and the tab member 21 are joined to each other is preferably formed on the one end part 13*a* side of the small lid piece 13 away from the hinge part 14.

As described above, in the small lid piece 13, if the tab member 21 is joined at the position closer to the tip end distanced from the hinge part 14, the distance to the point of force with respect to the hinge part 14 (fulcrum) can be increased. As a result, when the tab member 21 is lifted up or the like, a force is applied to the small lid piece 13 via the tab member 21, and the joining at the dotted joint part 17 and the half-cut part is released, so that the small lid piece 13 can be more easily opened and closed.

The tab member 21 has the one end part 21*a* attached to the small lid piece 13 and the other end part 21*b* facing the one end part 21*a*. In addition, the tab member 21 includes a tab main body and a holding part 23, and is preferably formed so that the holding part 23 can protrude from the tab main body. Further, in this case, the holding part 23 is formed at a position between the one end part 21*a* and the other end part 21*b* of the tab member 21, and is preferably formed in a claw shape by adding a cut line 23*a* to the tab member 21 (more specifically, tab main body). Note that the holding part 23 is formed at a position between the one end part 21*a* and the other end part 21*b*, but is preferably formed at a position close to the other end part 21*b* in the tab member 21, in other words, at a position where a knob part 24 to be described later is formed or at a position close to the knob part 24. In the state illustrated in FIGS. 1 and 4, the holding part 23 is in a state where the cut line 23*a* is formed in the tab member 21 (tab main body), but when being held by an insertion part 26 formed in the top lid part 2, that is, when the holding part 23 formed in a claw shape in the present embodiment is inserted into the cut line formed in the top surface part 2*a* as the insertion part 26, the holding part 23 is formed in a claw shape protruding from the tab member 21 (tab main body) toward the front surface 2*b* of the top lid part 2. In the present embodiment, as illustrated in FIG. 1, the shape of the holding part 23 is formed such that a tip end 23*b* is triangular and the tip end is rounded while being pointed as a whole. However, the shape of the holding part 23 is not limited to the triangular shape. For example, as the shape of the holding part 23, a conventionally known shape such as a semicircular shape, a polygonal shape such as a quadrangular shape, an elliptical shape, or the like can be arbitrarily adopted and used. That is, the holding part 23 may have any shape as long as it can be inserted into the insertion part 26 and can keep the small lid piece 13 open when being inserted into the insertion part 26, in other words, keep the opening part 12 open. The holding part 23 formed in such a shape may be referred to as a holding piece. Since the holding piece is substantially the same concept as the holding part, the holding part and the holding piece will be described below using the same reference numerals.

Figure 2:
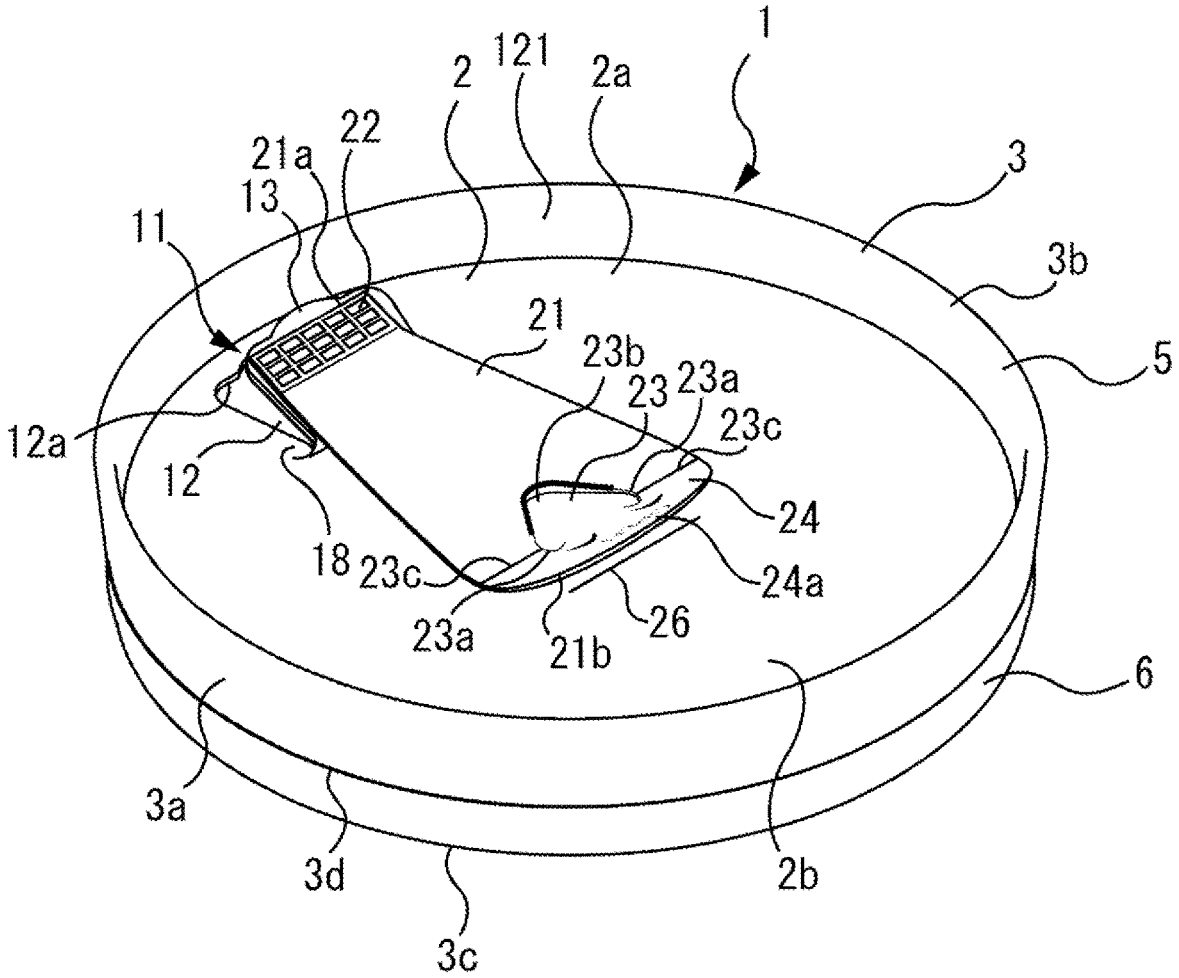
FIG. 2 is an external perspective view of a lid illustrating a movement of opening a small lid piece.

As described earlier, the holding piece 23 is formed so as to protrude from the tab main body of the tab member 21 when the small lid piece 13 is opened by gripping the knob part 24 to be described later as illustrated in FIGS. 2 and 3. The holding piece 23 is preferably formed in a direction protruding from the side of the tab member 21 where the knob part 24 is formed toward the side where the joint part 22 is formed. By forming the holding piece 23 in this manner, the holding piece 23 can be made difficult to be detached from the insertion part 26 when being inserted into the insertion part 26, and a state in which the small lid piece 13 is opened, that is, a state in which the opening part 12 is formed can be more reliably maintained. In order to make the holding piece 23 easy to protrude, a folding line 23*c* may be formed on the tab member 21. By forming such a folding line 23*c*, the holding piece 23 can be more easily inserted into the insertion part 26, and the above-described effect can be easily obtained. In addition, the insertion part 26 is formed so that the content in the container 101 does not leak or spill before the holding part 23 is inserted, and is formed to penetrate when the holding part 23 is inserted.

In addition, as illustrated in FIGS. 1, 3, and the like, the tab member 21 has the knob part 24 formed at a position on the other end part 21*b* side. The knob part 24 is formed so as to have a width wider than the part where the joint part 22 is formed at the one end part 21*a*, and is formed so that the user can easily pinch the tab member 21 when opening the small lid piece 13 using the tab member 21, can easily pull the small lid piece 13 when pulling up and opening the small lid piece 13, and further, can easily push the opened small lid piece 13 when closing the opened small lid piece 13. In the present embodiment, the knob part 24 is formed in a curved shape as a whole, but the shape of the knob part 24 is not limited to a curved shape, and any shape may be adopted as long as it is easy for the user to pinch and operate the tab member 21. A display part 24*a* is formed on the knob part 24. The display part 24*a* may be arbitrarily formed, and for example, characters "OPEN" are provided in the present embodiment. By forming the display part 24*a*, the user can be provided with notification of the function of the tab member 21 in the present embodiment. Note that the characters displayed on the display part 24*a* are not limited to the above-described example, and other characters may be written. In addition, the size of the display part 24*a*, the font, color, and the like of the written characters may be arbitrarily adopted.

Further, the knob part 24 is provided with a pattern 24*b* imitating an expression of a person. In the present embodiment, as illustrated in FIG. 1(*a*), the pattern 24*b* includes a pattern drawn along the cut line 23*a* on which the holding part 23 is formed, and a pattern drawn at a position close to a base end part of the cut line 23*a*. As described above, when the pattern drawn along the cut line 23*a* is defined as a mouth of a person, and the pattern drawn at a position close to the base end part of the cut line 23*a* is defined as eyes of a person, a design pattern depicting a smiling person is formed. Note that for the purpose of showing this pattern clearly, the description of the cut line 23*a* is omitted in FIG. 1(*b*). In addition, as illustrated in FIG. 3, when the holding part 23 is inserted into the insertion part 26 and the small lid piece 13 is opened, the pattern drawn along the cut line 23*a* is left as it is, and since the knob part 24 rises, the pattern drawn at the position close to the base end part of the cut line 23*a* changes into a pattern that gives an impression different from the design pattern described above. That is, the pattern 24*b* is formed to have different expressions before and after the holding piece 23 is protruded. In this case, the pattern 24*b* changes three-dimensionally before and after the holding piece 23 is protruded, and the expression indicated by the pattern before the holding piece 23 is protruded and the expression indicated by the pattern after the holding piece 23 is protruded are different from each other. By forming such a pattern 24*b*, the feeling of the user can be comforted and a warm feeling can be evoked. In general, such a lid 1 is often used with nothing printed thereon, or with a brand of the content, a manufacturer, or the like printed thereon. However, by providing such a pattern 24*b*, even in the lid 1 that tends to give a cold impression, it is possible to make the user feel warm by tickling the user's sense of play or comforting the user, and to give a high healing effect. Note that the mode of the pattern 24*b* described above is merely an example, and patterns other than those described above may be arbitrarily adopted and appropriately used, and the pattern 24*b* does not necessarily have to be formed on the knob part 24. Furthermore, in the above description, the pattern imitating a facial expression of a person has been described as an example of the pattern 24*b*, but the pattern 24*b* to be used is not limited to a pattern imitating a facial expression of a person, and for example, a logo mark, a product name, or the like of a store or a brand may be used as the pattern 24*b*, or the knob part 24 may simply be colored in a predetermined color.

In addition, the knob part 24 is preferably formed to rise when the holding piece 23 is inserted into the insertion part 26. By forming the knob part 24 in this manner, not only a visual effect of the pattern 24*b* described above can be obtained, but also when the holding piece 23 is inserted into the insertion part 26, it is possible to greatly reduce the complexity of the inserting movement and to facilitate the insertion. Further, when the inserted holding piece 23 is pulled out from the insertion part 26, the user can easily pinch the tab member 21, and operability can be improved.

The other end part 21*b* may be bonded to the top surface part 2*a* using the above-described adhesive or the like as necessary. Accordingly, it is possible to prevent the tab member 21 from being damaged before use.

In addition, the material forming the tab member 21 can be formed by appropriately selecting and using the same material as the material forming the top lid part 2 and the side wall 3, such as the above-described paper-based material or other materials. In addition, as a material capable of forming the tab member 21, for example, a wood piece, a film-like member, a metal member, or the like can be used. Note, however, that when these members are used, it is necessary that the holding part 23 can be formed and that the holding part 23 can maintain a state of being held in the insertion part 26. That is, any material may be appropriately selected and used as long as the tab member 21 is formed so that the user can lift the small lid piece 13 by pinching and operating the knob part 24, the holding part 23 is held by the insertion part 26, and the opening part 12 can be kept open while the holding part 23 is held in the state of being inserted into the insertion part 26.

Figure 8:
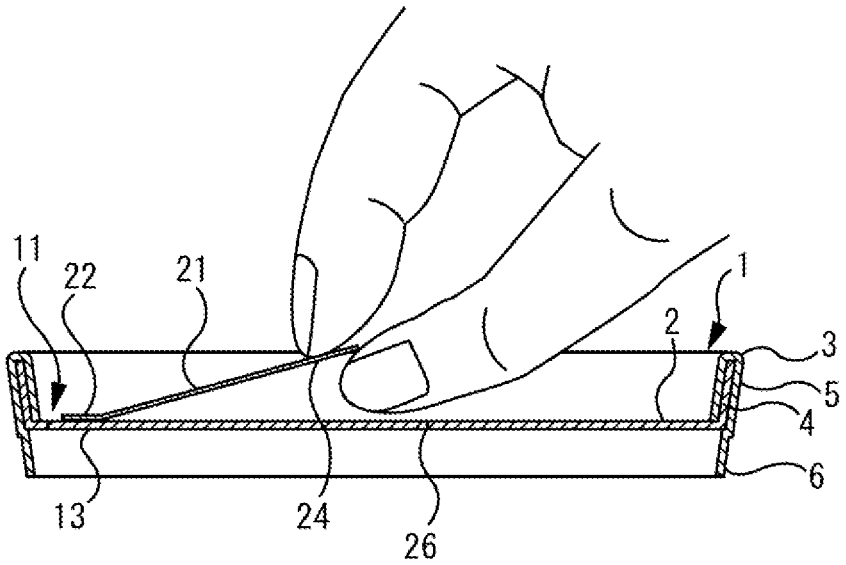
FIGS. 8(*a*), 8(*b*), and 8(*c*) are explanatory views for explaining a movement of opening the small lid piece.
Figure 8:
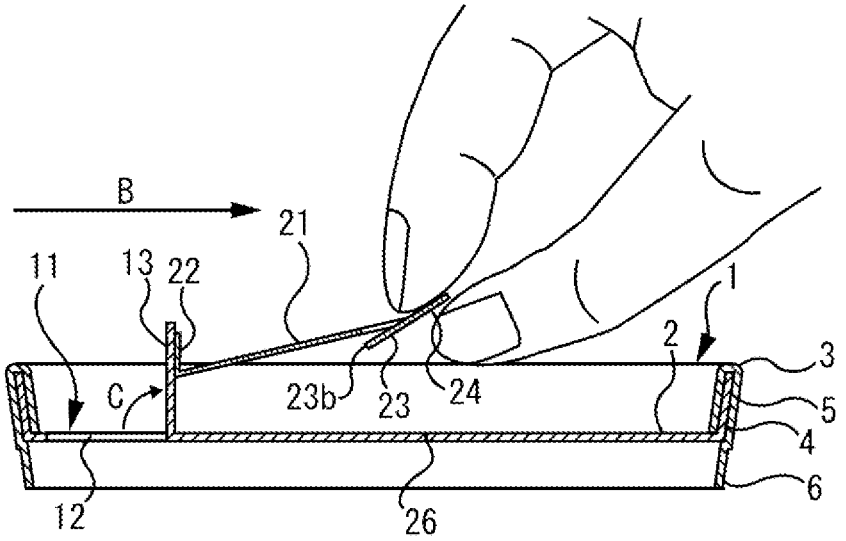
Figure 8:
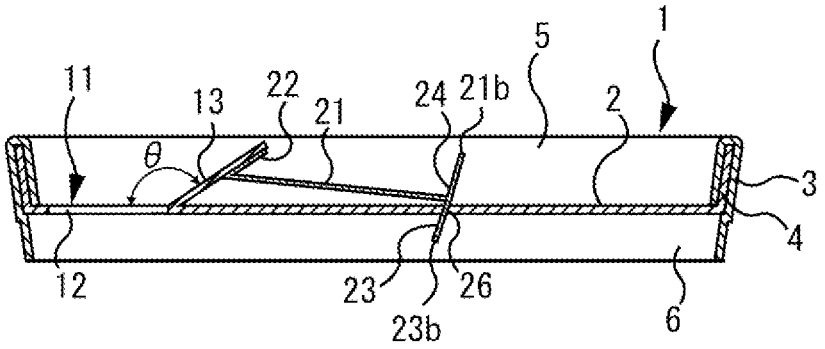

Next, the function and effect of the opening forming part 11 in the lid 1 according to the first embodiment will be described. First, as illustrated in FIG. 8(*a*), in the lid 1, the user pinches the knob part 24 of the tab member 21 and lifts the other end part 21*b* of the tab member 21. At this time, as described above, in a case where the other end part 21*b* is joined to the top lid part 2, the user peels off the tab member 21 from the front surface 2*b* of the top lid part 2 to release the joining when pinching the other end part 21*b* of the tab member 21, and pinches and lifts the knob part 24 at the other end part 21*b* of the tab member 21. Next, as illustrated in FIG. 8(*b*), when the user pulls the tab member 21 in direction B while pinching the knob part 24, the small lid piece 13 joined by the joint part 22 at the one end part 21*a* of the tab member 21 is lifted up in direction C in FIG. 8(*b*) with reference to the hinge part 14. At this time, the joint part 22 is formed in a part of the small lid piece 13, more specifically, the joint part 22 is formed closer to the tip end part of the small lid piece 13, and a non-joint part where the small lid piece 13 and the tab member 21 are not joined to each other is formed at a part other than the joint part 22 of the small lid piece 13 and the tab member 21. As described above, since the tab member 21 is joined at the position close to the one end part 13*a* side of the small lid piece 13, when the hinge part 14 is used as a fulcrum and the joint part 22 is considered as a point of force, a force of rotating and lifting the small lid piece 13 in direction C is more likely to be applied due to the force in direction B applied by the user via the joint part 22. Note that at this time, if the bending line 15 is formed at the part where the hinge part 14 is formed, the small lid piece 13 is more easily lifted in direction C. Then, when the user further pulls the tab member 21 in direction B, the small lid piece 13 continues to rotate in direction C about the other end part 13*b*, and the opening part 12 is formed. Note that at this time, the user may bend the other end part 21*b* of the tab member 21 so that the holding part 23 protrudes toward the front surface 2*b* side of the top lid part 2 while pinching the knob part 24, or may form the holding part 23 by bending the other end part 21*b* of the tab member 21 immediately before the holding part 23 is held by inserting the holding part 23 into the insertion part 26 without bending the other end part 21*b* until reaching the vicinity of the insertion part 26. Next, as illustrated in FIG. 8(*c*), the user inserts the holding part 23 into the insertion part 26. By inserting the holding part 23 into the insertion part 26 in this manner, the position of the tab member 21 and the opening position of the small lid piece 13 are physically fixed. That is, for example, when a seal having adhesiveness is used to keep the small lid piece 13 open, the back surface side of the small lid piece 13 is often peeled off immediately even if the small lid piece 13 is sealed, particularly when the content is a beverage or is hot. Therefore, even if the small lid piece 13 is to be sealed with a sticker having adhesiveness, the adhesive force gradually decreases with the lapse of time, and a phenomenon occurs in which the small lid piece 13 is eventually peeled off to return to the original position where it closes the opening part 12. When such a movement of the small lid piece 13 occurs when the user brings the front surface 2*b* of the top lid part 2 close to his/her face to drink a beverage, for example, the small lid piece 13 may touch the nose or face of the user, which may cause discomfort to the user. However, in the lid 1 according to the first embodiment, since the tab member 21 is physically fixed by holding the holding part 23 by the insertion part 26, it is possible to reliably prevent the movement of the small lid piece 13 returning to the original position with the lapse of time, and it is possible to keep the opening part 12 open. Therefore, even in a case where the user is to drink the content in the space part 105 of the container 101, the user can smoothly use the container 101 without the small lid piece 13 touching the face.

Further, according to the lid 1 of the first embodiment, since the user operates the holding part 23 to pull up the small lid piece 13, the user can open the opening part 12 without touching the back surface side of the small lid piece 13, or can operate the small lid piece 13 to close the opening part 12. Therefore, for example, since the user's finger does not touch the content attached to the back surface of the small lid piece 13, it is hygienic, and smooth operation can be performed even when the opening part 12 is opened.

Moreover, according to the lid 1 according to the first embodiment, by operating the holding piece 23 held by being inserted into the insertion part 26, the small lid piece 13 can also be moved in a direction in which the opening part 12 is closed by the small lid piece 13. Therefore, the opening and closing movement of the small lid piece 13 can be easily performed multiple times by operating the holding piece 23, and even when the content in the container 101 such as a beverage is not finished in a short time, the small lid piece 13 can be easily closed or the small lid piece 13 can be kept closed. In addition, since the lid 1 according to the first embodiment is formed using a paper-based material, it is also possible to provide an environment-friendly lid 1.

Note that when the small lid piece 13 is opened as described above, an opening angle θ of the small lid piece 13 illustrated in FIG. 8(*c*) is preferably more than 90°, more preferably 100° or more, and still more preferably 120° or more. In addition, the opening angle θ is more preferably 140° or more, and most preferably 178° or more or 180°. By opening the small lid piece 13 to such an angle, it is possible to prevent the small lid piece 13 from hitting the nose of the user when the user tries to drink the content, and it is possible to greatly reduce the user's discomfort.

Figure 12:
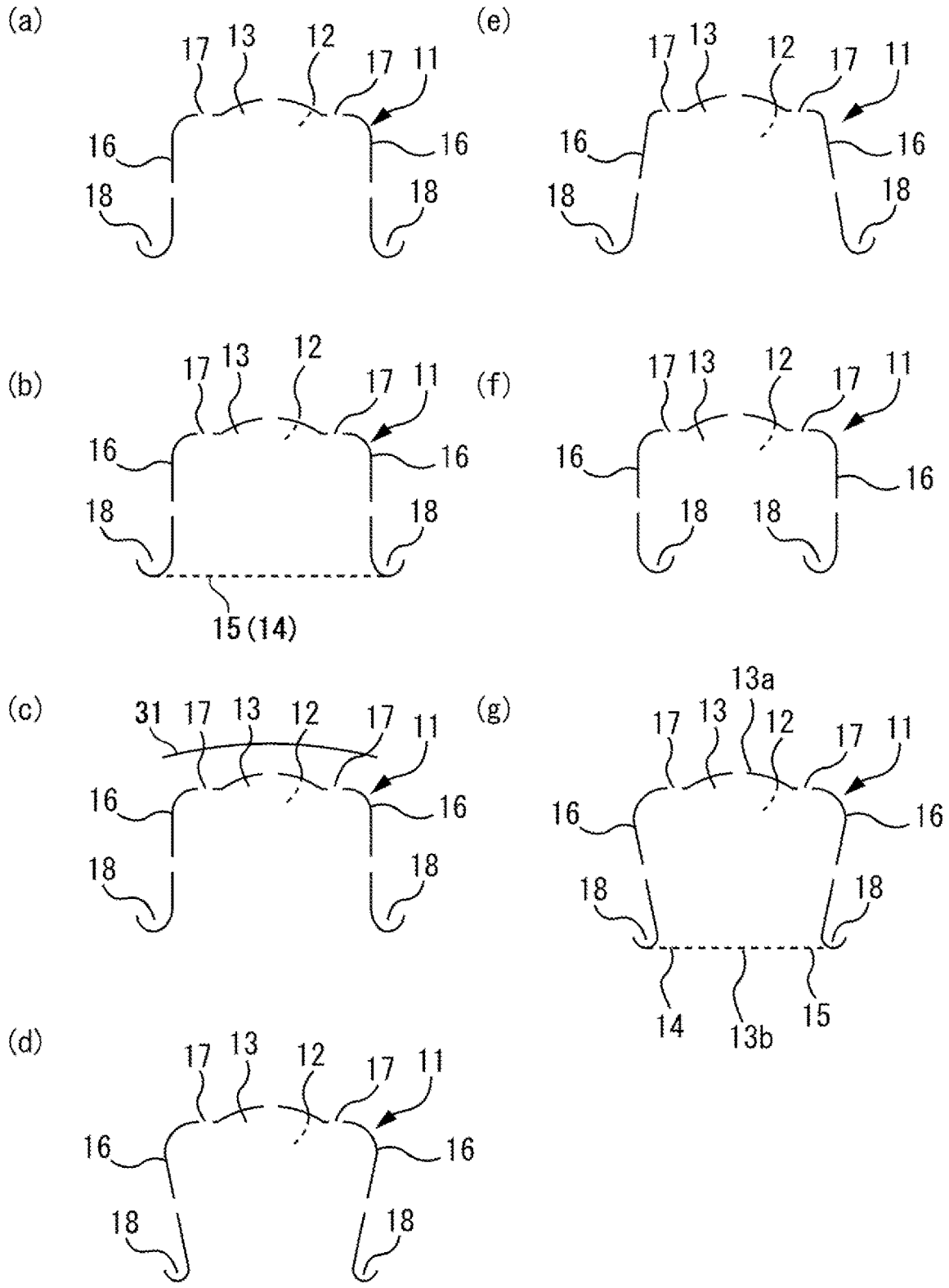
FIGS. 12(*a*) to 12(*g*) are explanatory views for explaining other modes of the small lid piece.

FIGS. 12(*a*) to 12(*f*) illustrate examples of the opening forming part 11. Note that the mode of FIG. 12(*d*) is an example of the opening forming part 11 formed in the lid 1 described above, but is also described here. Note that specifically, the opening forming part 11 has the same shape as that of the small lid piece 13, and when the small lid piece 13 is opened, the opening part 12 also has the same shape. While the shape of the opening forming part 11 will be described here, the description also includes the small lid piece 13 and the opening part 12. First, the opening forming part 11 is not limited to the shape described above, and may have an arbitrarily selected shape, for example, as illustrated in a modification described later. For example, in an opening forming part 11 illustrated in FIG. 12(*a*), dotted joint parts 17 are formed at a total of three positions, that is, one position on one end part side which is the one end part 13*a* side of the opening forming part 11, and one on each of the left and right sides in the course from the one end part side to the other end part side which is the other end part 13*b* side. Further, on the other end part side which is the other end part 13*b* side, cut lines 16 forming the opening forming part 11 are formed so as to draw an arc from the other end part side toward the one end part side. In addition, in the present modification, stress relieving parts 18 are formed on the other end part 13*b* side of the cut lines 16. The stress relieving part 18 is formed in an arc shape, and the other end part 13*b* side end part of the cut line 16 is located above the other end part 13*b* side end part of the opening forming part 11. In addition, the stress relieving part 18 is formed so as to be located outside the opening forming part 11. Since the stress relieving part 18 is formed in this manner, it is possible to prevent damage or the like of a top lid part 2 due to a force applied to a small lid piece 13 or the like when the small lid piece 13 is moved to open an opening part 12.

An opening forming part 11 illustrated in FIG. 12(*b*) has the same shape as the shape in FIG. 12(*a*) described above. Then, the opening forming part 11 illustrated in FIG. 12(*b*) is a mode in which a bending line 15 is formed on the base end side in addition to cut lines 16, and FIG. 12(*c*) is a mode in which a bending line 31 is formed on the tip end side of a small lid piece 13 in addition to cut lines 16. The bending line 15 and the bending line 31 formed in this manner are formed to specify a position where the other end part 13*b* side end part of a small lid piece 13 as the opening forming part 11 is bent when the small lid piece 13 as the opening forming part 11 changes to a rising state (that is, state of opening part 12) from a lying state (that is, state of closing opening part 12). In this manner, by forming the bending line 15 on the base end side of the opening forming part 11, it is possible to effectively curb variation in a rising manner, a risen state, and the like when the small lid piece 13 as the opening forming part 11 rises. Further, since the bending line 31 is formed at the end part on the one end part 13*a* side of the opening forming part 11, it is possible to specify a part where the top lid part 2 in which the opening forming part 11 is formed is bent. Therefore, when the opening forming part 11 moves from the lying state to the risen state, the influence on the end part on the one end part 13*a* side of the opening forming part 11 can be reduced.

An opening forming part 11 illustrated in FIG. 12(*d*) is different from the shape in FIG. 12(*a*) in that the width dimension on one end part 13*a* side is larger than the width dimension on the other end part 13*b* side. By forming the opening forming part 11 in this manner, not only the above-described effects can be obtained, but also, for example, in a case where a solid such as ice is present in the content in a container 101, it is possible to reliably prevent a risk that the solid such as ice may jump into the mouth of the user when the user is using the container 101.

An opening forming part 11 illustrated in FIG. 12(*e*) has a width dimension opposite to the shape in FIG. 12(*d*). That is, the opening forming part 11 is different in that the width dimension on the other end part 13*b* side is larger than the width dimension on one end part 13*a* side. By forming the opening forming part 11 in this manner, too, not only the above-described effects can be obtained, but also, for example, in a case where a solid such as ice is present in the content in a container 101, it is possible to reliably prevent a risk that the solid such as ice may jump into the mouth of the user in the opening forming part 11 of the present example when the user is using the container 101.

An opening forming part 11 illustrated in FIG. 12(*f*) is a mode in which a stress relieving part 18 is formed to face inward. As described above, even if the stress relieving part 18 is directed inward, since an end part of a cut line 16 is located at a position different from a hinge part 14, it is possible to prevent damage and the like of a top lid part 2 as described above.

Note that a dotted joint part 17 is more preferably formed at least at the most distal part of the one end-side end part which is an end part on the one end part 13*a* side. If the dotted joint part 17 is not formed at the above-described part, which is a part where a user's force is generally applied via a tab member 21, the opening forming part 11 can be lifted up where the user's force is applied, and the content of the container 101 may leak from an opening part 12. Such a risk can be greatly reduced. Note that in the modes illustrated in FIGS. 8(*a*) to 8(*c*), too, the cut line 16 may be formed or a half-cut part may be formed when forming the small lid piece 13 as the opening forming part 11. In addition, the small lid piece 13 as the opening forming part 11 may be formed in a mode other than these.

Figure 13:
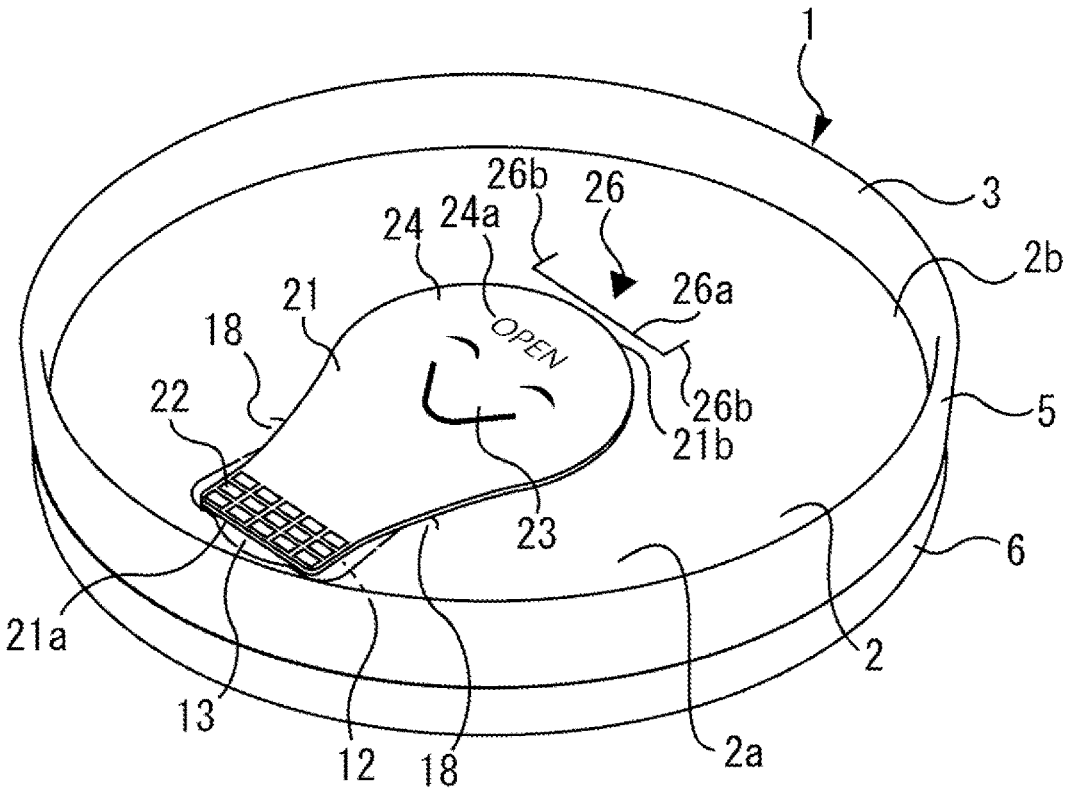
FIGS. 13(*a*) and 13(*b*) are an external perspective view and a longitudinal sectional view illustrating a first modification of the lid according to the present embodiment.
Figure 13:
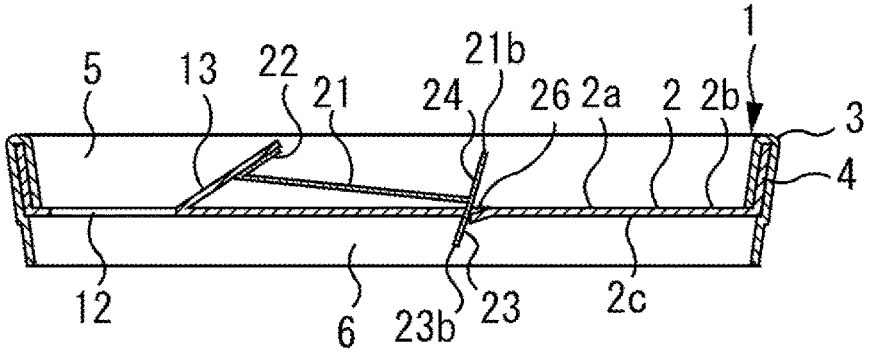
Figure 22:
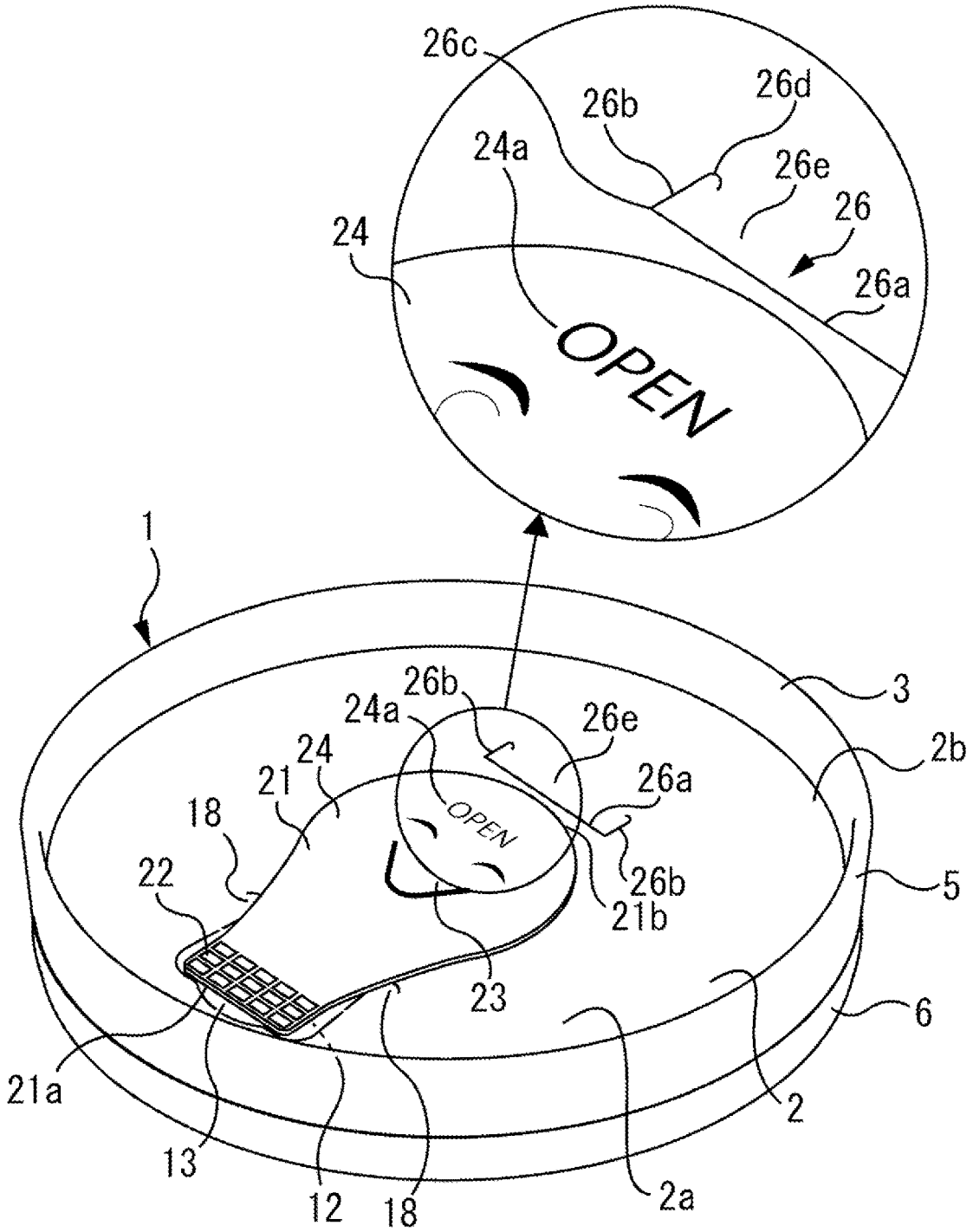
FIG. 22 is an external perspective view for explaining another mode of an insertion part in the lid.
Figure 23:
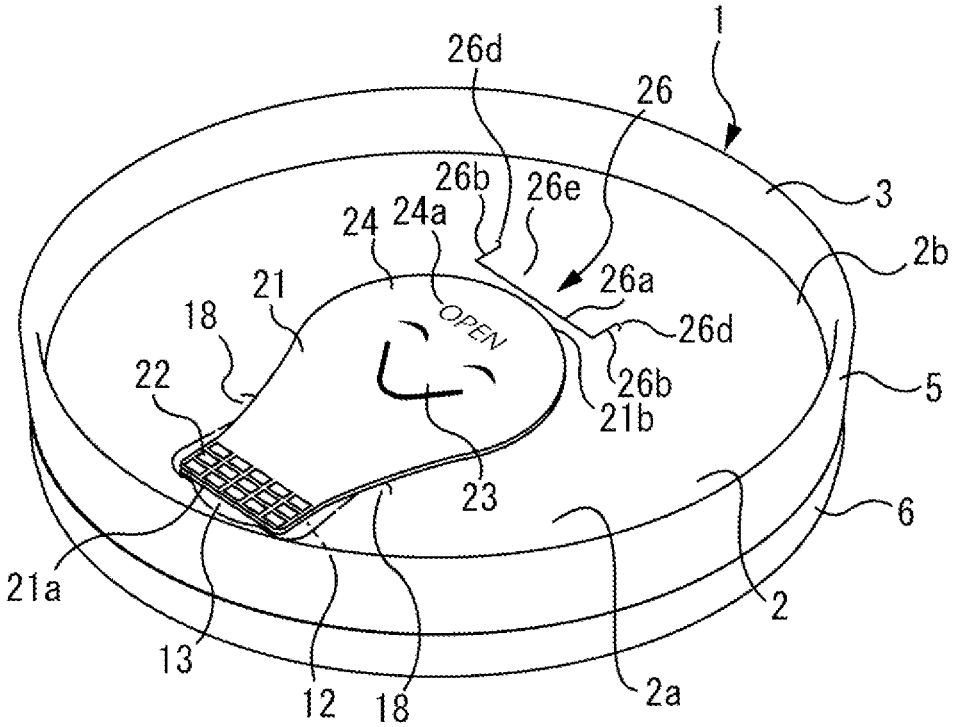
FIG. 23(*a*) is an external perspective view for explaining another mode of the insertion part in the lid.
Figure 23:
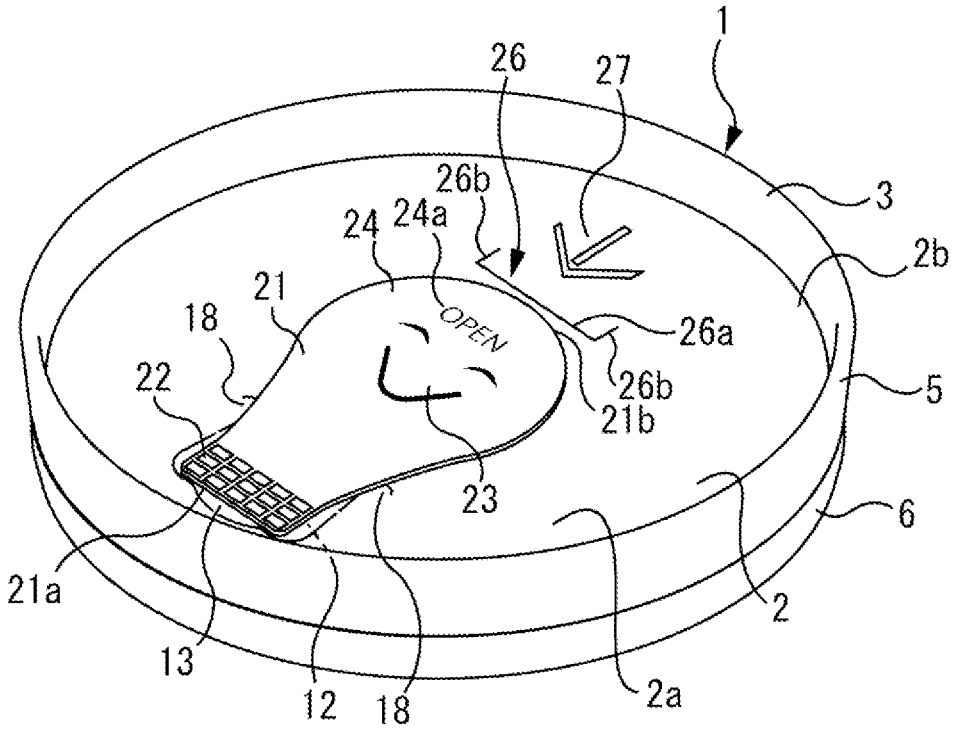

FIGS. 13, 22, and 23 illustrate modifications of the lid 1 according to the first embodiment. In the modifications illustrated in these drawings, the configuration of an insertion part 26 is different from that described above. First, in an insertion part 26 in a lid 1 illustrated in FIG. 13, the insertion part 26 includes a main part 26*a* and an auxiliary part 26*b*. The main part 26*a* is a part into which a holding piece 23 is inserted, and the auxiliary part 26*b* is formed to cross the main part 26*a*. By forming the insertion part 26 in this manner, as illustrated in FIG. 13(*b*), when the holding piece 23 is inserted into the insertion part 26, the auxiliary part 26*b* allows the main part 26*a* to move easily in the vertical direction along the movement of the holding piece 23. Therefore, the holding piece 23 can be easily inserted into the insertion part 26. Note that the auxiliary part 26*b* is preferably formed in the main part 26*a* so as to cross the main part 26*a* at a position away from a position where the tab member 21 is provided.

Further, a lid 1 illustrated in FIG. 22 is the same as the modification described above in that an insertion part 26 is formed of a main part 26*a* and an auxiliary part 26*b*. In addition, in the insertion part 26 of the lid 1 according to the present modification, the main part 26*a* and the auxiliary part 26*b* are formed continuously, and the auxiliary part 26*b* is a continuous part 26*c* in which an end part on one end side is continuous with the main part 26*a*. Further, in the auxiliary part 26*b*, an end part on the other end side located on the opposite side to the end part on one end side which is the continuous part 26*c* is formed as an insertion assisting part 26*d*. The insertion assisting part 26*d* is formed to more easily deform a part (hereinafter also referred to as "insertion part forming region 26*e*") surrounded by the main part 26*a* and the auxiliary part 26*b* in the insertion part 26 along with the movement of inserting a holding piece 23 when the holding piece 23 is inserted into the insertion part 26. The insertion assisting part 26*d* is preferably formed in a direction different from a direction in which the auxiliary part 26*b* extends from an end part on one end side toward an end part on the other end side. For example, as illustrated in FIG. 22, the insertion assisting part 26*d* is preferably formed such that an end part on the other end side of the auxiliary part 26*b* curves inward toward the insertion part forming region 26*e*. When the insertion assisting part 26*d* is formed in this manner, the part formed as the insertion part forming region 26*e* in the insertion part 26 can be more easily deformed along with the insertion movement of the holding piece 23, and the insertion movement of the holding piece 23 can be more smoothly performed. Then, the holding piece 23 inserted into the insertion part 26 can be maintained in a state where the back surface side of the holding piece 23, in other words, the side of a surface facing the top surface part 2*a* in the state before a tab member 21 is used abuts on the insertion part 26. Therefore, the state in which the holding piece 23 is physically inserted into the insertion part 26 can be more easily maintained, and the inconvenience that the holding piece 23 is detached from the insertion part 26 due to an unexpected impact or the like can be reduced. On the other hand, when the user holds a knob part 24 and tries to pull out the holding piece 23 from the insertion part 26, the holding piece can be pulled out smoothly. Hence, operability can be greatly improved when the user performs a movement of inserting the holding piece 23 into the insertion part 26 or a movement of pulling out the holding piece 23 from the insertion part 26.

The insertion assisting part 26*d* may have a mode as illustrated in FIG. 23(*a*). FIG. 23(*a*) illustrates still another modification of the insertion part 26 in the lid 1. In this example, an insertion assisting part 26*d* in an insertion part 26 is formed so as to curve in a direction away from an insertion part forming region 26*e*, in other words, toward a region opposite to the insertion part forming region 26*e*. The insertion assisting part 26*d* may be formed in this manner.

FIG. 23(*b*) illustrates another modification of the lid 1. In a lid 1 according to this modification, a guide display part 27 is formed between an insertion part 26 and an edge part 2*d* of a top surface part 2*a*. The guide display part 27 is for guiding the position to which a holding piece 23 is inserted by providing notification to the user of the position of the insertion part 26. The guide display part 27 can be arbitrarily formed using a conventionally known method. For example, the guide display part 27 may be formed by embossing the top surface part 2*a* to form irregularities on a surface 2*c* of the top surface part 2*a*, or may be formed by printing on the surface 2*c* of the top surface part 2*a*. Alternatively, the guide display part 27 may be formed by a method other than these. Forming the guide display part 27 makes it possible to further improve the operability of a tab member 21 by the user by providing notification of and guiding the position of the insertion part 26 into which the holding piece 23 is inserted when the user performs a movement of pinching a knob part 24 of a tab member 21, pulling up a small lid piece 13, and opening an opening part 12, for example. When the insertion part 26 is formed by a cut line as in the present example, the user may be confused by not knowing the position of the cut line. In such a case, by forming the guide display part 27 in the present example, the user can be provided with notification of the position of the insertion part 26, and the above-described operability can be improved. Note that in FIG. 23(*b*), a shape of an arrow indicating the position of the insertion part 26 is used as an example of the guide display part 27. However, the guide display part 27 only needs to be able to guide the position of the insertion part 26 to the user, and the shape and configuration are not limited to this mode, and various modes may be arbitrarily adopted.

Next, another modification of the tab member 21 will be described with reference to FIGS. 24 to 27. In a tab member 21 illustrated in these examples, an identification display part 28 as a display part is formed. The identification display part 28 is for making it easy to identify the type of content (for example, beverages) put in a container 101 when a lid 1 is used for the container 101 with the lid closed. The identification display part 28 is formed to extend or protrude from a tab main body of the tab member 21 in the width direction, in other words, in a direction intersecting with a direction of moving the tab member 21 when the user operates the tab member 21, more specifically, in a direction orthogonal to the direction of moving the tab member 21. In the example illustrated in FIG. 24, a total of four identification display parts 28, two at each end in the width direction, are formed, and each of the identification display parts 28 is provided with a display indicating the type of the content, such as "Orange", "Cola", "Latte", or "Tea". As also illustrated in the drawings, a predetermined coloring is applied to the part where the identification display part 28 is formed. In this case, for example, by coloring with a color corresponding to the color of the content such that the color of the identification display part 28 of "Orange" representing orange juice is orange, the color of the identification display part 28 of "Cola" is brown, the color of the identification display part 28 of "Latte" is light brown, and the color of the identification display part 28 of "Tea" is light red or green, it is possible to facilitate identification at a glance. In this case, when the predetermined coloring is applied to the identification display part 28, the notation of the characters on the identification display part 28 may be difficult to see with black characters depending on the applied color. In such a case, the characters in the identification display part 28 may be displayed in white, or may be displayed in another color with good readability. When the colors of the identification display parts 28 are changed in this manner, the tab member 21 can easily give a vivid impression as a whole to a person who looks at the lid 1. Therefore, in combination with the effect of the pattern 24*b* imitating a facial expression of a person like the tab member 21 in this example, it is possible to more easily give a good visual impression to a person who picks up the lid 1.

Figure 24:
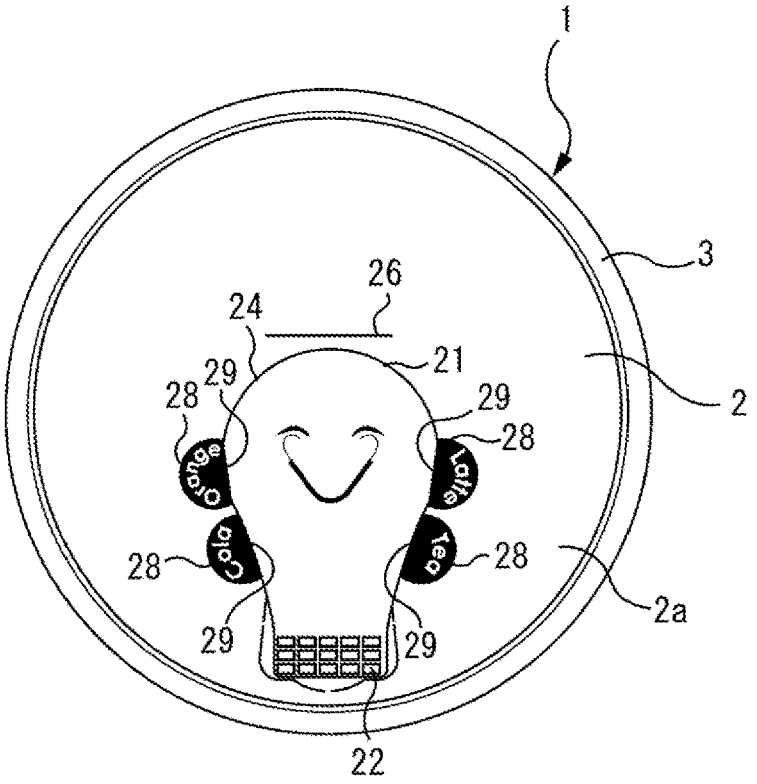
FIG. 24(*a*) is a plan view illustrating a configuration of a lid having a tab member of another mode.
Figure 24:
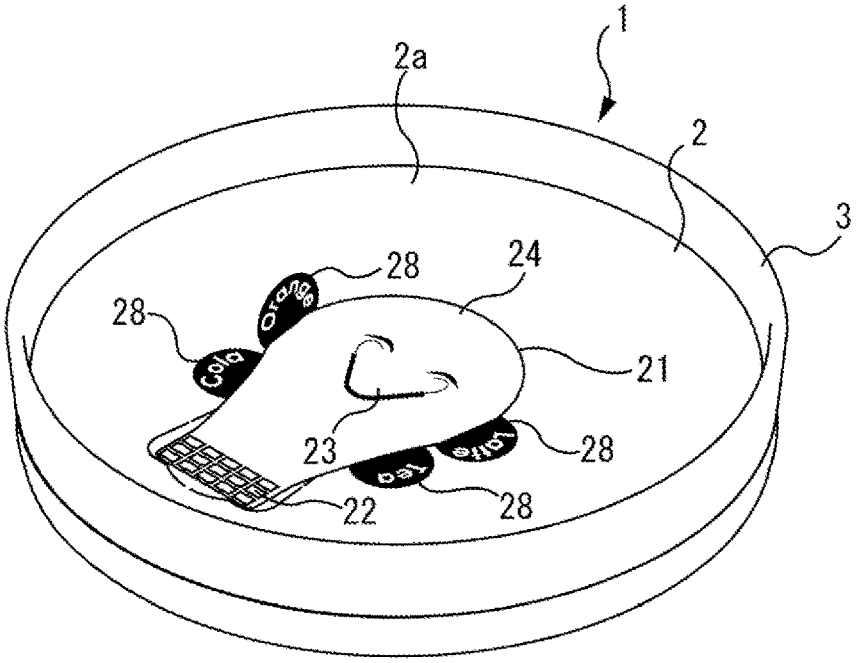

As illustrated in FIG. 24(*b*), the identification display part 28 is configured to be bendable with respect to the tab main body. In this case, it is possible to make it easier to bend by forming a cut or the like as a bending assisting part at the bending part. When the identification display part 28 is bent in this manner, the user can determine at a glance what the content of the container closed by the lid 1 is by the identification display part 28. For example, as illustrated in FIG. 24(*b*), when the identification display part 28 of "Orange" of the identification display parts 28 of the tab member 21 is folded, the user can determine at a glance that orange juice is in the container 101, and it is possible to easily prevent a mistake of taking the wrong container 101. In addition, from the viewpoint of a person on the side of providing the beverage or the like, since the identification display part 28 can display the content of the container 101 only by bending the identification display part 28 corresponding to the content, it is possible to prevent misplacement on the side of the provider and to provide the product to the customer while easily confirming the content. Hence, it is possible to provide the beverage or the like smoothly.

Note that in the identification display part 28, an example in which different coloring is applied to each identification display part 28 has been described in the above description. However, it is also possible to color all the identification display parts 28 in the same color, or not color any of the identification display parts 28. In addition, the types of the content described in the identification display part 28 are not limited to those described above, and other types of content may be appropriately used. In addition, in the example illustrated in FIG. 24, an example in which four identification display parts 28 are formed has been described, but the number of identification display parts 28 is not limited to four, and may be more or less than four. Furthermore, in FIG. 24(*b*), an example in which only the identification display part 28 of "Orange" of the identification display parts 28 is bent has been described, but it goes without saying that other identification display parts 28 other than "Orange" can also be bent.

Figure 25:
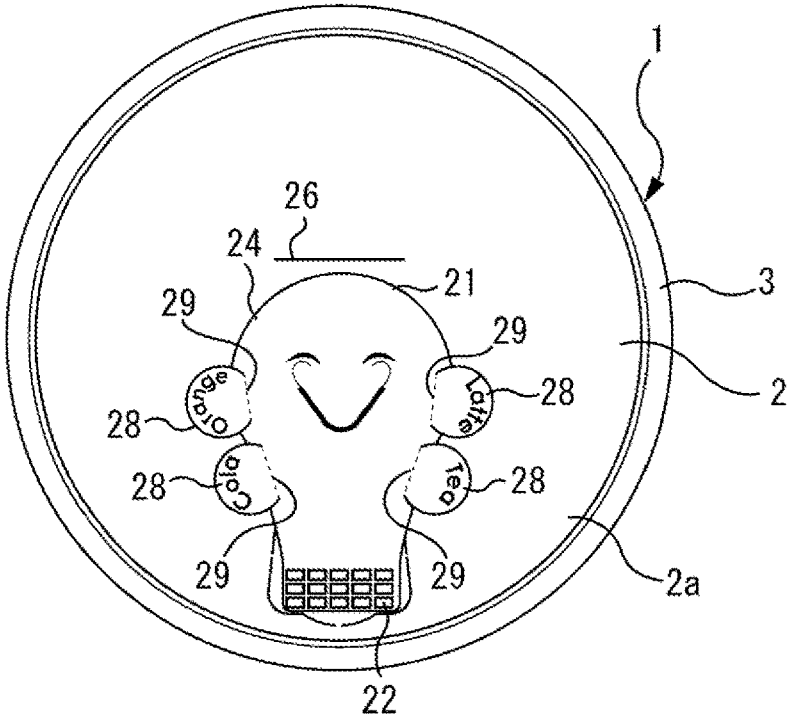
FIG. 25(*a*) is a plan view illustrating a configuration of a lid having a tab member of another mode.
Figure 25:
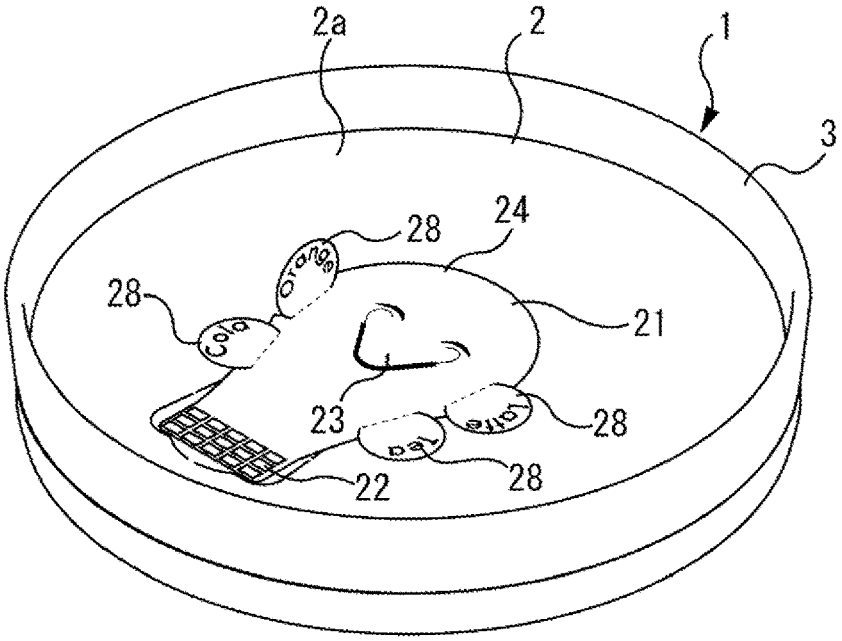

FIG. 25 illustrates another example of the identification display part 28 of the tab member 21. An identification display part 28 illustrated in FIG. 25 is formed such that the position where a bending assisting part 29 is formed is located further on the inner side of the tab main body than that illustrated in FIG. 24. With such a configuration, even when the identification display part 28 is formed, it is possible not only to obtain a function and effect similar to that described above, but also to reduce the size of a tab member 21. In another example of the identification display part 28 illustrated in FIG. 26, an identification display part 28 is formed by making cuts in a tab main body. That is, this is an example in which the outer edge of the identification display part 28 is formed to also serve as the outer edge of the tab main body. In this way, the identification display part 28 can be formed without changing the size and shape of a tab member 21 described above.

Figure 26:
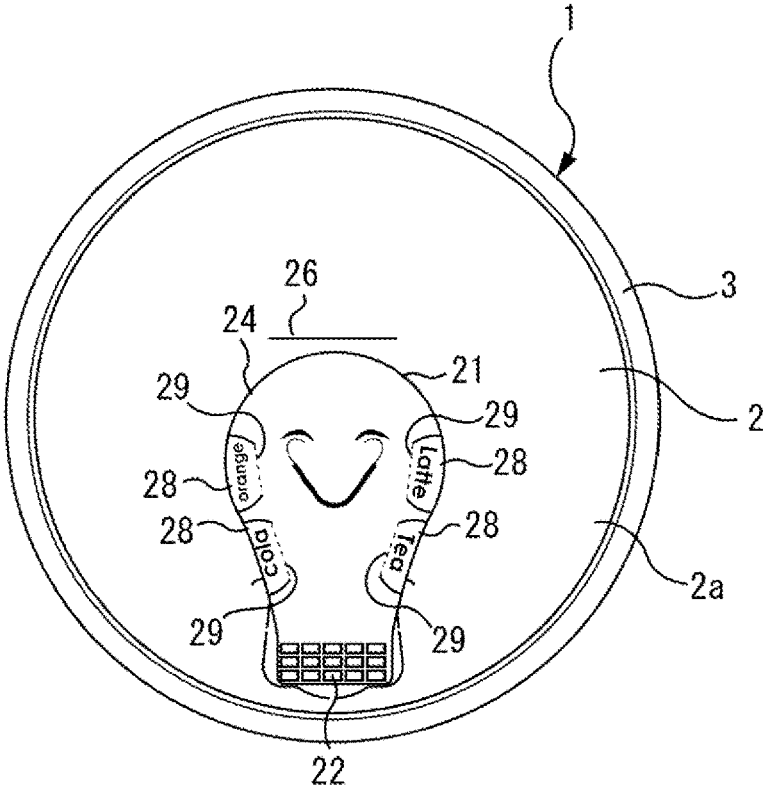
FIG. 26(*a*) is a plan view illustrating a configuration of a lid having a tab member of another mode.
Figure 26:
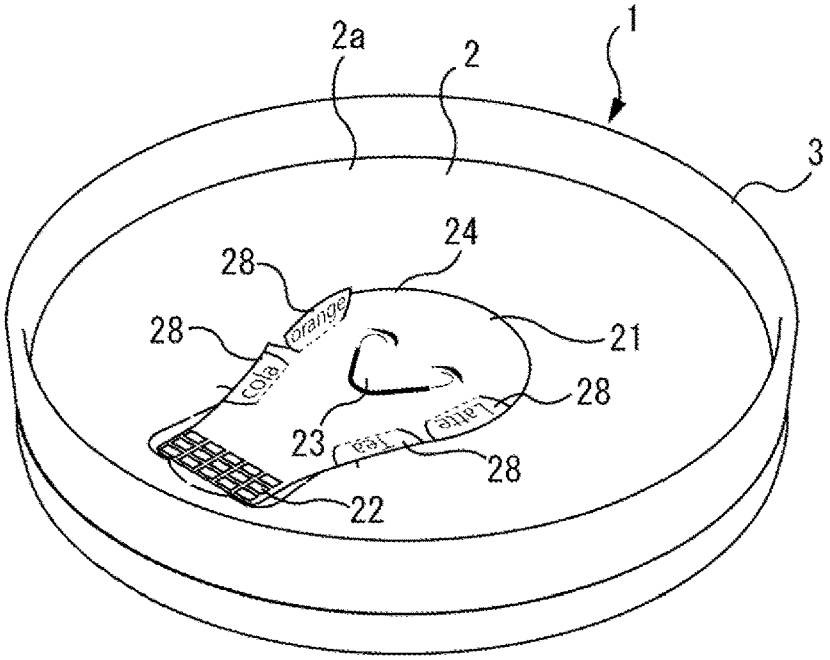
Figure 27:
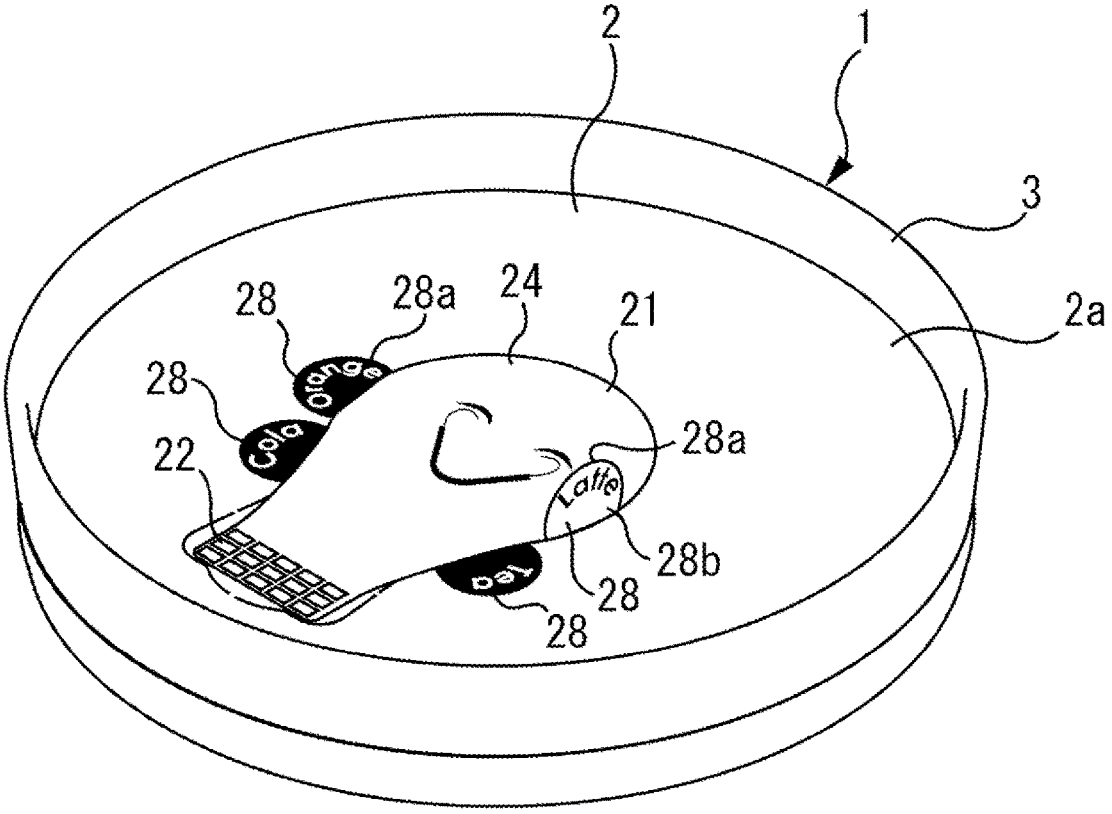
FIG. 27 is an external perspective view illustrating a configuration of a lid having a tab member of another mode.

In addition, in the identification display parts 28 described with reference to FIGS. 24 to 26, as illustrated in FIG. 27, the display of content may also be provided on the back surface side of an identification display part 28. As described above, by providing the display of the content not only on a front surface 28*a* side but also on a back surface 28*b* side of the identification display part 28, even when the identification display part 28 corresponding to the content is bent as described above, the content can be easily identified by looking at the notation written on any of the front surface 28*a* and the back surface 28*b*. Therefore, it is possible to make it easier for a person who provides a beverage or the like and a user who is provided with the beverage or the like, for example, to distinguish the content. Note that the notation on the back surface 28*b* side of the identification display part 28 may be the same as or different from the notation on the front surface 28*a* side. For example, in the case of the identification display part 28 described above with the notation of "Orange", the front surface 28*a* side may be colored in orange and displayed as "Orange" with white characters, and the back surface 28*b* side may be displayed as "Orange" with black characters on background color of paper with no coloring, or the notation of "Orange" on the back surface 28*b* side may be displayed in the orange color used for the coloring of the front surface 28*a*. In this way, it is possible not only to easily identify which of the front surface 28*a* and the back surface 28*b* the content is displayed on in the identification display part 28, but also to easily identify the type of the content. In addition, in the identification display part 28, coloring or writing of characters is performed using the same color on both the front surface 28*a* and the back surface 28*b*, so that the user can confirm what type of content is contained in which container at a glance. As described above, in a case where the identification display part 28 is formed on the tab member 21, it is possible to identify what the content of the container 101 is by bending the identification display part 28 as described above, to prevent a mistake of taking the wrong product, and to eat or drink after knowing what the content is. Therefore, it is also possible to give a sense of security. Note that in the above description, it has been described that the identification display part 28 is configured such that the content can be identified by being bent in the direction intersecting the tab main body. In the identification display part 28, it is preferable that an angle formed by a state before being bent and a state after being bent is close to 180°. In addition, it is more preferable to configure the identification display part 28 such that the bent state can be maintained when it is bent in this way. With this configuration, the identification display part 28 makes it easier to identify the content of the container 101, and allows the user to eat and drink with a more secure feeling.

Figure 53:
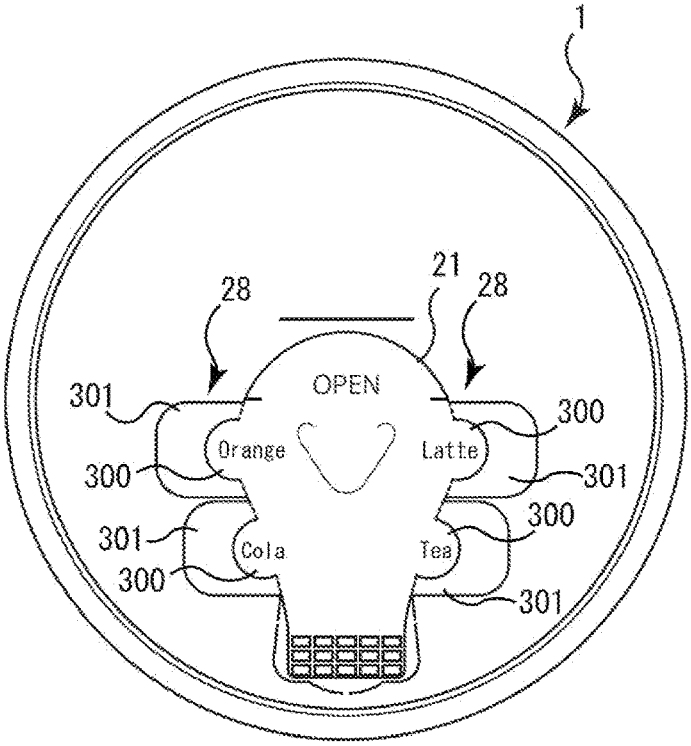
FIG. 53(*a*) is a plan view illustrating a configuration of a lid having a tab member of another mode.
Figure 53:
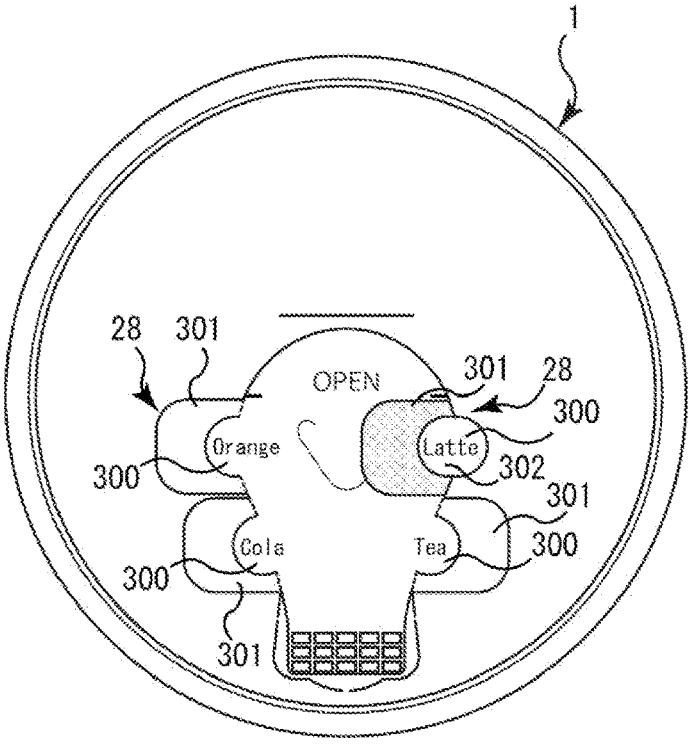

Further, the identification display part 28 of the tab member 21 is not limited to the configuration described above. For example, as illustrated in FIG. 53, in a case of displaying the type of content such as "LATTE", a display part 300 with such display may be formed on a tab main body so that a predetermined part of the outer peripheral part of the display part 300 becomes a bending part 301 formed to be bendable. In a case where an identification display part 28 is formed by the display part 300 and the bending part 301 in this manner, when the content of a container 101 is latte, for example, the bending part 301 corresponding to a part where the display of the display part 300 is "LATTE" is bent toward the tab main body. At this time, when the bending part 301 is bent to approximately 180°, as illustrated in FIG. 53(*b*), a display window 302 in which the display part 300 can be visually recognized even if the bending part 301 is bent is formed. By forming the identification display part 28 in this manner, it is possible to visually confirm that what is displayed on the display window 302 is the content of the container 101. By forming the identification display part 28 in this way, it is possible to make it easy for the user or the provider to confirm what the content is, and it is possible to give a sense of security. Note that the method of identifying the content by the identification display part 28 is not limited to the above-described methods. For example, notification of the content of the container 101 may be provided by, for example, tearing the bending part 301 or the like described above, or if the user or the provider can easily confirm the identification of the content, a mode other than those described above may be used.

FIGS. 14 to 21 illustrate other examples of the top lid part 2 and the side wall 3 of the lid according to the first embodiment. Note that what is illustrated here is merely an example, and it is a matter of course that the top lid part 2 and the side wall 3 having other configurations may be used. Note that in FIGS. 14 to 17, description of the tab member 21 is omitted for convenience of description.

Figure 14:
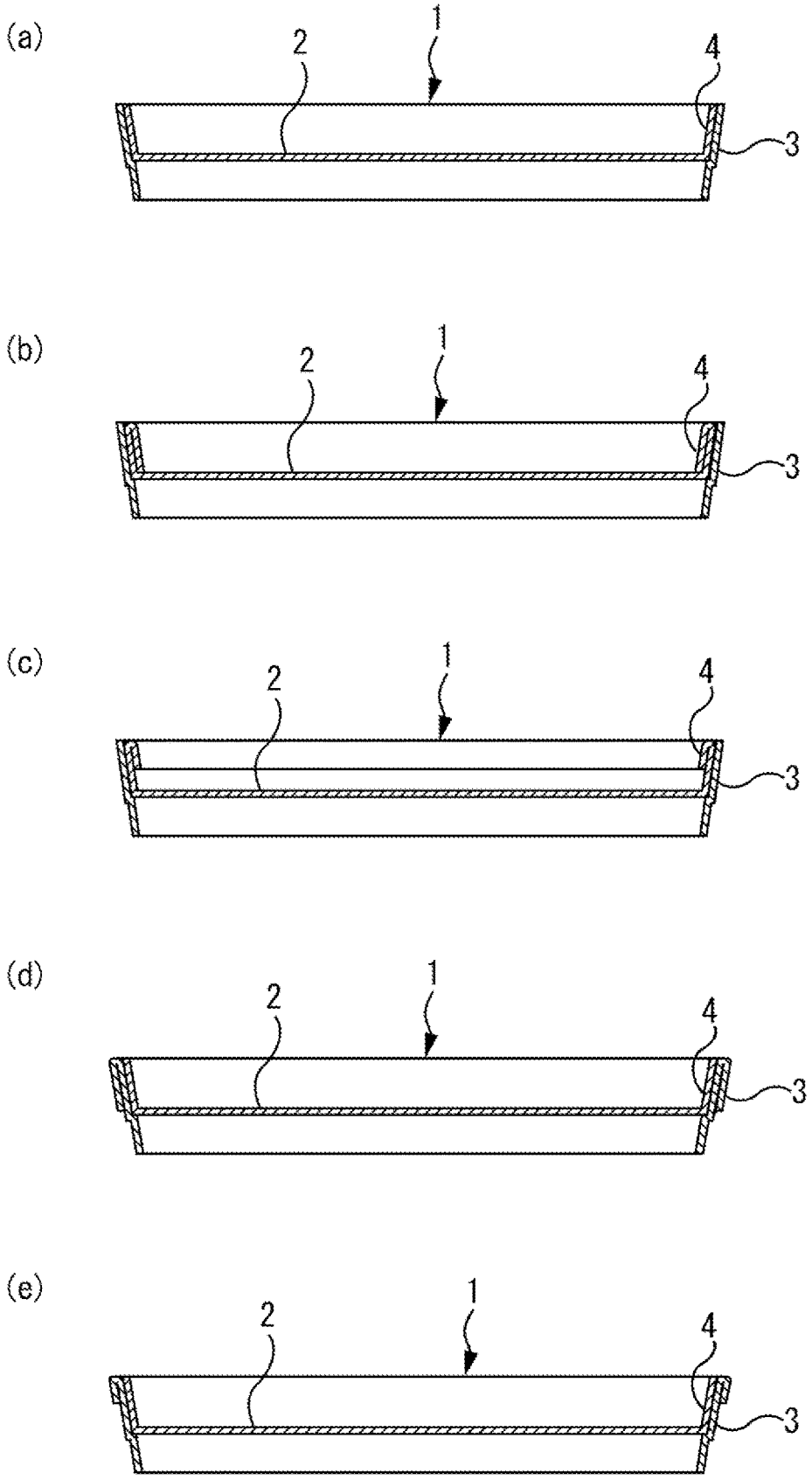
FIGS. 14(*a*) to 14(*e*) are explanatory views illustrating a configuration of other modes of the lid.

A lid 1 illustrated in FIG. 14 is a mode in which a rising part 4 of a top lid part 2 and the upper end of a side wall 3 are flush with each other. In this case, not only the mode in which the rising part 4 and the upper end of the side wall 3 are flush with each other is adopted as illustrated in FIG. 14(*a*), but also a rising part 4 may be folded inward so that the height position of the bent part to be the upper end of the rising part 4 and the position of the upper end of a side wall 3 may be flush with each other as illustrated in FIG. 14(*b*). Alternatively, as illustrated in FIG. 14(*c*), the height position of the bent part of a rising part 4 and the position of the upper end of a side wall 3 may be flush with each other, and the folded part of the rising part 4 may be formed so as not to reach a top lid part 2. Further, as illustrated in FIGS. 14(*d*) and 14(*e*), the upper end position of the folded part where a side wall 3 is folded back outward and the upper end position of a rising part 4 may be aligned to be flush with each other.

Figure 15:
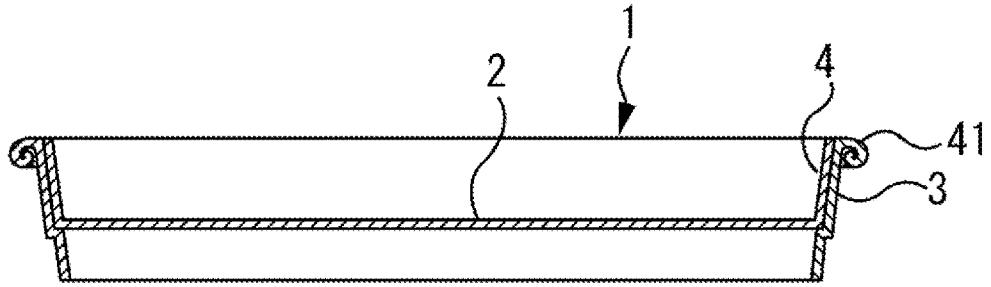
FIGS. 15(*a*) to 15(*d*) are explanatory views illustrating a configuration of other modes of the lid.
Figure 15:
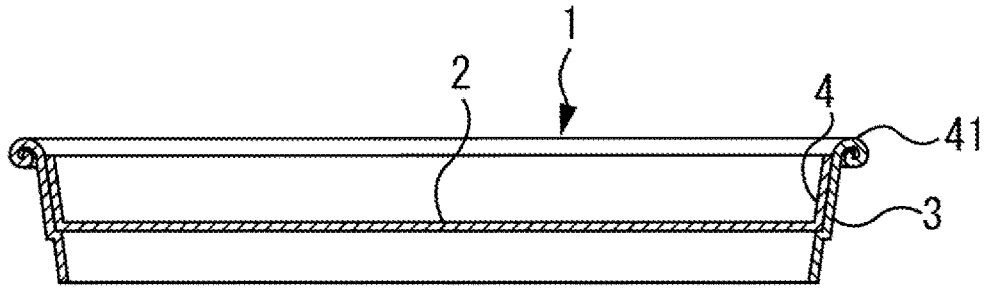
Figure 15:
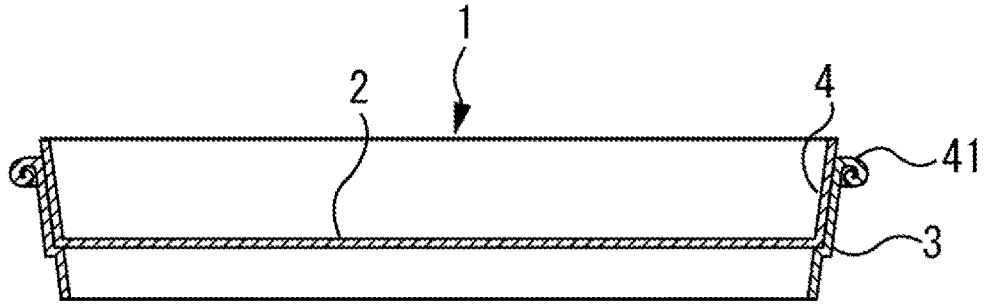
Figure 15:
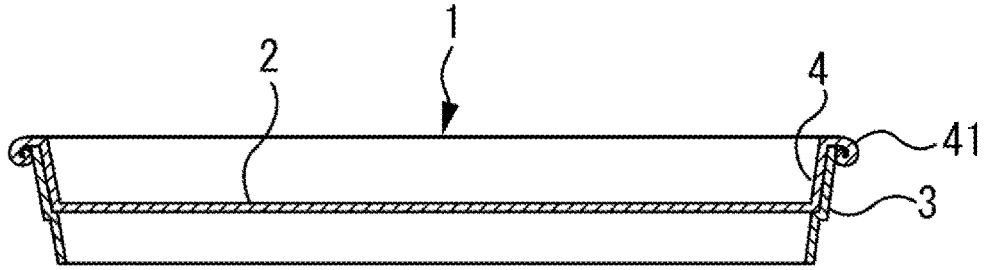

FIG. 15 illustrates an example in which a curled part 41 as a projecting part is formed on an upper end part of a lid 1. The shape of the curled part 41 may be formed in a curled shape as illustrated in FIG. 15, or may be formed in a flange shape by crushing the curled part. The projecting part here is a concept including a part projecting outward of the side wall 3. FIG. 15(*a*) illustrates an example in which a rising part 4 and a side wall 3 are formed to be flush with each other, and a curled part 41 is formed on the side wall 3. Alternatively, FIG. 15(*b*) is an example in which a rising part 4 is formed lower than a side wall 3 although a curled part 41 is formed on the side wall 3 similarly to FIG. 15(*a*). FIG. 15(*c*) illustrates an example in which a curled part 41 is formed on a side wall 3, and a rising part 4 protrudes higher than the upper end position of the side wall 3. Further, FIG. 15(*d*) illustrates an example in which the upper end part of a rising part 4 is located above the upper end of a side wall 3 and further protrudes outward from the side wall 3 to form a curled part 41. The curled part 41 can also be formed in this manner.

Note that when the curled part 41 is formed, not only the strength of the side wall 3 and the top lid part 2 can be increased, but also the heat insulation effect can be improved. For example, at the time of drinking a hot beverage or the like, the curled part 41 can make it less likely to feel uncomfortable heat on the lips and improve the feel on the mouth.

Figure 16:
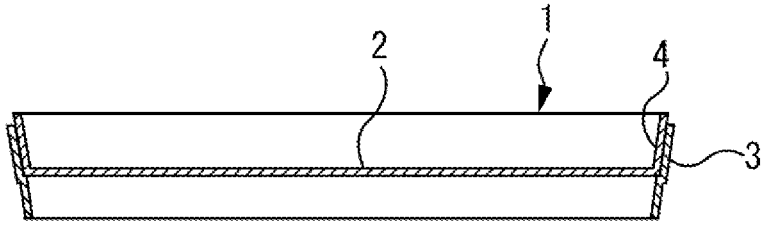
FIGS. 16(*a*) to 16(*e*) are explanatory views illustrating a configuration of other modes of the lid.
Figure 16:
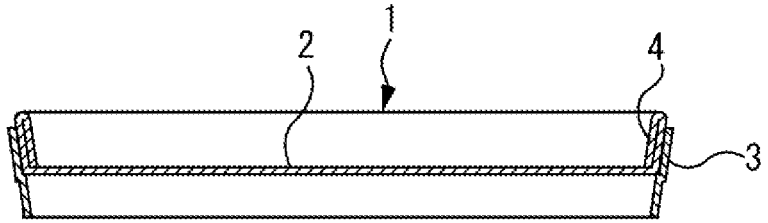
Figure 16:
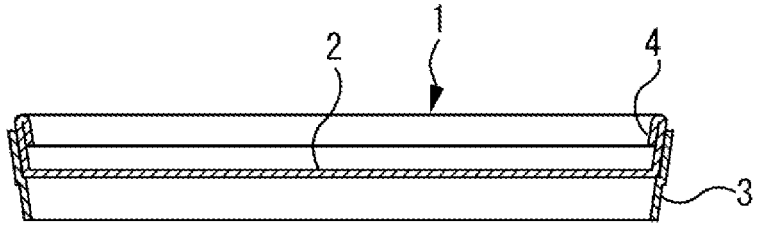
Figure 16:
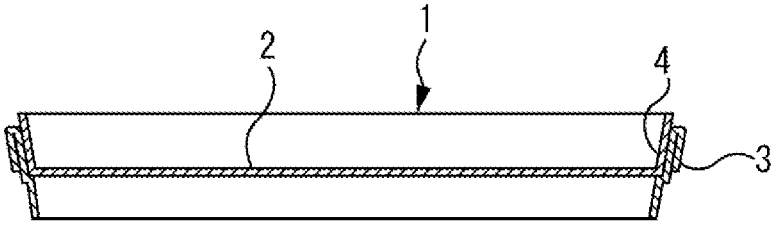
Figure 16:
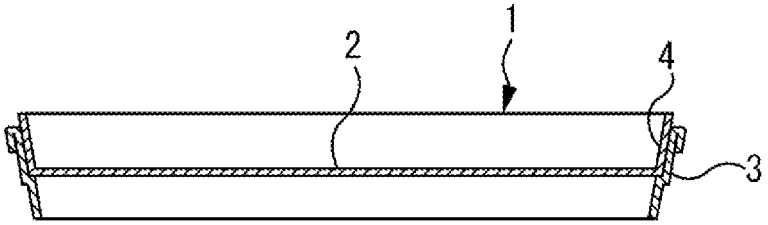

FIG. 16 illustrates a mode in which a rising part 4 protrudes upward from a side wall 3. For example, in FIG. 16(*a*), a rising part 4 protrudes upward from a side wall 3, and in FIGS. 16(*b*) and 16(*c*), a rising part 4 is folded inward, and the position of the folded end part protrudes upward from the upper end of a side wall 3. In FIGS. 16(*d*) and 16(*e*), a side wall 3 is folded back outward, and the position of the upper end of a rising part 4 protrudes upward from the position of the folded end.

Figure 17:
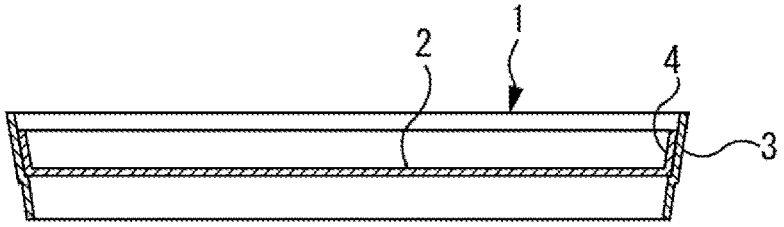
FIGS. 17(*a*) to 17(*e*) are explanatory views illustrating a configuration of other modes of the lid.
Figure 17:
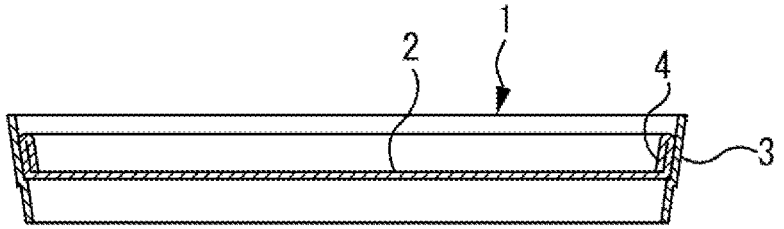
Figure 17:
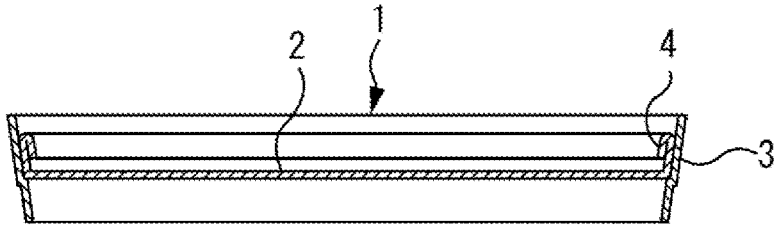
Figure 17:
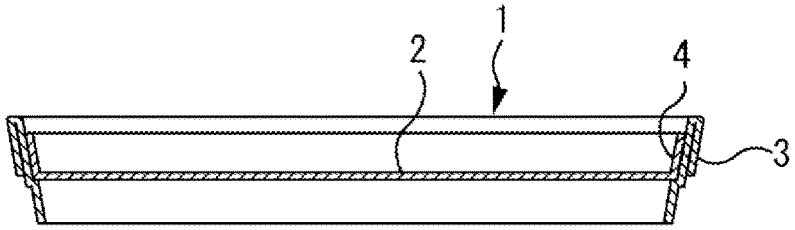
Figure 17:
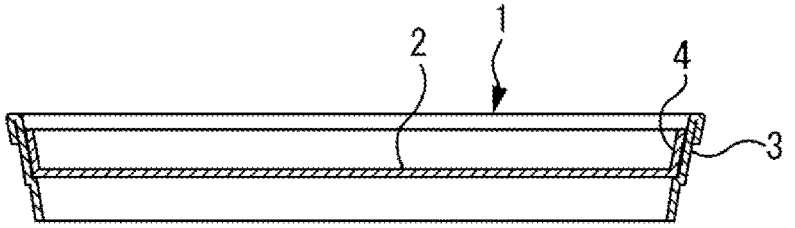

FIG. 17 illustrates a mode in which, contrary to FIG. 16, the upper end of a rising part 4 is formed at a position lower than the upper end of a side wall 3. FIG. 17(*a*) illustrates an example in which the position of the upper end of a side wall 3 is higher than the upper end of a rising part 4, and FIGS. 17(*b*) and 17(*c*) illustrate an example in which a rising part 4 is folded inward, and the upper end position of a side wall 3 is located higher than the upper end position of the folded part. Alternatively, FIGS. 17(*d*) and 17(*e*) illustrate an example in which a side wall 3 is folded back outward, and the height position of the folded part is higher than the upper end position of a rising part 4.

Figure 18:
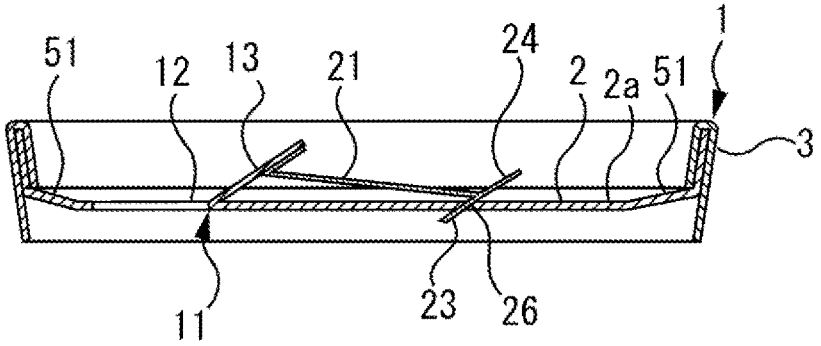
FIGS. 18(*a*) to 18(*d*) are explanatory views illustrating a configuration of other modes of the lid.
Figure 18:
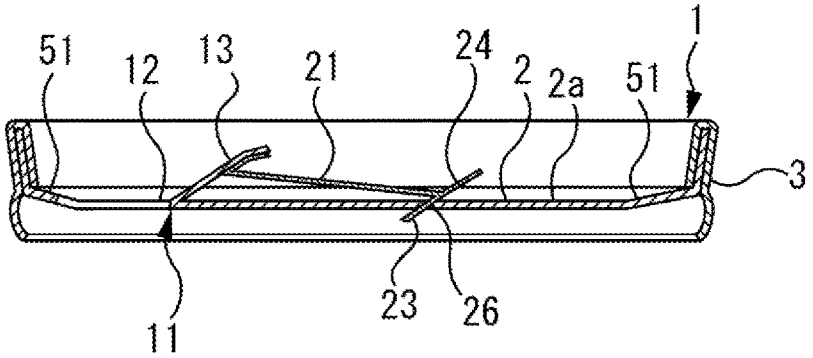
Figure 18:
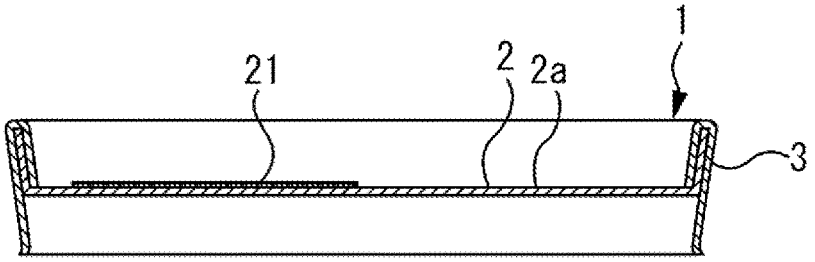
Figure 18:
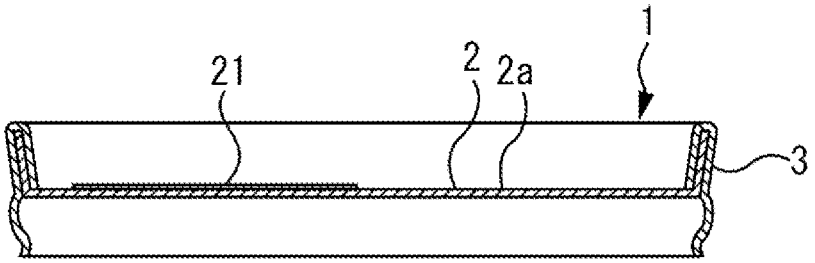

FIGS. 18(*a*) and 18(*b*) illustrate an example in which an inclined part 51 is formed in a top lid part 2. As described above, when the inclined part 51 is formed in the top lid part 2, for example, when a container 101 or a lid 1 attached to the container 101 is returned to a state where the top lid part 2 is horizontal from a state of being inclined after drinking a beverage or the like, the beverage remaining on an inner surface of a rising part 4 easily returns to an opening part 12 along the inclined part 51. By forming the inclined part 51 in this manner, the beverage is less likely to remain on a front surface 2*b* of the top lid part 2 and the like. Note that in a case where the inclined part 51 is formed in the top lid part 2 in this manner, the position of the opening part 12 may be formed at a position avoiding the inclined part 51 as illustrated in FIG. 18(*a*), or may be formed such that an opening part 12 is formed in a part of an inclined part 51 as illustrated in FIG. 18(*b*). In addition, the shape of a side wall 3 may be formed linearly as illustrated in FIG. 18(*a*), or may be formed so as to swell a lower wall 6 as illustrated in FIG. 18(*b*). FIG. 18(*c*) illustrates an example in which a guide part 52 is formed at a lower end part of a lower wall 6 in a lid 1 described above. The guide part 52 is provided to facilitate attachment of the lid 1 to a container 101 when attaching the lid 1 to the container 101. By forming the guide part 52, the container 101 can be more smoothly attached.

Figure 19:
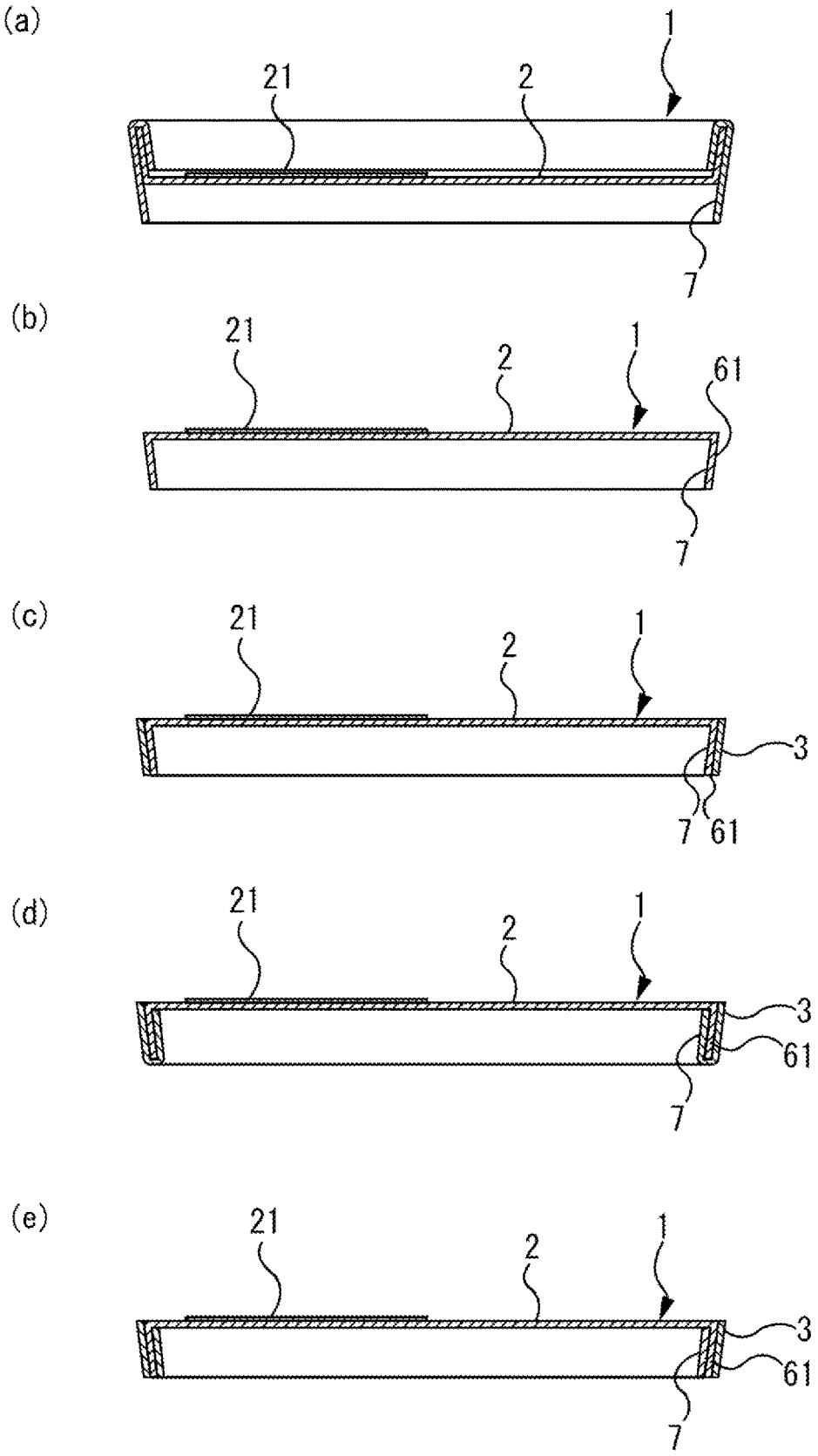
FIGS. 19(*a*) to 19(*e*) are explanatory views illustrating a configuration of other modes of the lid.

FIG. 19 illustrates another example of the form of the engaging part 7 formed on the lower wall 6 in the lid 1 described above. FIG. 19(*a*) illustrates a mode of the lid 1 described so far, and an engaging part 7 is formed to have a linearly tapered shape without bulging outward. In addition, FIGS. 19(*b*) to 19(*e*) illustrate a configuration in which the shape of an engaging part 7 is formed in a linearly tapered shape as in the case described in FIG. 19(*a*), and in addition, a rising part 4 is not formed, and a falling part 61 formed by lowering a peripheral edge part of a top lid part 2 is included. The lid 1 having such a form may be used.

Figure 20:
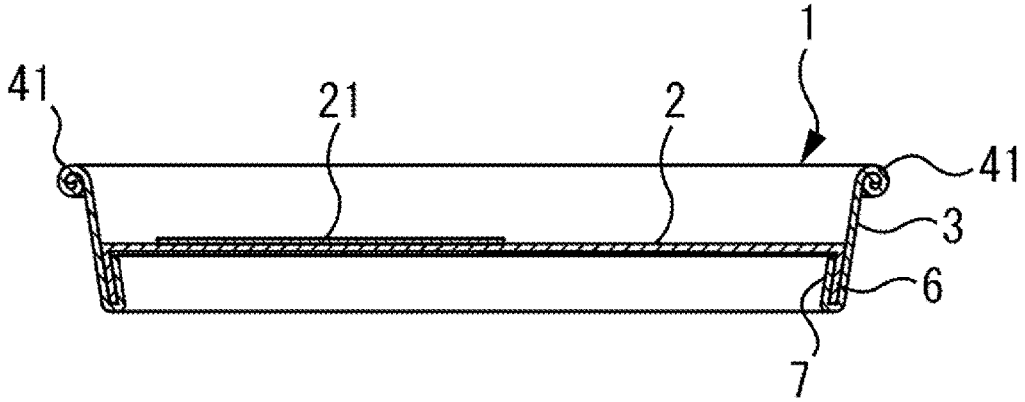
FIGS. 20(*a*) and 20(*b*) are explanatory views illustrating a configuration of other modes of the lid.
Figure 20:
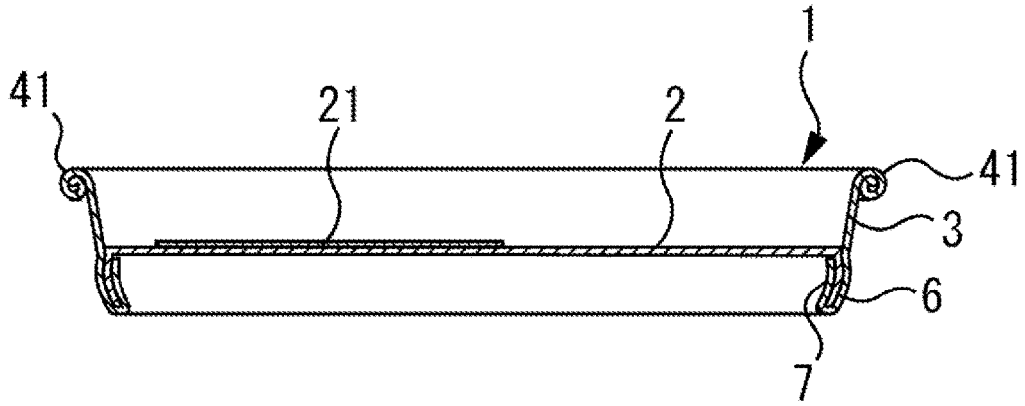
Figure 21:
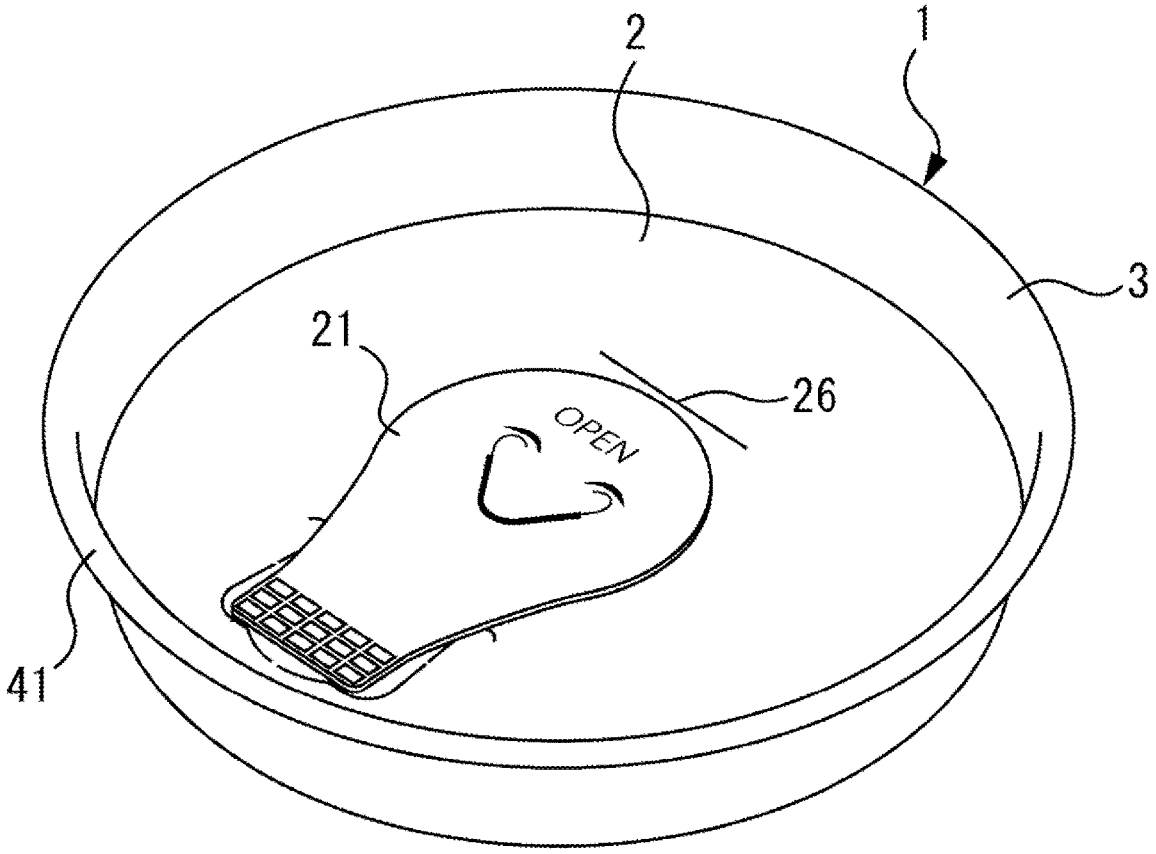
FIG. 21 is a perspective view illustrating the configuration of another mode of the lid.

FIG. 20 illustrates an example of a lid 1 including a falling part 61 where the peripheral edge of a top surface part 2*a* of a top lid part 2 falls, a side wall 3 is formed so as to surround the falling part 61, and the falling part 61 and the side wall 3 are joined together. A lid 1 of FIG. 20(*a*) has a tapered shape in which an engaging part 7 is linearly formed, and a lid 1 of FIG. 20(*b*) has a form in which an engaging part 7 bulges outward. The configuration of the engaging part 7 is not limited to this mode, and the configuration described above and the like may be appropriately used. Note that the lid 1 of the mode illustrated in FIG. 20(*a*) is illustrated in FIG. 21.

Second Embodiment

Figure 28:
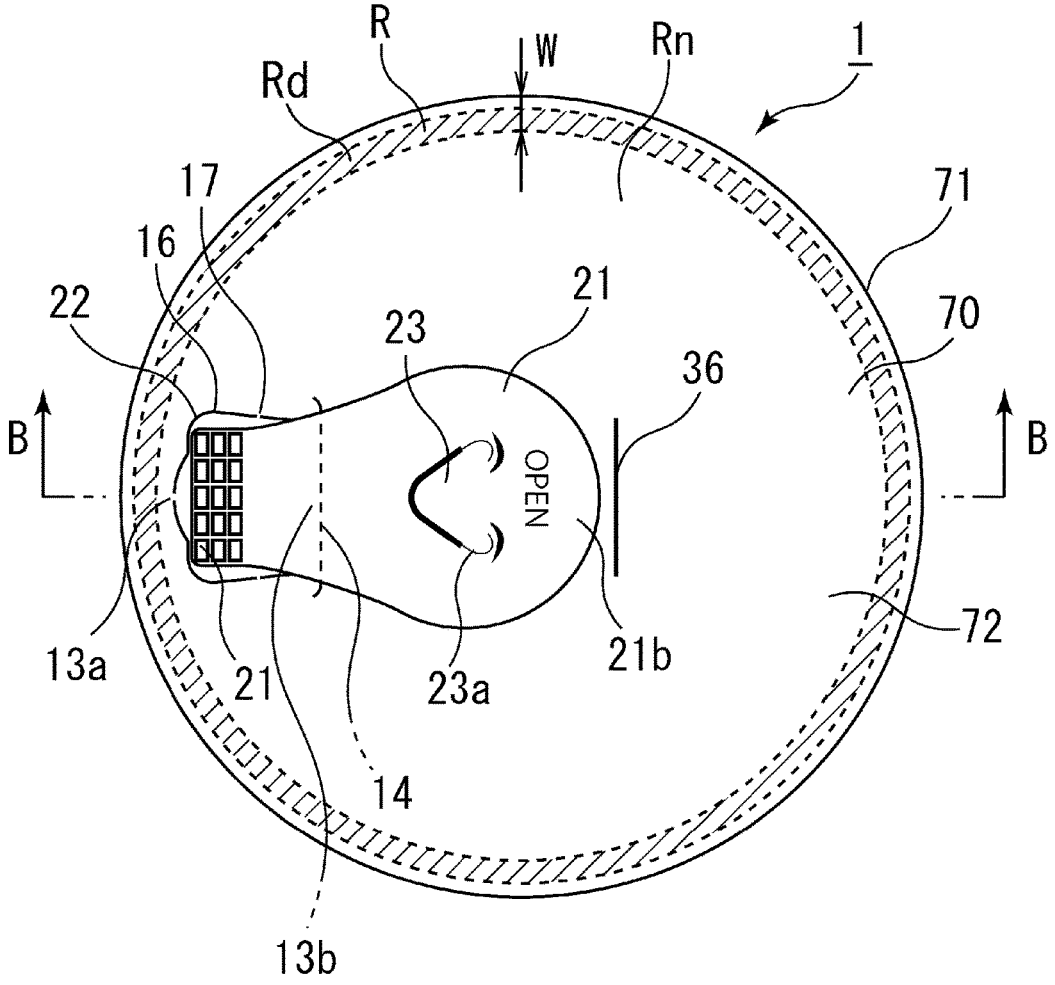
FIG. 28(*a*) is a plan view for explaining an example of a lid according to a second embodiment of the present invention.
Figure 28:
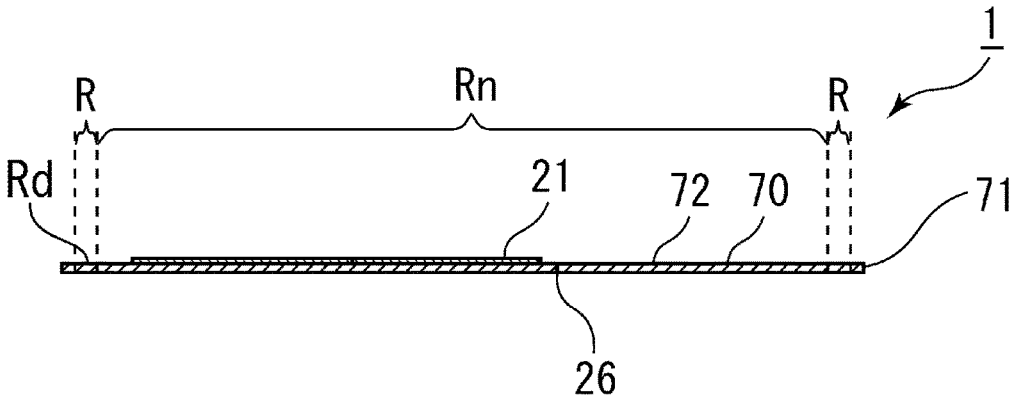

Next, a lid 1 according to a second embodiment will be described. The lid 1 according to the second embodiment is used by being joined along an edge part 103 of an open mouth part 102 of a container 101. The lid 1 is formed in a shape that covers the open mouth part 102 in a state of being joined to the open mouth part 102 of the container 101. As illustrated in FIGS. 28(*a*), 28(*b*), 29, 30(*a*), 30(*b*), and the like, the lid 1 has a joining region R joined to the edge part 103 of the open mouth part 102 of the container 101 and a part corresponding to the joining region R (hereinafter, part corresponding to joining region R is referred to as "joining region corresponding part Rd"). In addition, in the lid 1, a small lid piece 13 is provided in a region (hereinafter sometimes simply referred to as region inside joining region R or inner region Rn) of an exposed surface 70 of the lid 1 corresponding to the inside of the joining region R in plan view of the lid 1 (where vertical direction is line-of-sight direction). The other configurations may be formed in a manner similar to that in the first embodiment. Therefore, in the lid 1, an opening part 12 is formed when the small lid piece 13 is pulled up. In addition, in the lid 1, a tab member 21 is joined to the small lid piece 13. The small lid piece 13, the opening part 12, and the tab member 21 of the lid 1 according to the second embodiment are formed in a manner similar to that of the small lid piece 13, the opening part 12, and the tab member 21 provided in the top lid part 2 of the first embodiment. Also in the lid 1, an opening forming part 11 is formed by the small lid piece 13 and the opening part 12. FIGS. 28(*a*), 28(*b*), and 29 are diagrams illustrating an example of the lid 1 according to the second embodiment.

(Joining Region)

Figure 39:
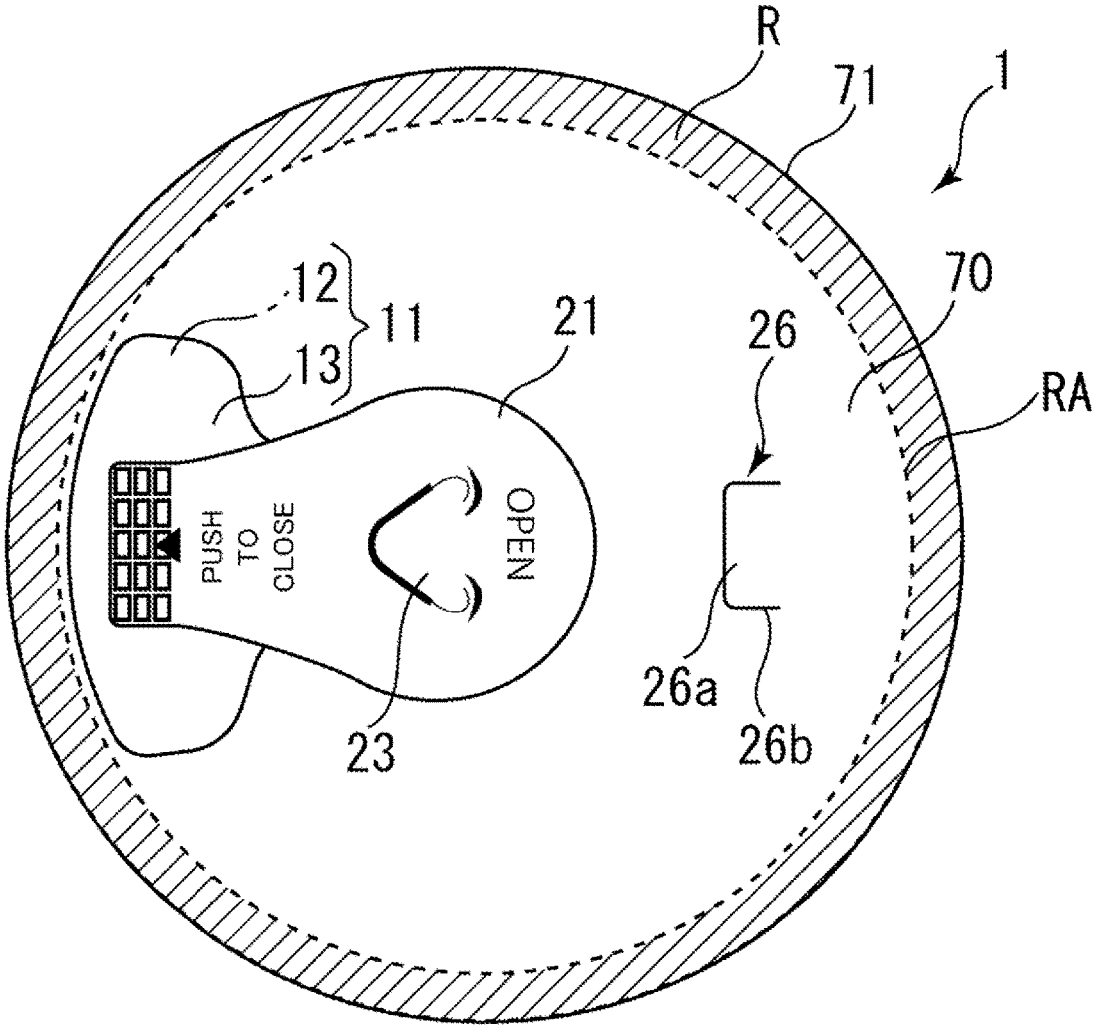
FIG. 39 is a plan view for explaining an example of a lid according to the second embodiment of the present invention.

The joining region R is a region formed annularly along the open mouth part 102 of the container 101 in a shape corresponding to the open mouth part 102. A width W (width along inner and outer directions) of the joining region R is usually the same as or narrower than the width of an edge part 103 of the open mouth part 102. Note, however, that this does not prohibit the width W of the joining region R from being larger than the width of the edge part 103 of the open mouth part 102. Further, the joining region R may be formed inside an outer peripheral end 71 of the lid 1, or may be formed up to the outer peripheral end 71 of the lid 1 as illustrated in FIG. 39. FIG. 39 is a plan view illustrating one of other examples of the lid 1 according to the second embodiment. A position with respect to the joining region R is defined as a position with respect to the part forming the joining region R in the lid 1 unless otherwise specified. For example, a case of referring to the inside (outside) of the joining region R indicates the inside (outside) with respect to the part forming the joining region R in the lid 1 unless otherwise specified.

(Small Lid Piece)

Figure 30:
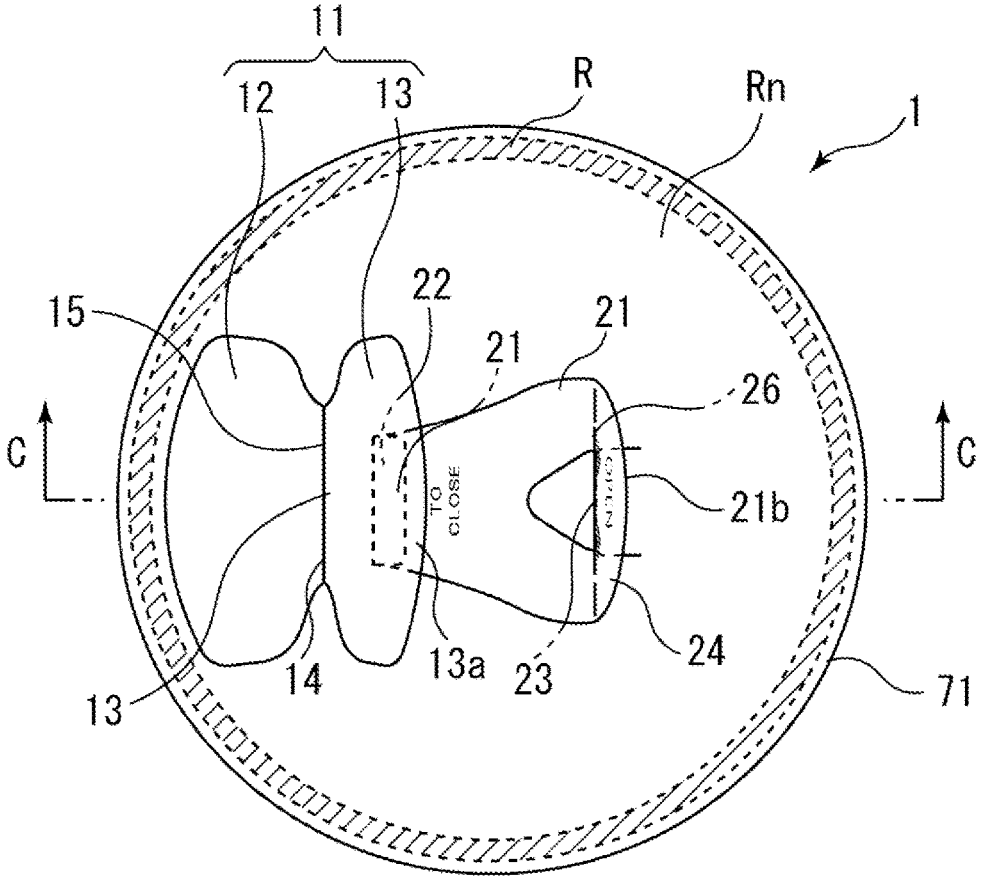
FIG. 30(*a*) is a plan view for explaining an example of a lid according to the second embodiment of the present invention.
Figure 30:
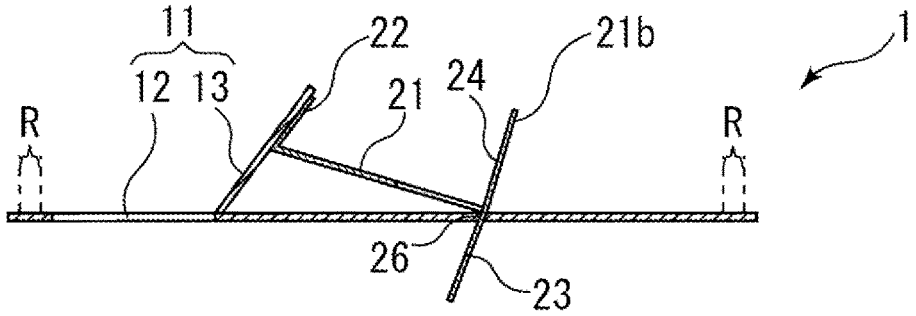

The lid 1 is provided with the small lid piece 13. In the lid 1 according to the second embodiment, the small lid piece 13 is connected to a peripheral part 72 including the joining region R. The peripheral part 72 is formed of a part excluding the small lid piece 13 in a part forming the exposed surface 70 of the lid 1 in plan view of the lid 1. As illustrated in FIGS. 30(*a*) and 30(*b*), in the lid 1, similarly to the first embodiment, a state in which the small lid piece 13 is lifted is formed in conjunction with the movement of the tab member 21 joined to the small lid piece 13 at a joint part 22. In the small lid piece 13, a connecting part between the peripheral part 72 and the small lid piece 13 is formed as a hinge part 14, and the opening part 12 is exposed as the small lid piece 13 is lifted with the connecting part as a support shaft. The small lid piece 13 is provided inside the joining region R in plan view of the lid 1. FIGS. 30(*a*) and 30(*b*) are diagrams for explaining a state in which the opening part 12 is exposed by lifting the small lid piece 13 in the lid 1 according to the second embodiment. Hereinafter, of an outer peripheral edge 73 of the small lid piece 13, a connecting part (hinge part 14) serving as a support shaft when small lid piece 13 is lifted is referred to as a hinge connecting part 74.

Figure 29:
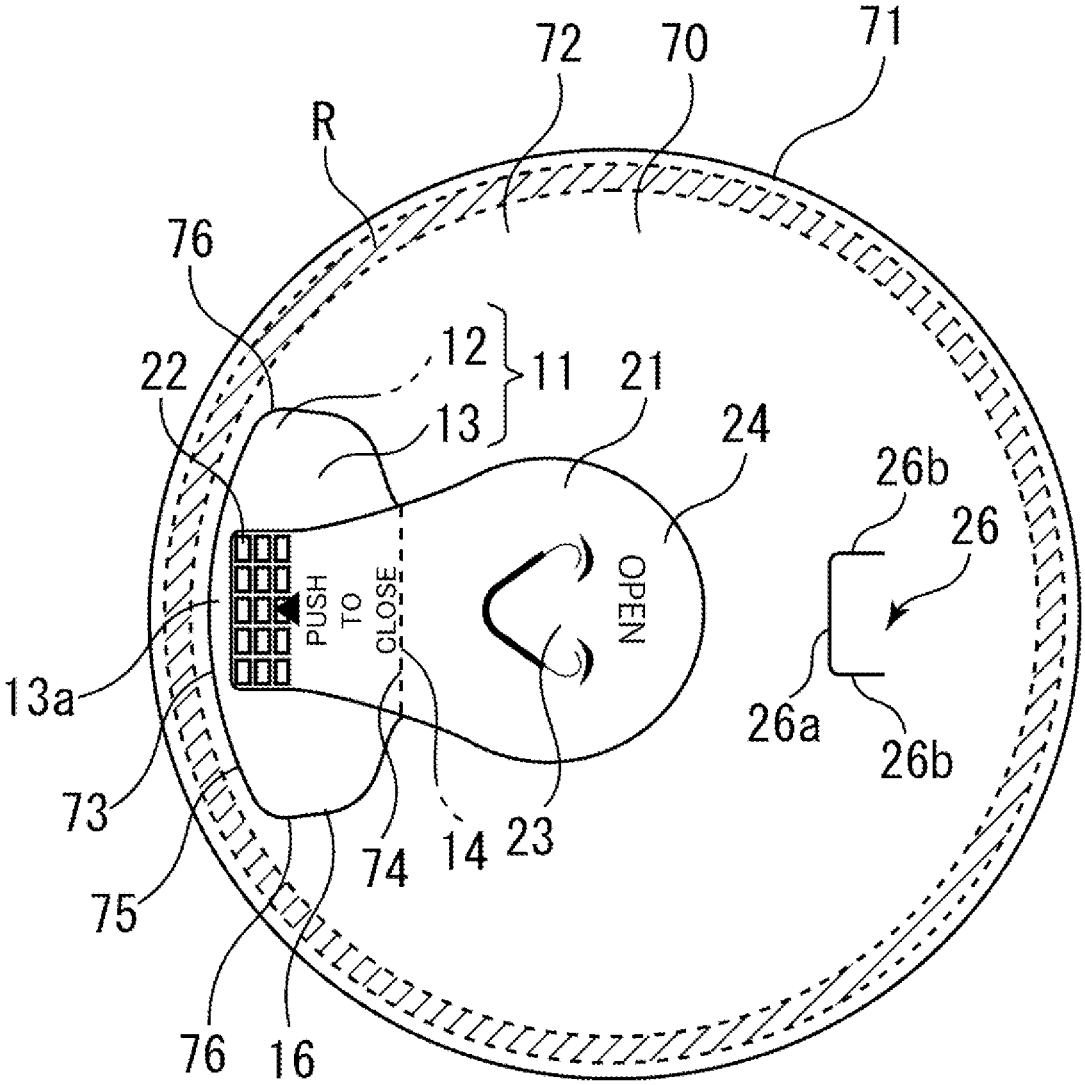
FIG. 29 is a plan view for explaining an example of a lid according to the second embodiment of the present invention.

The shape and structure of the small lid piece 13 are not particularly limited. As illustrated in FIGS. 28(*a*) and 28(*b*), the shape and structure of the small lid piece 13 may be similar to various shapes and structures illustrated in an example of the first embodiment. In addition, as illustrated in FIG. 29 and the like, the shape of the small lid piece 13 preferably has a contour shape in which at least a part of the outer peripheral edge 73 of the small lid piece 13 extends along the inner end of the joining region R. In the case of the example of FIG. 29, the shape of a front end edge part 75 of the outer peripheral edge 73 of the small lid piece 13 is a shape along the inner end of the joining region R. At this time, the shape of the front end edge part 75 tends to be a shape along the inner end of the edge part 103 of the open mouth part 102. Such a shape of the small lid piece 13 may be applied to the small lid piece 13 of the lid 1 according to the first embodiment. Hereinafter, in the description of the lid 1 according to the second embodiment, the case where the small lid piece 13 as illustrated in FIG. 29 is used will be described as an example unless otherwise specified. Note that in the example of the small lid piece 13 illustrated in FIG. 29, the outer peripheral edge 73 is configured by the front end edge part 75, the hinge connecting part 74, and a side end edge part 76 connecting the front end edge part 75 and the hinge connecting part 74.

Figure 32:
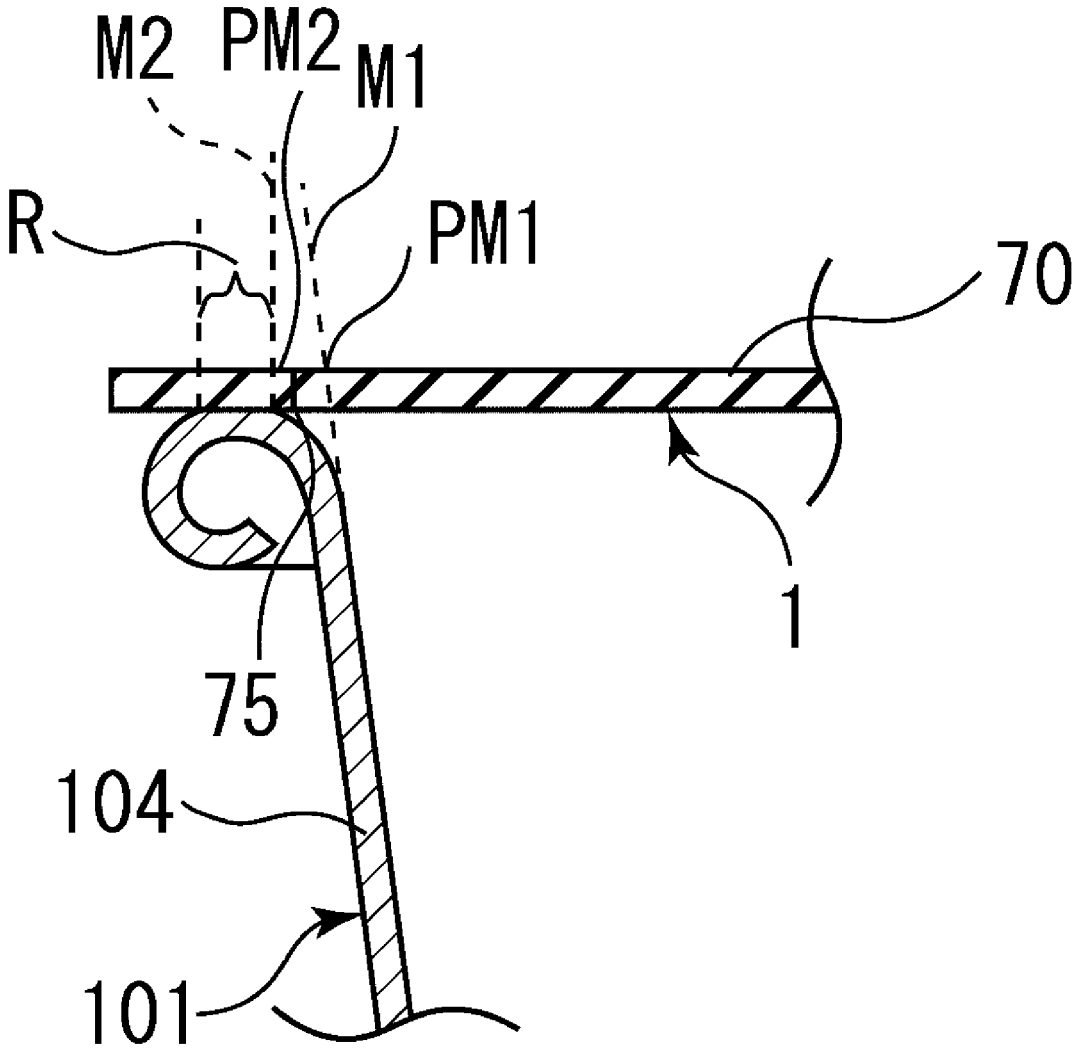
FIG. 32 is a cross-sectional view of a main part for explaining an example of a lid according to the second embodiment of the present invention.

In the example illustrated in FIG. 30, the front end edge part 75 of the outer peripheral edge 73 of the small lid piece 13 is preferably formed between a position PM1 and a position PM2 in plan view of the lid 1 as illustrated in FIG. 32. FIG. 32 is a diagram for explaining the position of the front end edge part 75. The position PM1 is an intersection position where an extended surface M1 of an inner peripheral surface of a side wall 104 of the container 101 and the exposed surface 70 of the lid 1 intersect with each other in a state where the lid 1 is joined to the container 101. The position PM2 indicates an intersection position where a surface M2 extending along the thickness direction of the lid 1 from the position of the inner end of the joining region R and the exposed surface 70 of the lid 1 intersect with each other. Note, however, that this does not prohibit the front end edge part 75 of the small lid piece 13 from existing outside the part between the position PM1 and the position PM2. For example, it is not prohibited that the front end edge part 75 is formed slightly closer to the center side of the lid 1 than the position PM2.

In a part excluding the hinge connecting part 74, the outer peripheral edge 73 of the small lid piece 13 may have a cut part that is cut with respect to the peripheral part 72 or may have a fragile part that is partially joined. As illustrated in the example of FIG. 29, the cut part can be formed by providing a cut line 16 along the boundary between the small lid piece 13 and the peripheral part 72. As illustrated in the example of FIG. 28, the fragile part can be formed by providing a structure (perforation structure) in which short cut lines 16 and the dotted joint parts 17 are alternately arranged at the boundary between the small lid piece 13 and the peripheral part 72, or by forming a half-cut structure. For example, as will be described later with reference to FIGS. 40(*a*) and 40(*b*), the half-cut structure can be a structure cut to a predetermined depth in the thickness direction of the lid 1.

In the lid 1 according to the second embodiment, even after the opening part 12 is exposed by lifting the small lid piece 13, the opening part 12 can be covered with the small lid piece 13. When the small lid piece 13 is lifted, the opening part 12 is exposed. This state is referred to as an open lid state. A state in which the opening part 12 is covered with the small lid piece 13 is referred to as a closed lid state.

Figure 35:
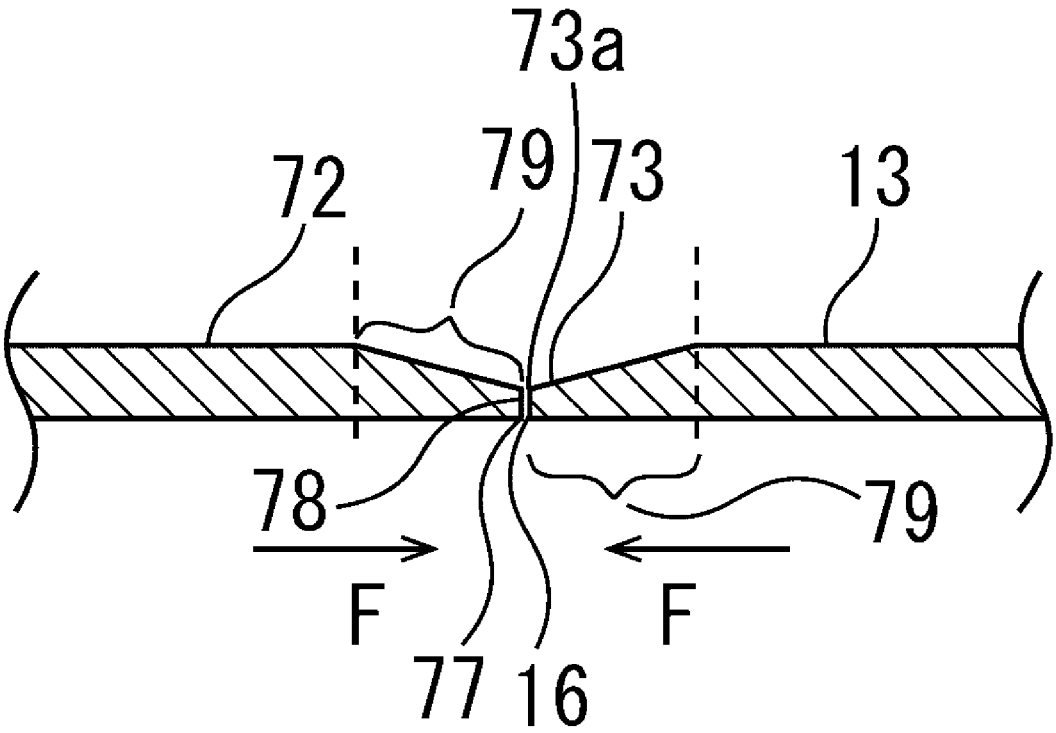
FIG. 35 is a cross-sectional view of a main part for explaining an example of a lid according to the second embodiment of the present invention.

In the lid 1, as illustrated in FIG. 35, in the closed lid state, the end surface of the peripheral part 72 can face an end surface 73*a* (outer peripheral end surface) of the outer peripheral edge 73 of the small lid piece 13. At this time, a part of the end surface of the peripheral part 72 facing the end surface 73*a* of the outer peripheral edge 73 of the small lid piece 13 is a facing surface 77. In the lid 1 according to the second embodiment, the end surface 73*a* of the outer peripheral edge 73 and the facing surface 77 are preferably in contact with each other to form a contact part 78. In a case where the lid 1 is made of a paper-based material, such a lid 1 can be formed, for example, by forming the cut line 16 at a boundary between the small lid piece 13 and the peripheral part 72. When the cut line 16 is formed, the paper-based material forming the lid 1 is cut while being compressed at the boundary between the small lid piece 13 and the peripheral part 72. At this time, the paper-based material is likely to be stretched in the vicinity of the boundary between the small lid piece 13 and the peripheral part 72. Therefore, in the state where the end surface 73*a* of the outer peripheral edge 73 of the small lid piece 13 and the facing surface 77 are disposed so as to face each other (that is, in closed lid state), at the cut line 16, the end surface 73*a* and the facing surface 77 are in contact with each other to form the contact part 78, and a force F by which the small lid piece 13 and the peripheral part 72 are pressed against each other is easily generated at the contact part 78. Then, when the small lid piece 13 is opened from such a closed lid state, at least a part of the end surface 73*a* of the outer peripheral edge 73 and the facing surface 77 rub against each other. Therefore, in the lid 1, it is possible to form a state in which the opening part 12 is firmly covered with the small lid piece 13 in the closed lid state, and it is possible to reduce the possibility that a liquid leaks from the inside of the container 101 through a gap between the small lid piece 13 and the peripheral part 72. Note, however, that in the lid 1, since the small lid piece 13 and the peripheral part 72 are divided by the cut line 16, air permeability can be secured, and steam can be communicated from between the small lid piece 13 and the peripheral part 72.

In the case where the lid 1 is made of a paper-based material, as illustrated in the example of FIG. 35, preferably, a compressed part 79 of the paper-based material forming the lid 1 is formed in the vicinity of the position of the end surface 73*a* of the small lid piece 13 and the facing surface 77. In the example of FIG. 35, the compressed part 79 in the vicinity of the end surface 73*a* of the small lid piece 13 is configured such that the compression ratio gradually increases and the thickness gradually decreases toward the end surface 73*a*. In addition, the compressed part 79 in the vicinity of the facing surface 77 is configured such that the compression ratio gradually increases and the thickness gradually decreases toward the facing surface 77. In this case, even when the end surface 73*a* and the facing surface 77 come into contact with each other with a certain strong force, distortion and deflection are less likely to occur in the contact part 78, and the structure of the contact part 78 can be reliably maintained.

Figure 36:
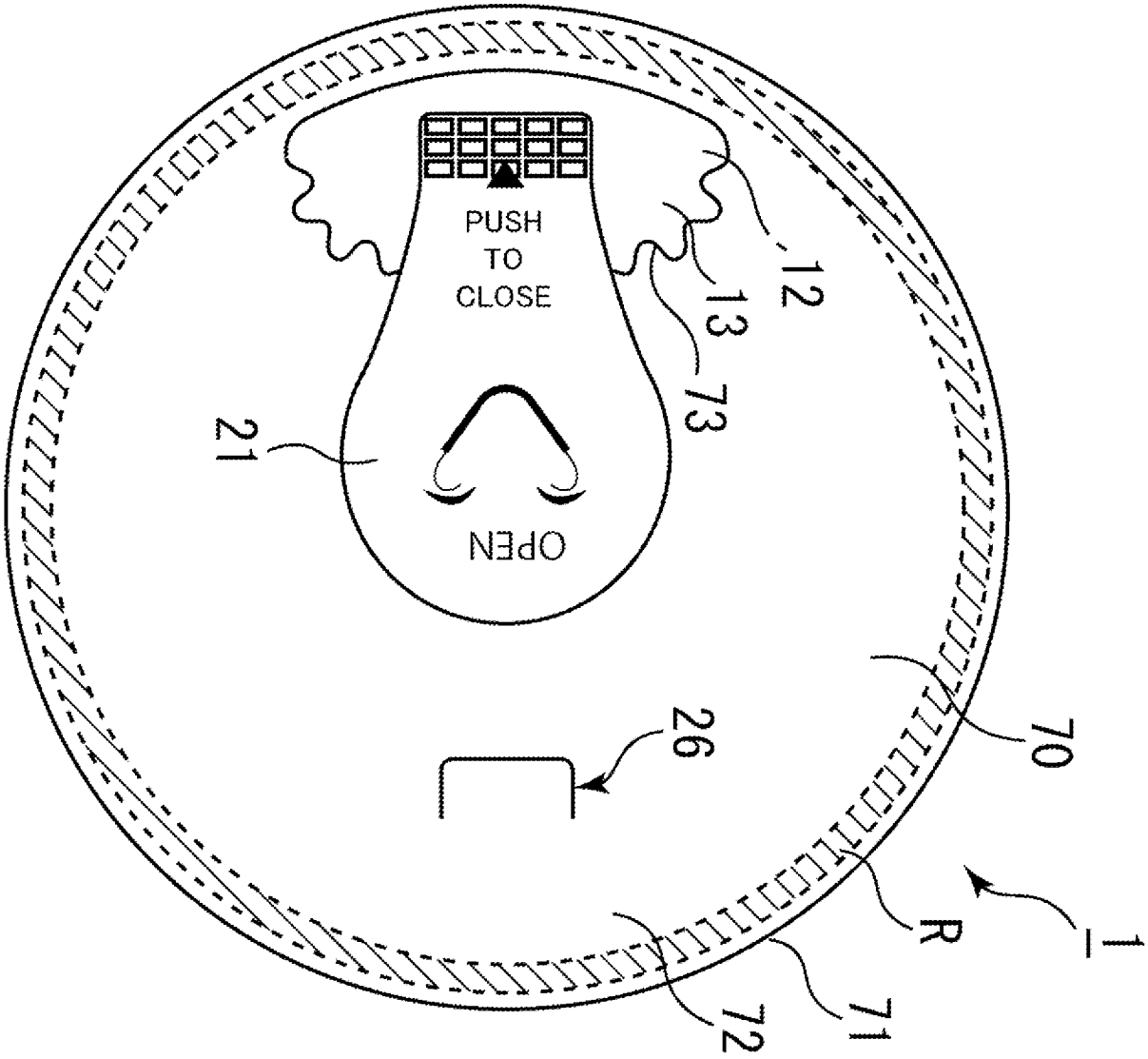
FIG. 36 is a cross-sectional view of a main part for explaining an example of a lid according to the second embodiment of the present invention.

Further, in the lid 1, from the viewpoint of forming a state in which the opening part 12 is firmly covered with the small lid piece 13 in the closed lid state, the small lid piece 13 and the peripheral part 72 may be formed as illustrated in FIG. 36. In FIG. 36, the outer peripheral edge 73 of the small lid piece 13 has a shape in which a wavy structure is partially formed, and a peripheral edge (part forming facing surface 77 in peripheral part 72) of the opening part 12 has a shape matching the shape of the outer peripheral edge 73 of the small lid piece 13. In a case where the small lid piece 13 and the peripheral part 72 are formed in such a shape, at least a part of the contact part 78 has a wavy structure, that is, the area of the contact part 78 is increased, and a state in which the opening part 12 is firmly covered by the small lid piece 13 is easily maintained.

(Tab Member)

As illustrated in FIGS. 28, 29, 30, and the like, the tab member 21 may be configured similarly to the tab member provided in the lid 1 according to the first embodiment. The tab member 21 is joined at one end 21*a* of the tab member 21 to a part (position close to one end part 13*a*) close to the tip end of the small lid piece 13.

In the example of FIGS. 30(*a*) and 30(*b*), the tab member 21 includes a holding piece 23 formed between the joint part 22 and a knob part 24, and is formed such that the holding piece 23 protrudes from the tab member 21 when the knob part 24 is pinched to open the small lid piece 13. An insertion part 26 into which the protruding holding piece 23 is inserted is formed in the peripheral part 72. Further, the insertion part 26 is configured such that the holding piece 23 can be inserted into the insertion part 26 to keep the small lid piece open. Note that the insertion part 26 may have a main part 26*a* and an auxiliary part 26*b* as in the first embodiment.

In addition, in the examples of FIGS. 28 and 29, the tab member 21 is provided so that at least a part of the tab member 21 overlaps a part immediately above the small lid piece 13 in the closed lid state. When formed in this manner, even in the closed lid state, by eliminating rising of the small lid piece 13 by moving the tab member 21 while horizontally maintaining the position of the tab member 21 such that the tab member 21 is substantially parallel to the lid 1, movement of the small lid piece 13 is easily stopped in a state where the contact part 78 between the end surface 73*a* of the small lid piece 13 and the facing surface 77 is formed.

Figure 47:
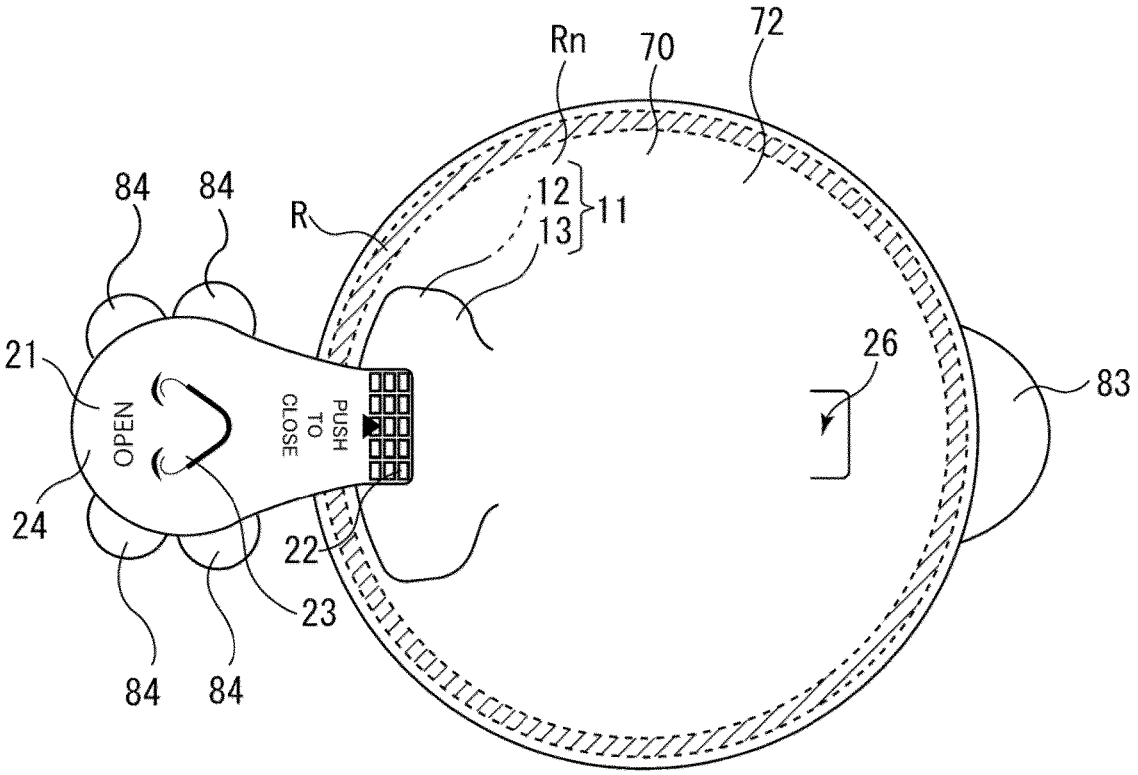
FIG. 47 is a plan view for explaining an example of the lid of the present invention.

Further, in the example of FIG. 28 and the like, the tab member 21 is disposed such that the knob part 24 is located closer to the center side of the lid 1 than the joint part 22, but the disposition of the tab member 21 is not limited thereto. The tab member 21 may be disposed such that the distance from the center of the lid 1 to the joint part 22 is equal to the distance from the center of the lid 1 to the knob part 24, or such that the joint part 22 is located closer to the center of the lid 1 than the knob part 24 as illustrated in FIG. 47. From the viewpoint of housing the tab member 21 in the exposed surface 70 of the lid 1 in plan view of the lid 1, the tab member 21 is preferably disposed such that the knob part 24 is located closer to the center side of the lid 1 than the joint part 22 as illustrated in the example of FIG. 28 and the like.

According to the second embodiment, similarly to the lid 1 according to the first embodiment, it is possible to obtain a lid that enables easy and hygienic opening of an opening part corresponding to a spout.

Modifications of the lid 1 according to the second embodiment will be described.

Modification 1

Figure 33:
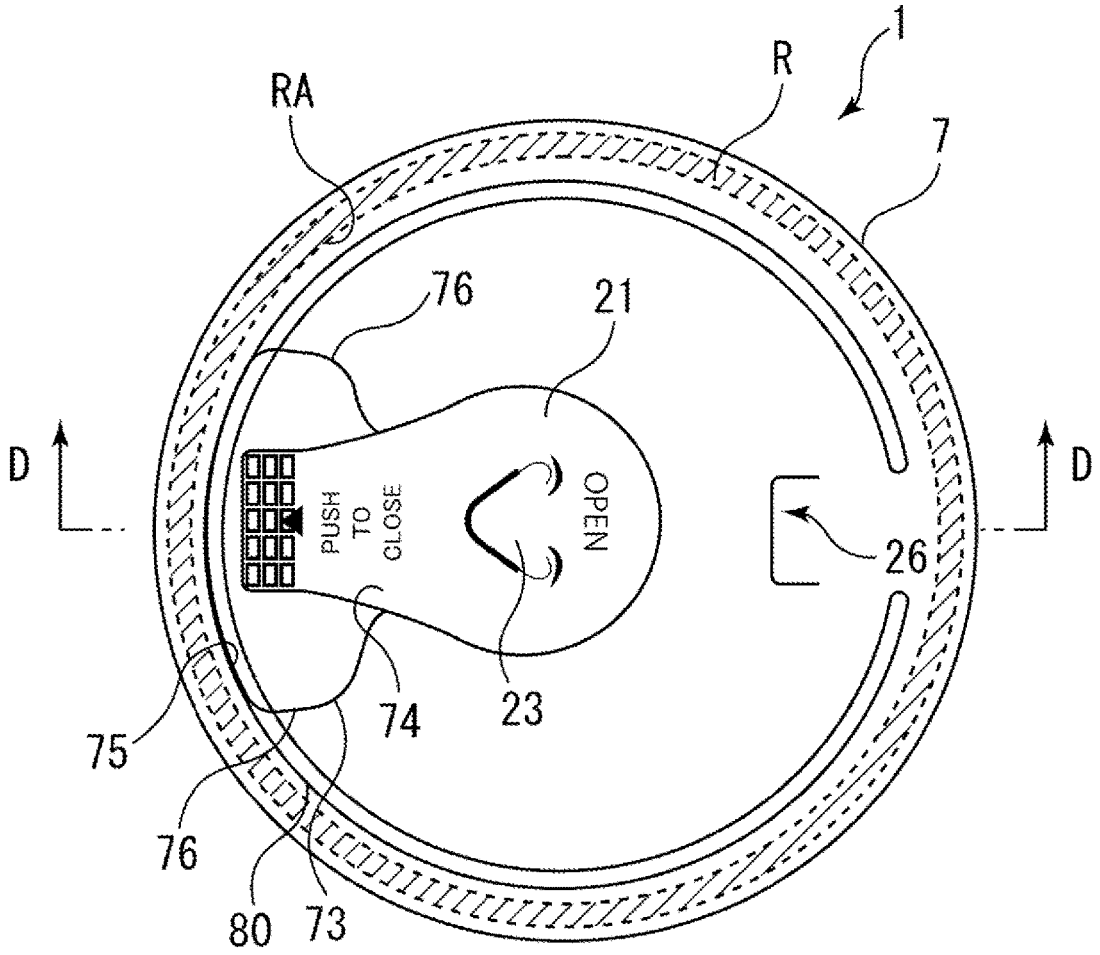
FIG. 33(*a*) is a plan view for explaining an example of a lid according to Modification 1 of the second embodiment of the present invention.
Figure 33:
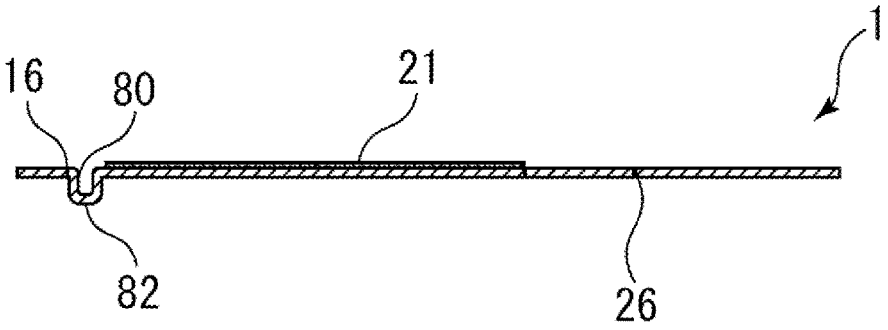

In the lid 1 according to the second embodiment, as illustrated in FIGS. 33(*a*) and 33(*b*), in plan view of a lid 1, a groove 80 may be formed in a region (simply referred to as inside of joining region R) corresponding to the inside of a joining region R on an exposed surface 70 (Modification 1). FIGS. 33(*a*) and 33(*b*) are diagrams illustrating an example of the lid 1 according to Modification 1 of the second embodiment.

(Groove)

In Modification 1, the groove 80 is preferably formed to extend along an inner edge RA of the joining region R inside the joining region R. The depth of the groove 80 is not particularly limited, but is preferably configured to gradually become deeper from a position far from a small lid piece 13 toward the small lid piece 13. In addition, as illustrated in the example of FIG. 33(*a*), the groove 80 is also preferably formed in the small lid piece 13.

In the example of FIG. 33(*a*), the groove 80 is formed in a C shape along the inner edge RA of the joining region R, but may be formed in an annular shape.

Figure 40:
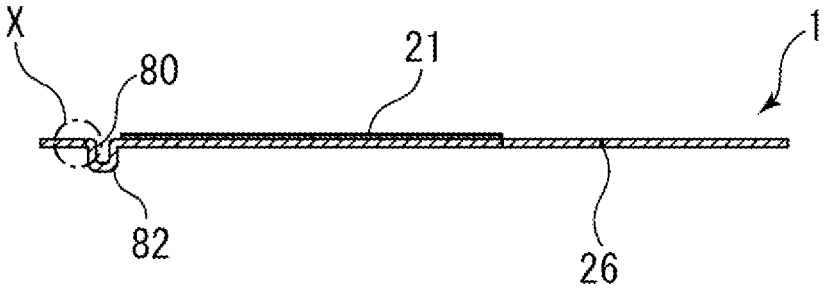
FIG. 40(*a*) is a cross-sectional view for explaining an example of a lid according to the second embodiment of the present invention.
Figure 40:
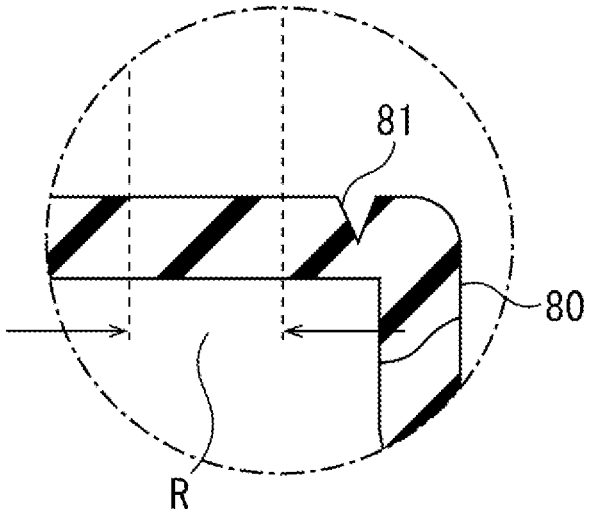

Even in the case where the groove 80 is formed, a part (front end edge part 75 and side end edge part 76) of an outer peripheral edge 73 of the small lid piece 13 excluding a hinge connecting part 74 may have a cut line 16 as illustrated in FIG. 33(*b*), or may be a half-cut part 81 as an example of the fragile part as illustrated in FIGS. 40(*a*) and 40(*b*). FIGS. 40(*a*) and 40(*b*) are diagrams illustrating one example of the lid 1 in a case where the groove 80 is formed. FIG. 40(*b*) is a partially enlarged view of a broken line region X in FIG. 40(*a*). The half-cut part 81 illustrated in this example is a part formed by cutting a member forming the lid 1 from the exposed surface 70 side of the lid 1 to a predetermined depth. That is, the half-cut part 81 is a part cut to such an extent as not to penetrate the member forming the lid 1, and is a part having the half-cut structure described above. Note, however, that this does not limit the configuration of the half-cut part 81. Note that in the case of the example illustrated in FIGS. 40(*a*) and 40(*b*), that is, in the case where the part of the outer peripheral edge 73 of the small lid piece 13 excluding the hinge connecting part 74 is the half-cut part 81 as the fragile part, even if the groove 80 is set to have a deep depth and the groove 80 is formed across the boundary between the small lid piece 13 and the peripheral part 72, a gap is less likely to occur at the position where the boundary between the small lid piece 13 and the peripheral part 72 and the groove 80 intersect with each other.

Although the number of grooves 80 formed is one in the example of FIG. 33(*a*), a plurality of grooves 80 may be concentrically formed. In the case where a plurality of grooves 80 are formed, one type of lid 1 can be used for covering the open mouth part 102 of a plurality of types of containers 101 having open mouth parts 102 with different diameters.

According to the lid 1 according to Modification 1 of the second embodiment, when the lid 1 is joined to the open mouth part 102 of the container 101 storing a liquid, even if the liquid leaks from the inside of the container 101 onto the exposed surface 70 of the lid 1, the liquid can flow down into the groove 80 before being spilled to the outside of the lid 1. Further, in a case where the groove 80 is formed so as to become deeper toward the small lid piece 13, the liquid flowing into the groove 80 can flow down toward the position of the small lid piece 13. Then, by pulling up the small lid piece 13 to expose an opening part 12, the liquid is allowed to drip into the container from the opening part 12.

(Protruding Part)

Figure 43:
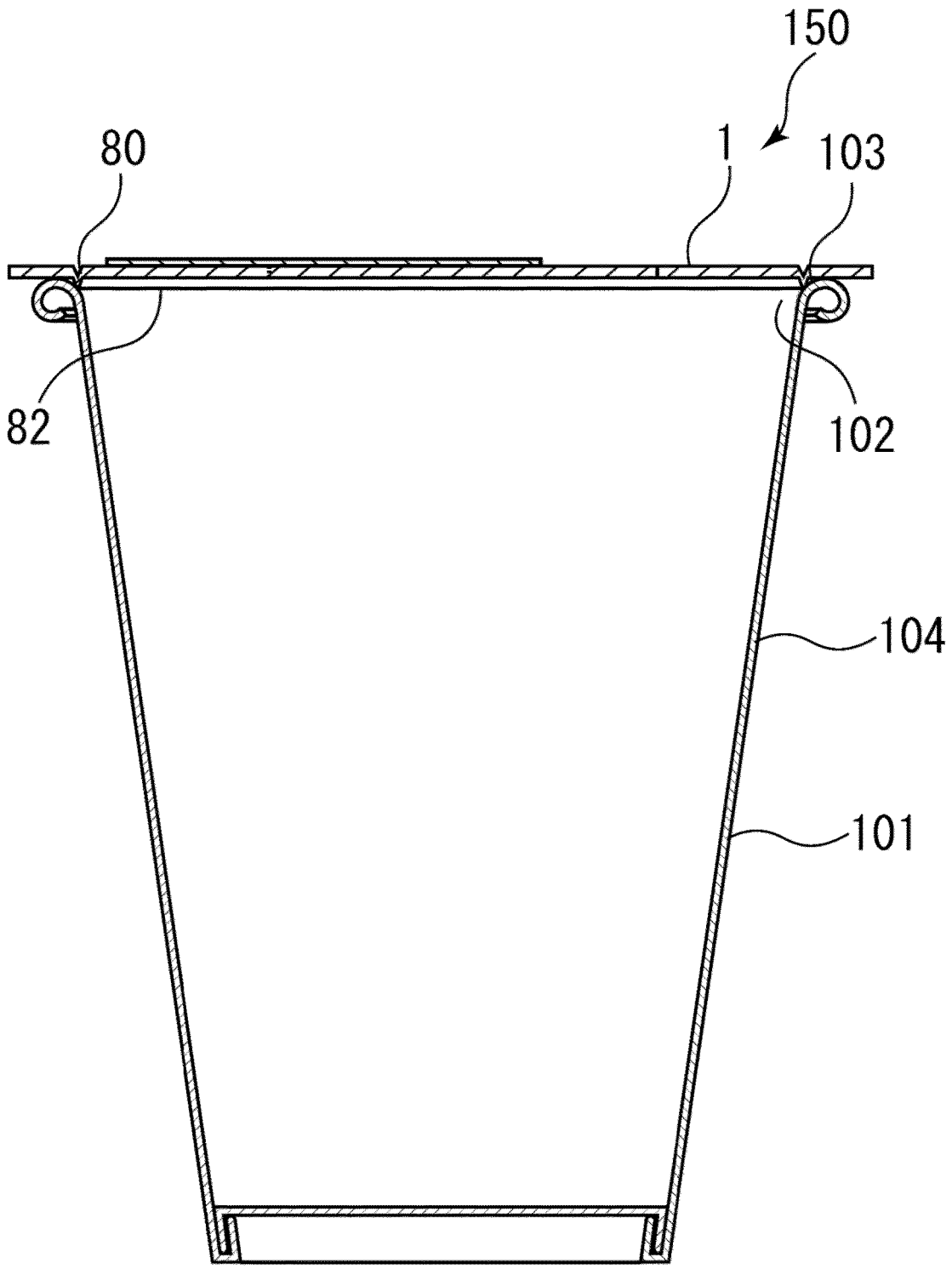
FIG. 43 is a cross-sectional view illustrating an example of the container with a lid.

In the lid 1, it is preferable that a position corresponding to a formation position of the groove 80 and on a side opposite to a formation surface (exposed surface 70) of the groove 80 be a protruding part 82. In this case, as illustrated in FIG. 43, the protruding part 82 is preferably formed at a position in contact with the inner surface side of an edge part 103 of the open mouth part 102 of the container 101. In addition, it is preferable that the height of the protruding part 82 is secured to such an extent that deviation of the exposed surface 70 of the lid 1 in the surface direction is less likely to occur with respect to the edge part 103 of the open mouth part 102 of the container 101. Such a protruding part 82 can be achieved by embossing the lid 1. By embossing, the groove 80 is formed on the exposed surface 70 side of the lid 1, and the protruding part 82 having a height corresponding to the depth of the groove 80 is formed at a position on the opposite surface side corresponding to the formation position of the groove 80. Then, by forming the groove 80 along the inside of the edge part 103 of the open mouth part 102 of the container 101, as illustrated in FIG. 43, the protruding part 82 can be formed along the inner end of the edge part 103 of the open mouth part 102 of the container 101 and in contact with the inner surface side of the edge part 103 of the open mouth part 102 of the container 101. Note that FIG. 43 is a cross-sectional view illustrating an example in which the lid 1 is disposed on the container 101.

Forming such a protruding part 82 facilitates alignment of the lid 1 with respect to the container 101 when the lid 1 is disposed so as to cover the open mouth part 102 of the container 101.

Modification 2

Figure 31:
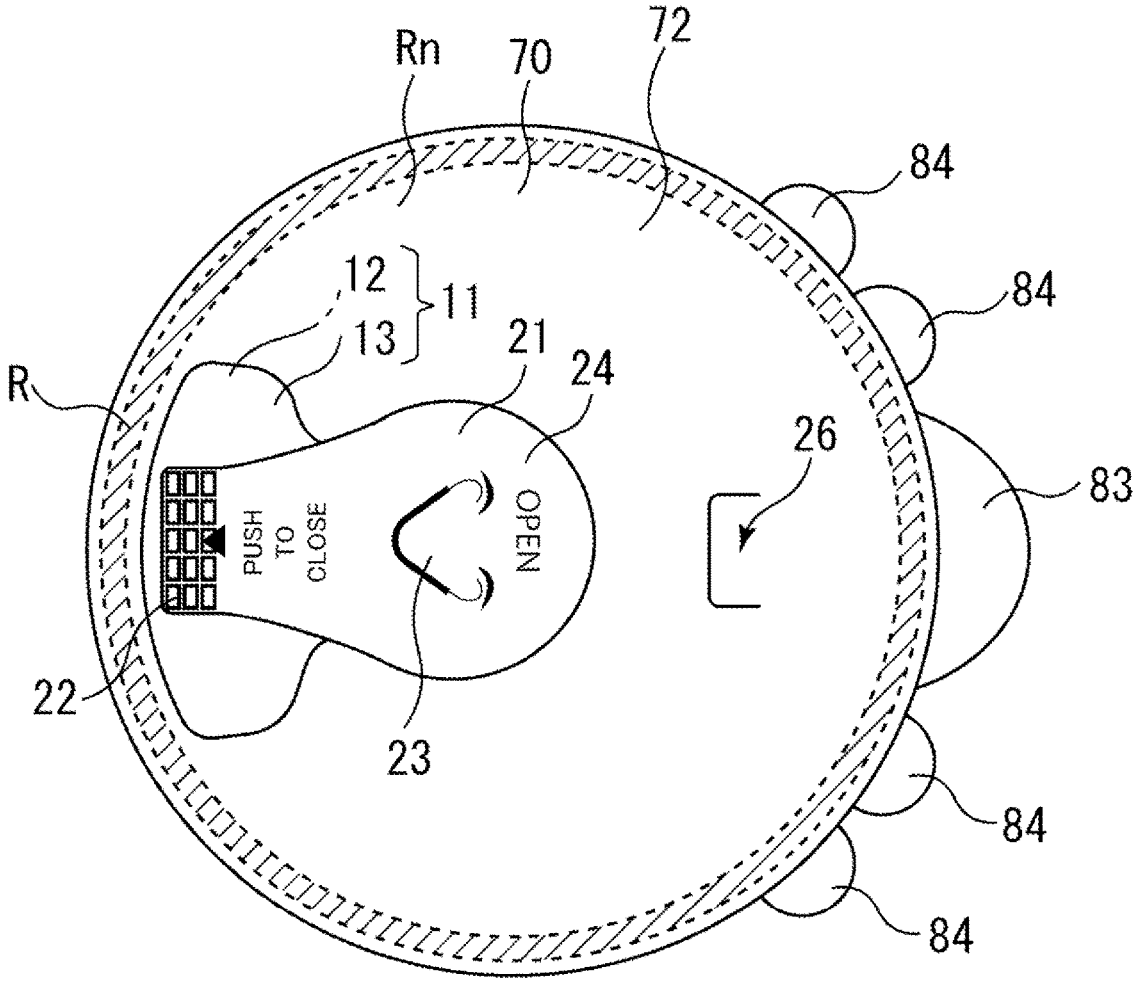
FIG. 31 is a plan view for explaining an example of a lid according to Modification 2 of the second embodiment of the present invention.

In the lid 1 according to the second embodiment, as illustrated in FIG. 31, a knob 83 (tab) and a label 84 may be formed outward from an outer peripheral edge 73 of a lid 1 (Modification 2). The knob 83 is preferably formed at a position far from the opening start end (one end part 13*a*) of a small lid piece 13. The shape and size of the knob 83 are preferably formed in such a shape and size that the user can pinch with the fingertips of his/her hand. Since the knob 83 is formed in this manner, it is possible to reduce the possibility that the hand touches an opening part 12 when gripping the lid 1, and it is possible to curb contamination of the opening part 12 due to the hand touching the opening part 12. Note that in the example of FIG. 31, the knob 83 is formed in a peripheral part 72 in plan view of the lid 1, and is formed in a part including a position farthest from the one end part 13*a* among positions of the outer peripheral edge 73.

Figure 48:
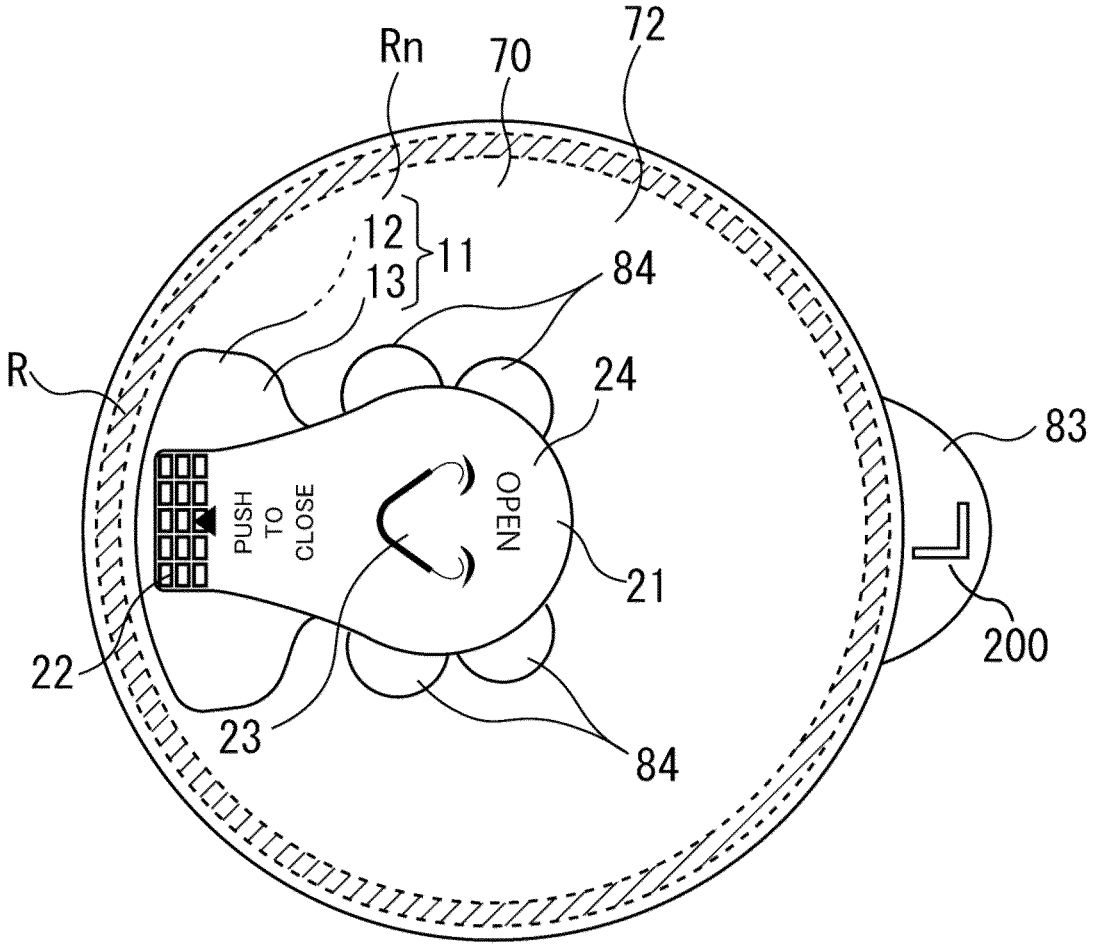
FIG. 48 is a plan view for explaining an example of the lid of the present invention.
Figure 49:
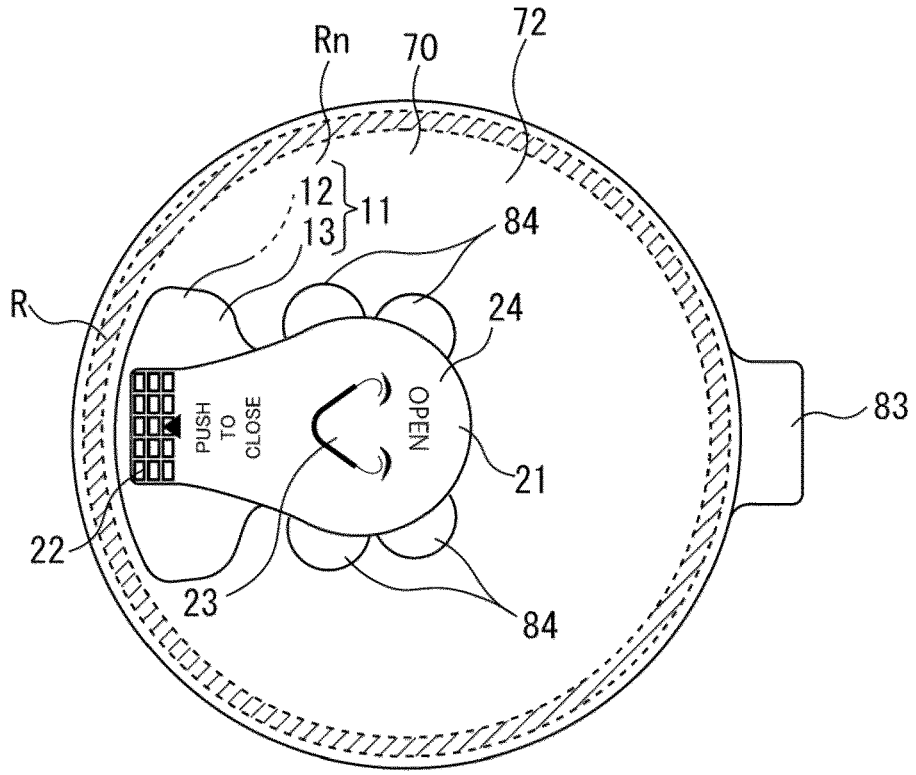
FIGS. 49(*a*) and 49(*b*) are plan views for explaining an example of the lid of the present invention.
Figure 49:
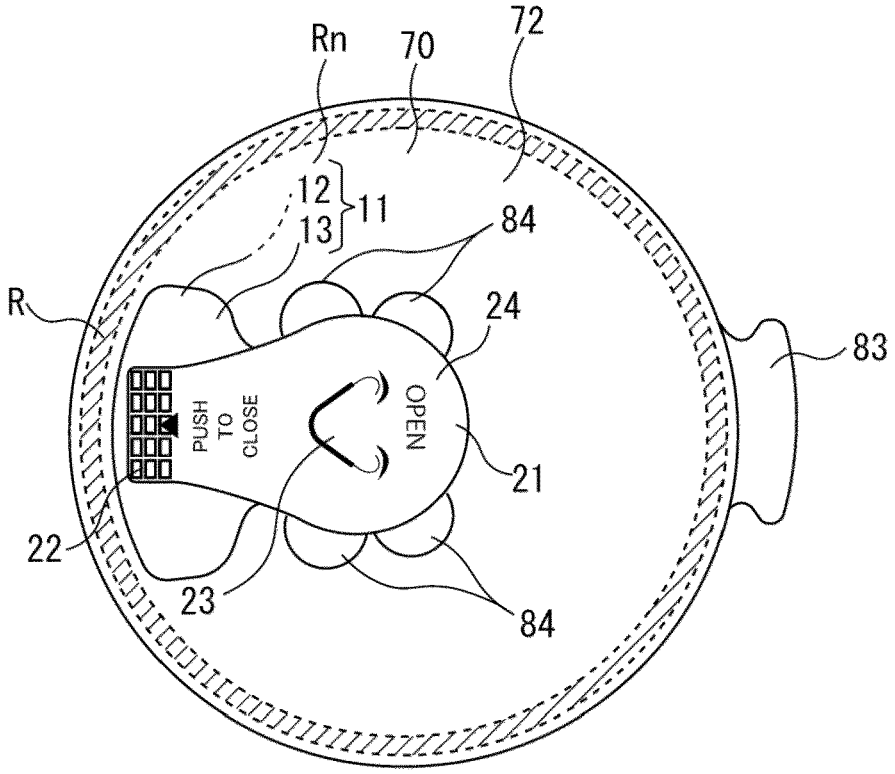

The knob 83 can be provided with an arbitrary display 200 such as characters (for example, character such as "L" illustrated in FIG. 48) indicating the size of the lid 1 and the container 101. The display or the like applied to the knob 83 is not limited to the case of printing, and may be displayed as a character that can be visually recognized by forming irregularities by embossing, a character that can be visually recognized by cutting out a shape corresponding to a character (for example, L) on the knob 83, or the like. Further, instead of or in addition to the display or the like described above, the knob 83 may be partially or entirely embossed, cut out, or the like. By subjecting the knob 83 to such processing, the user can easily pinch the lid 1 when pinching the knob 83 and picking up the lid 1 by hand. Note that in the above example, the example in which the sizes of the lid 1 and the container 101 are displayed by characters or the like has been described, but the mode of displaying the sizes of the lid 1 and the container 101 is not limited to the above example. For example, the shape of the knob 83 and the color of the knob 83 may be changed according to the size of the lid 1 and the container 101, and the sizes of the lid 1 and the container 101 may be identified by visually recognizing the shape and the color. For example, in the case of performing identification by changing the shape of the knob 83, in addition to the shape of the knob 83 described above, for example, the shape of the knob 83 may be changed as illustrated in FIGS. 49(*a*) and 49(*b*), or other shapes may be used for identification. In addition, the sizes of the lid 1 and the container 101 may be identified by other methods. Moreover, although the above is an example of identifying the sizes of the lid 1 and the container 101, the object to be identified is not limited to such sizes of the lid 1 and the container 101, and other objects may be exemplified as the object to be identified.

Although the shape and size of the label 84 are not limited, it is preferable that the label has a shape and size that can be recognized by a user. In the example of FIG. 31, a plurality of labels 84 are formed in the vicinity of the knob 83 on the outer peripheral edge 73 of the lid 1. The label 84 may be used as follows, for example. That is, an individual product name is described on each of the plurality of labels 84, and the label 84 on which a product name corresponding to the content of the container 101 is described is bent. Accordingly, even after the container 101 is bonded with the lid 1, the content of the product stored in the container 101 can be identified by recognizing the bent label 84.

Figure 54:
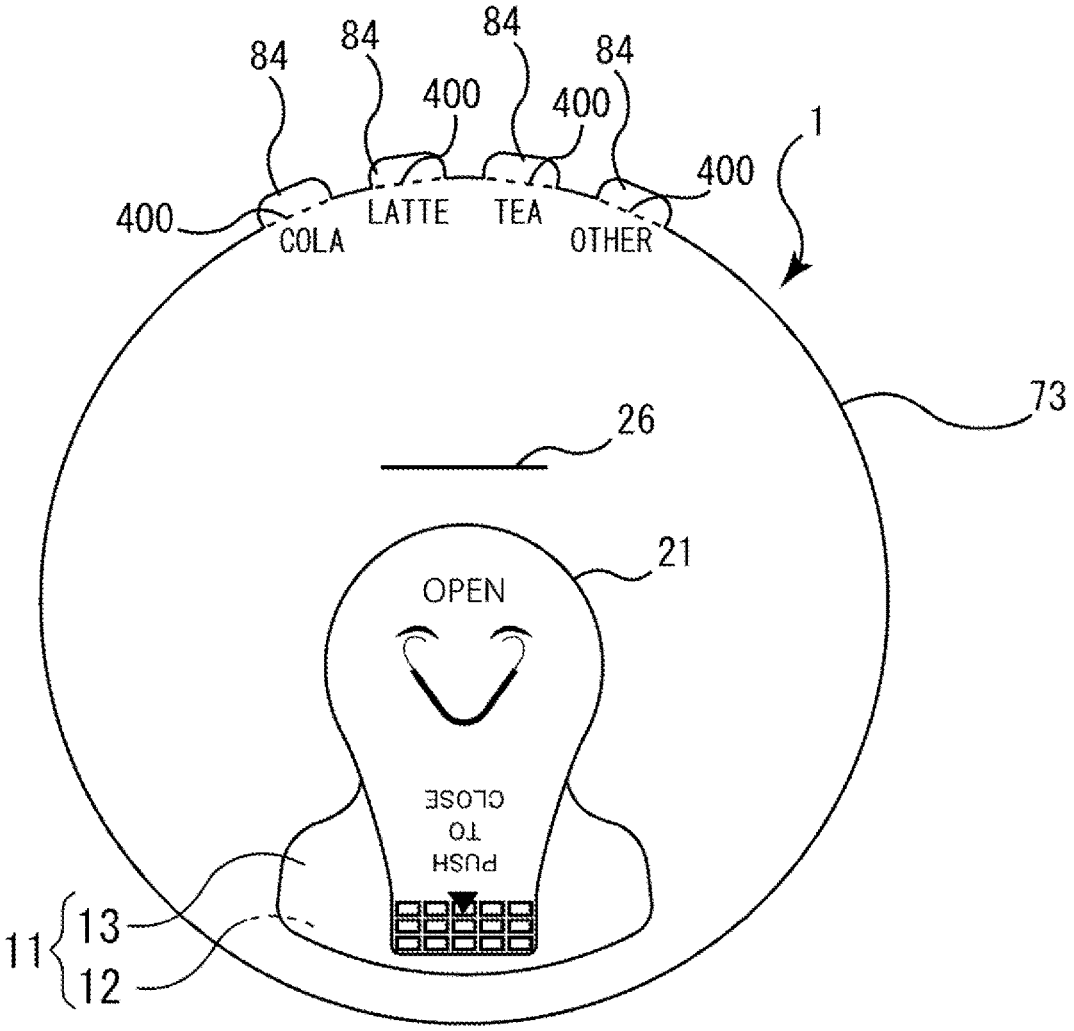
FIG. 54 is a plan view illustrating a configuration of a lid having a tab member of another mode.
Figure 55:
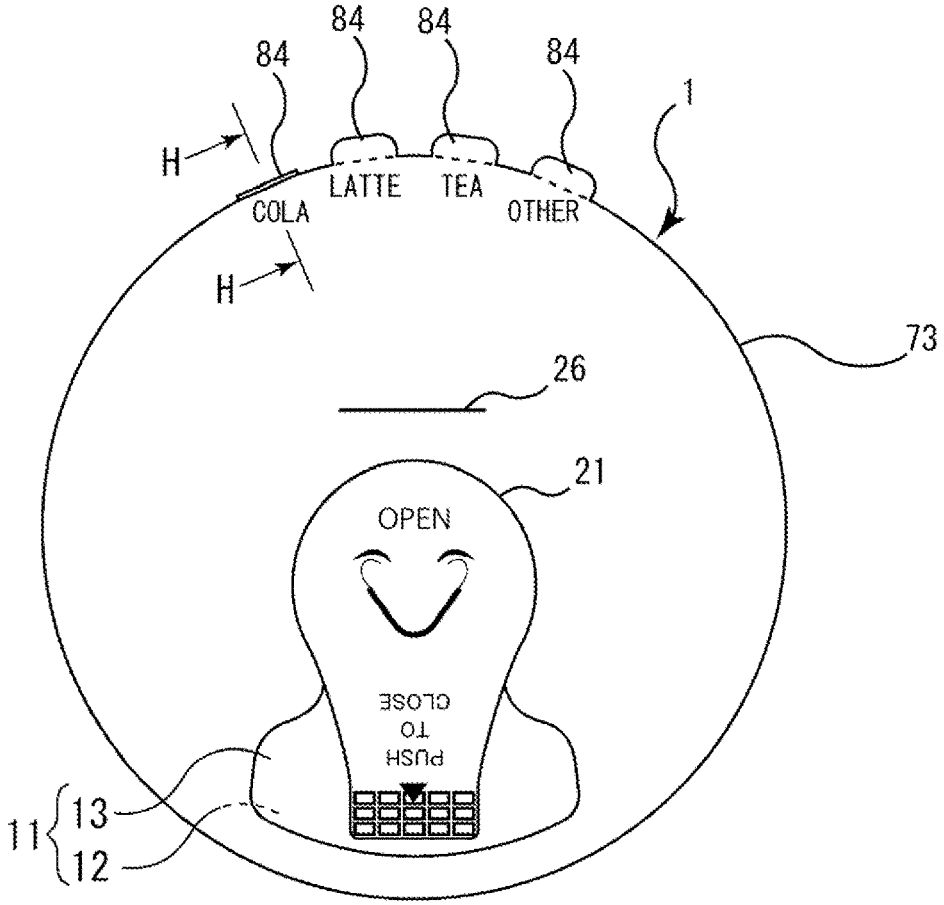
FIG. 55(*a*) is a plan view for explaining a usage example of the lid illustrated in FIG. 54.
Figure 55:
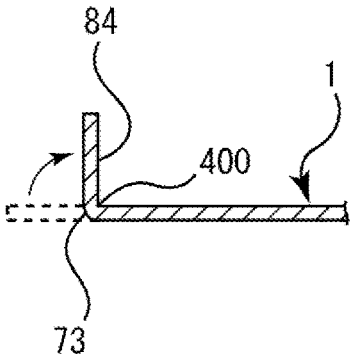

In the example of FIGS. 54 and 55, a plurality of labels 84 are formed on the outer peripheral edge 73 of the lid 1.

The plurality of labels 84 are configured to be bendable along the outer peripheral edge 73 of the lid 1. A bending part 400 for easily bending the label 84 is preferably formed at a boundary between the outer peripheral edge 73 and the label 84. The bending part 400 may have any configuration as long as the label 84 can be easily bent, and for example, a perforation line may be formed at the boundary between the outer peripheral edge 73 and the label 84, a cut less than the thickness of the material constituting the lid 1 may be formed, a folding line may be formed, or these may be formed in a composite manner. In addition, as long as the label 84 can be easily bent, configurations other than those described above may be employed. On the lid 1, for example, individual product names such as "COLA", "LATTE", "TEA", and "OTHER" can be written on parts corresponding to the parts where the labels 84 are formed. These individual product names are not limited to those described above, and may be other notations. In addition, at least a part of these individual product names is preferably displayed inside the outer peripheral edge 73, and the entire individual product names are preferably displayed inside the outer peripheral edge 73. With such display, the product name can be visually recognized more clearly. FIG. 55(*a*) is a plan view illustrating a usage example of the lid 1 in this example. This example is a use example in a case where the content is cola. In this case, of the labels 84, the label 84 at the part where "COLA" corresponding to cola is displayed is bent. FIG. 55(*b*) illustrates a state in which the label 84 is bent. The bending direction of the label 84 is not limited to upward as illustrated in FIG. 55(*b*), and may be downward. As described above, when the label 84 corresponding to the content is bent, since the other labels 84 are not bent, it is possible to clearly visually recognize that the label having the notation corresponding to the part where the label 84 is bent is the content, and an employee of the store, a purchaser, or the like can easily recognize what the content is, and it is possible to eat and drink with security. Note that in this example, the description has been given using a mode in which the label 84 is bent, but the label 84 may be detached by being torn or the like. In this case, too, in order to make it easy to tear the label 84, it is preferable to form the above-described perforation line or the like at a position corresponding to the above-described bending part 400. Even in a case where the label 84 is torn in this manner, it is possible to easily clarify what the corresponding content is. Note that even in a mode other than bending or tearing the label 84, other configurations may be adopted as long as the configuration can be used to clearly identify the content. In addition, the label 84 may be colored with a predetermined color or the like, or a conventionally known method such as embossing may be arbitrarily selected and appropriately used.

Figure 45:
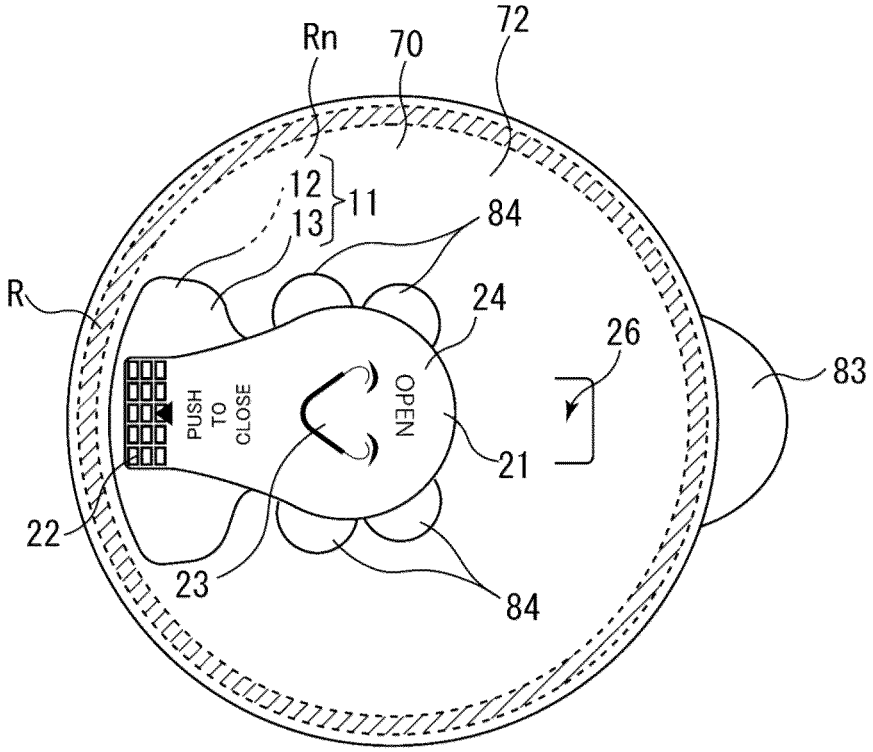
FIGS. 45(*a*) and 45(*b*) are plan views for explaining an example of a lid according to Modification 2 of the second embodiment of the present invention.
Figure 45:
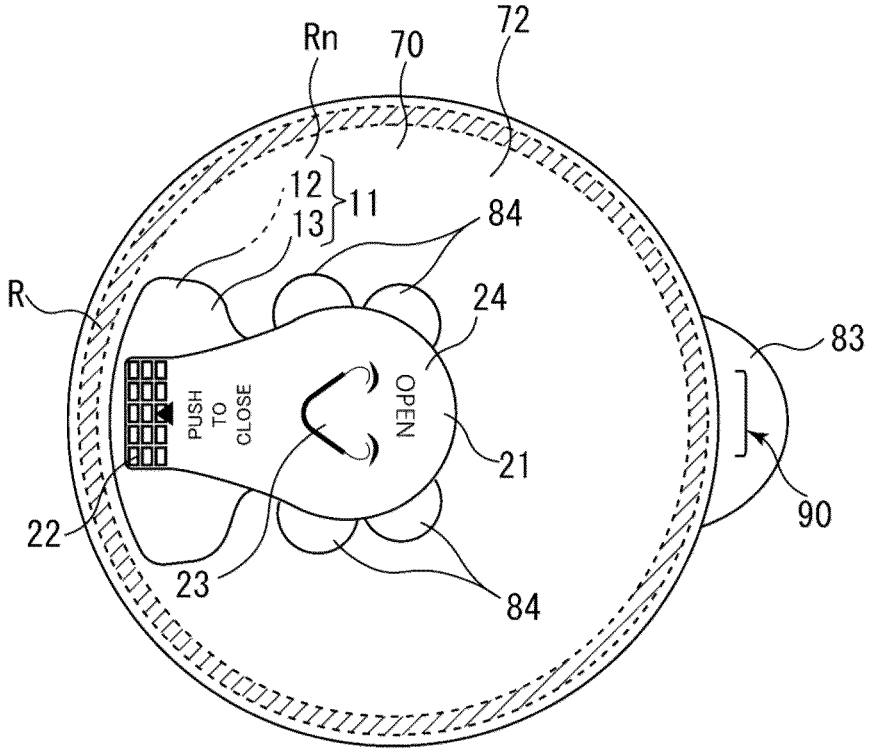

Note that although the label 84 is formed on the peripheral part 72 of the lid 1 in the example of FIG. 31, the label 84 may be formed on a tab member 21. For example, as illustrated in FIG. 45(*a*), a plurality of labels 84 may be formed around the tab member 21. In addition, when the knob 83 is formed, as illustrated in FIG. 45(*b*), the knob 83 may be formed together with the insertion part 26 or instead of the insertion part 26. An insertion part 90 may be formed in a structure similar to that of the insertion part 26. In FIG. 45(*b*), the insertion part 90 is formed instead of the insertion part 26. The insertion part 90 has a function similar to that of the insertion part 26. However, in this case, the size of the tab member 21 or the small lid piece 13 (opening part 12) is preferably set to such a size that a holding piece 23 of the tab member 21 is inserted into the insertion part 90 in a state where the small lid piece 13 is lifted up. Further, the tab member 21 may be locked by hooking the holding piece 23 at the position of the outer peripheral edge 73 of the lid 1. In this case, the insertion part 26 may be omitted from the lid 1.

As illustrated in FIG. 45(*b*), in the case where the insertion part 90 is formed in the knob 83, particularly when the contour of the small lid piece 13 is formed by a half-cut line, there is no place where the front surface and the back surface of the top surface part 2*a* communicate with each other in the region surrounded by a joining region R. Therefore, after the lid 1 is sealed to the container 101 and before the user opens the small lid piece 13, the inside of the container 101 can be brought into a completely sealed state, and it is possible to prevent foreign matter from being mixed from the outside or content from leaking to the outside of the container 101 when the user carries the container 101 and shakes the container 101. In addition, in a case where the insertion part 90 is formed in the knob 83 in this manner, the size of the small lid piece 13 and therefore the size of the opening part 12 can be increased. In this way, when the opening part 12 and the small lid piece 13 can be enlarged, it is possible to make it easy for the user to drink the content, and it is also possible to greatly improve the ease of putting the content such as a beverage into the container 101 from the opening part 12.

Figure 50:
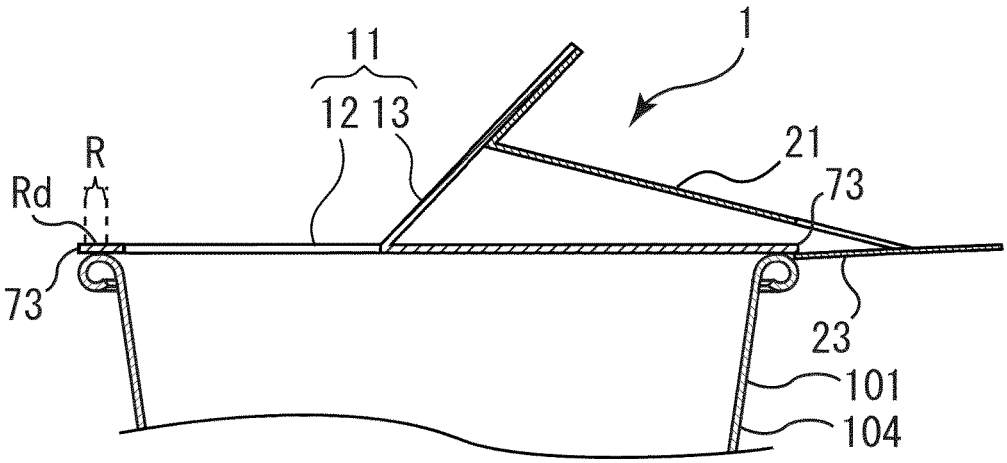
FIGS. 50(*a*) and 50(*b*) are explanatory views for explaining an example of a lid according to the second embodiment of the present invention.
Figure 50:
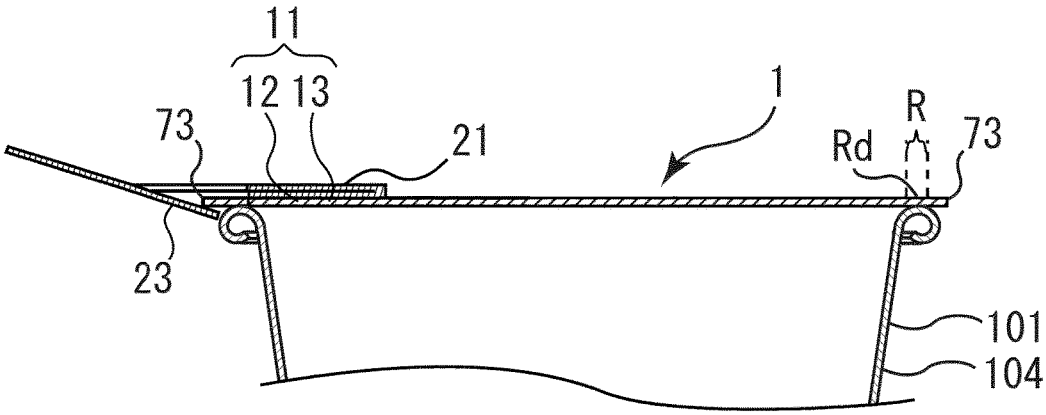
Figure 56:
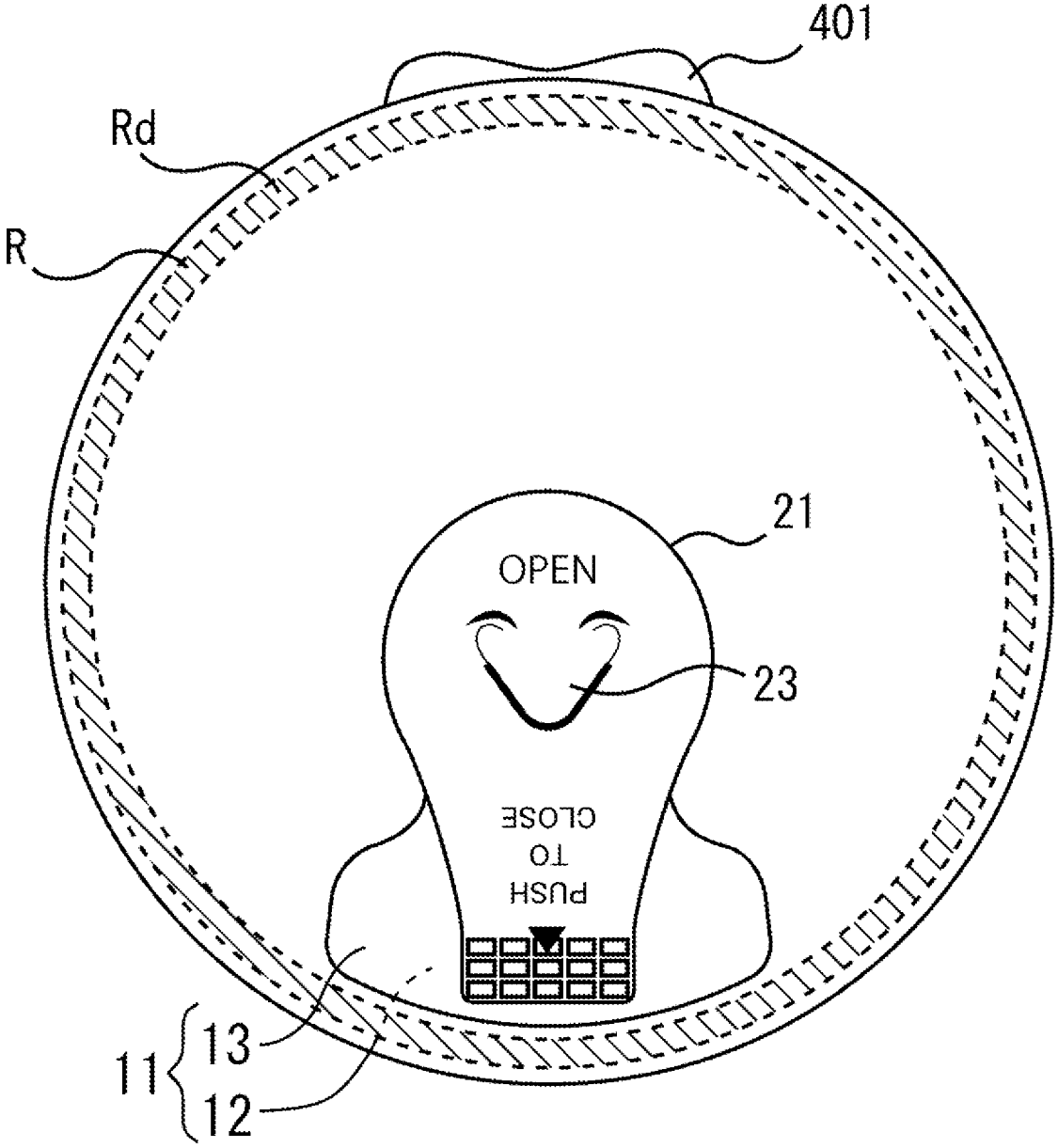
FIG. 56 is a plan view for explaining an example of a lid according to a modification of the second embodiment of the present invention.

Note that in FIG. 45(*b*), a mode in which the insertion part 90 formed in the knob 83 is formed, and the holding piece 23 is inserted to lock the tab member 21 has been described. However, as illustrated in FIG. 50(*a*), the holding piece 23 may be hooked on the outer peripheral edge 73 of the lid 1 to lock the tab member 21. Further, as illustrated in FIG. 50(*b*), when the small lid piece 13 is re-closed, the holding piece 23 may be hooked on the outer peripheral edge 73 on the side close to the small lid piece 13 to keep the small lid piece 13 re-closed. Note that when re-opening the re-closed small lid piece 13, it is sufficient to release the hook between the outer peripheral edge 73 and the small lid piece 13. In addition, as illustrated in FIG. 56, a holding and receiving part 401 formed so as to extend from the outer peripheral edge 73 may be formed instead of the insertion part. In the case where the holding and receiving part 401 is formed in this way, the small lid piece 13 is held in the opened state by hooking the holding part 23 on the holding and receiving part 401 or the like, and when the small lid piece 13 is to be re-closed, the holding part 23 may be removed from the holding and receiving part 401 to re-close the small lid piece 13. Note that in this case, it is sufficient that the holding and receiving part 401 can hold the holding part 23, and the shape and the size thereof are not limited and may be arbitrarily selected.

Note that in this example, by hooking the holding piece 23 formed on the tab member 21 on the outer peripheral edge 73, it is possible to keep the small lid piece 13 open and keep the small lid piece 13 re-closed. However, the configuration for keeping the small lid piece 13 open and keeping the small lid piece re-closed is not limited to the above-described configuration, and those of other modes may be arbitrarily selected and used. For example, a seal member may be used instead of the tab member 21 so that the small lid piece 13 can be kept open or re-closed by an adhesive action, or the above-described state of the small lid piece 13 can be maintained using another member.

Modification 3

Figure 34:
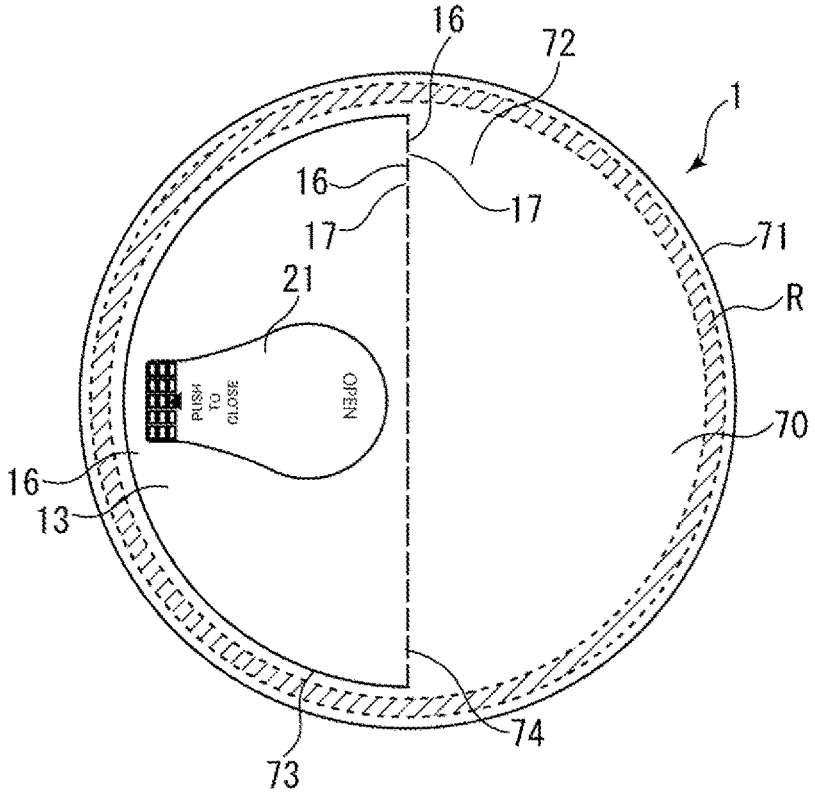
FIGS. 34(*a*) and 34(*b*) are plan views for explaining an example of a lid according to Modification 3 of the second embodiment of the present invention.
Figure 34:
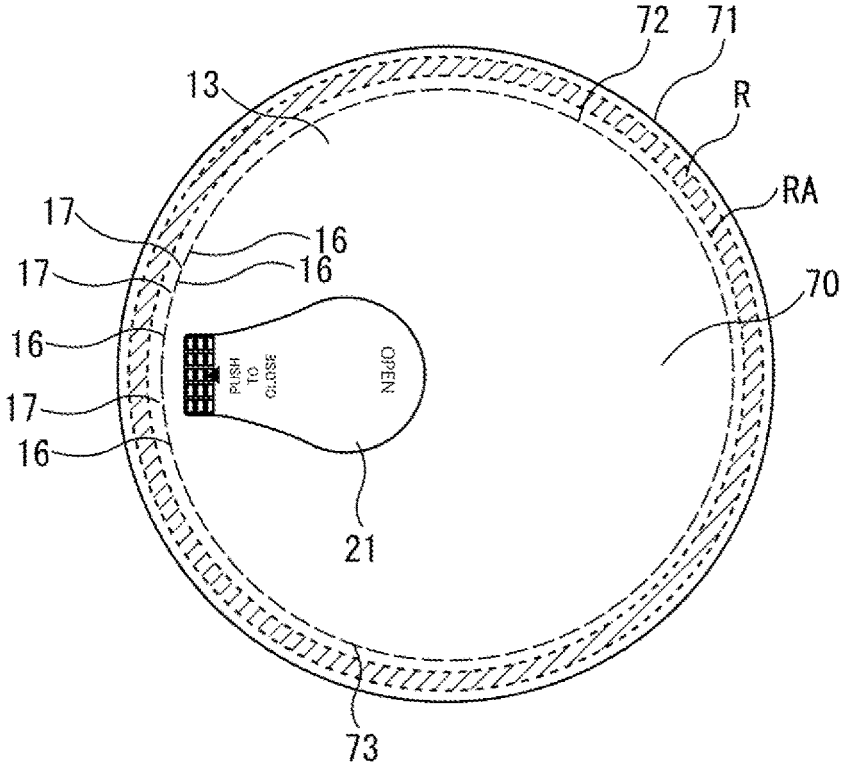

In the lid 1 according to the second embodiment, as illustrated in FIGS. 34(*a*) and 34(*b*), a small lid piece 13 may be formed with a large dimension so that an entire tab member 21 overlaps a small lid piece 13 in the closed lid state (Modification 3). Note, however, that also in Modification 3 of the second embodiment, the small lid piece 13 is formed inside a joining region R, and is smaller than the dimension of a lid 1. FIGS. 34(*a*) and 34(*b*) are diagrams illustrating an example of the lid 1 according to Modification 3 of the second embodiment.

In the lid 1 according to the second embodiment, the lid 1 may be cut at a hinge connecting part of the outer peripheral edge of the small lid piece in the open lid state. In this case, as illustrated in FIG. 34(*a*), a hinge connecting part 74 of an outer peripheral edge 73 of the small lid piece 13 preferably has a configuration similar to that of a fragile part. In FIG. 34(*a*), the fragile part has a repeated structure (perforated structure) of a cut line 16 and a dotted joint part 17. Note that in the example of FIG. 34(*a*), a part of the outer peripheral edge 73 of the small lid piece 13 excluding the hinge connecting part 74 is the cut line 16.

In addition, in the lid 1 according to the second embodiment, as illustrated in FIG. 34(*b*), the hinge connecting part 74 may be omitted. In the example of FIG. 34(*b*), the outer peripheral edge 73 of the small lid piece 13 is a fragile part. As in FIG. 34(*a*), the fragile part has a repeating structure (perforated structure) of the cut line 16 and the dotted joint part 17.

In Modification 3 of the second embodiment described above, when the small lid piece 13 is lifted by the tab member 21 in the closed lid state, the small lid piece 13 and the peripheral part 72 are separated. Further, in Modification 3 of the second embodiment, as illustrated in FIG. 34, the holding piece 23 and the insertion part 26 may be omitted. Note, however, that in the present invention, from the viewpoint of obtaining the effect of holding the small lid piece 13 in the peripheral part 72, it is preferable that the holding piece 23 and the insertion part 26 are present.

Modification 4

Figure 37:
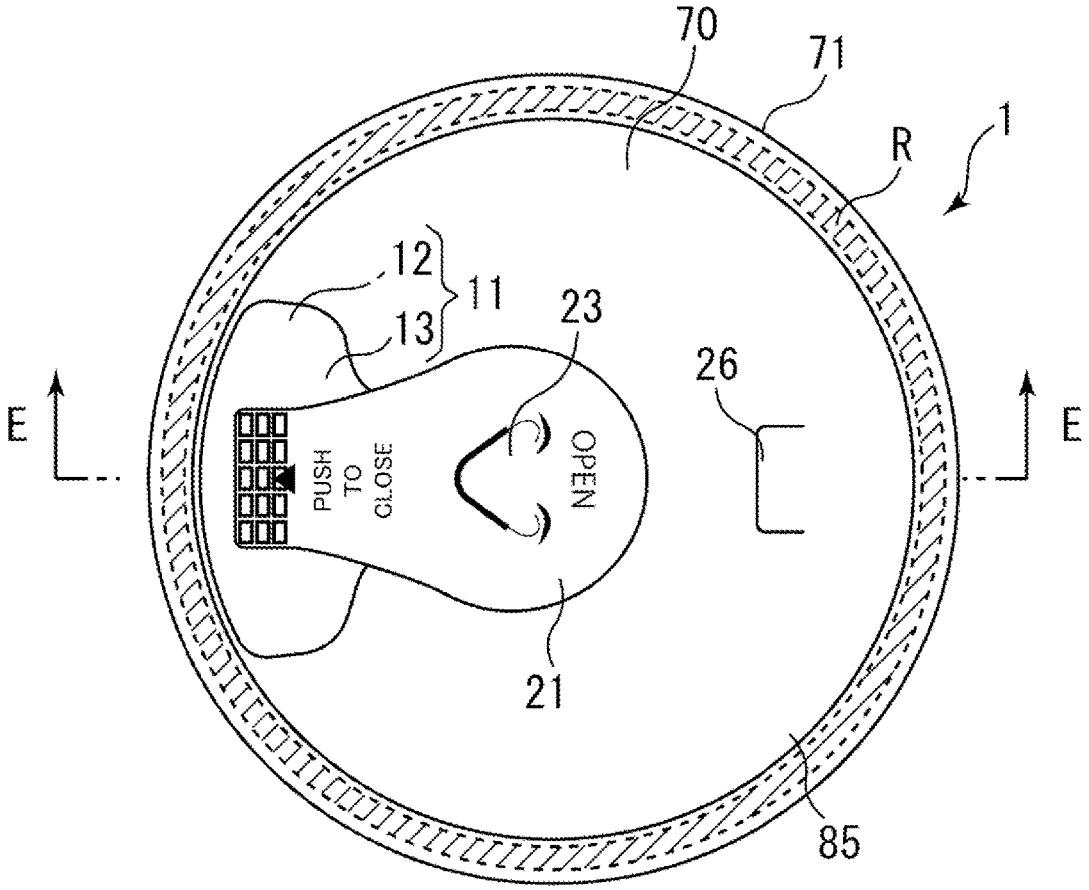
FIG. 37(*a*) is a plan view for explaining an example of a lid according to Modification 4 of the second embodiment of the present invention.
Figure 37:
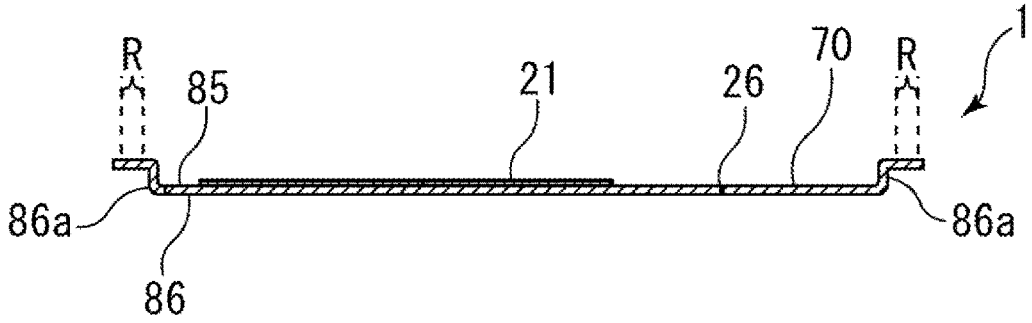

In the lid 1 according to the second embodiment, instead of the groove 80 formed inside the joining region R, as illustrated in FIGS. 37(*a*) and 37(*b*), a recessed part 85 in which a region inside a joining region R is entirely recessed with respect to a part corresponding to the joining region R may be formed (Modification 4). FIGS. 37(*a*) and 37(*b*) are diagrams illustrating an example of a lid 1 according to Modification 4 of the second embodiment.

Figure 44:
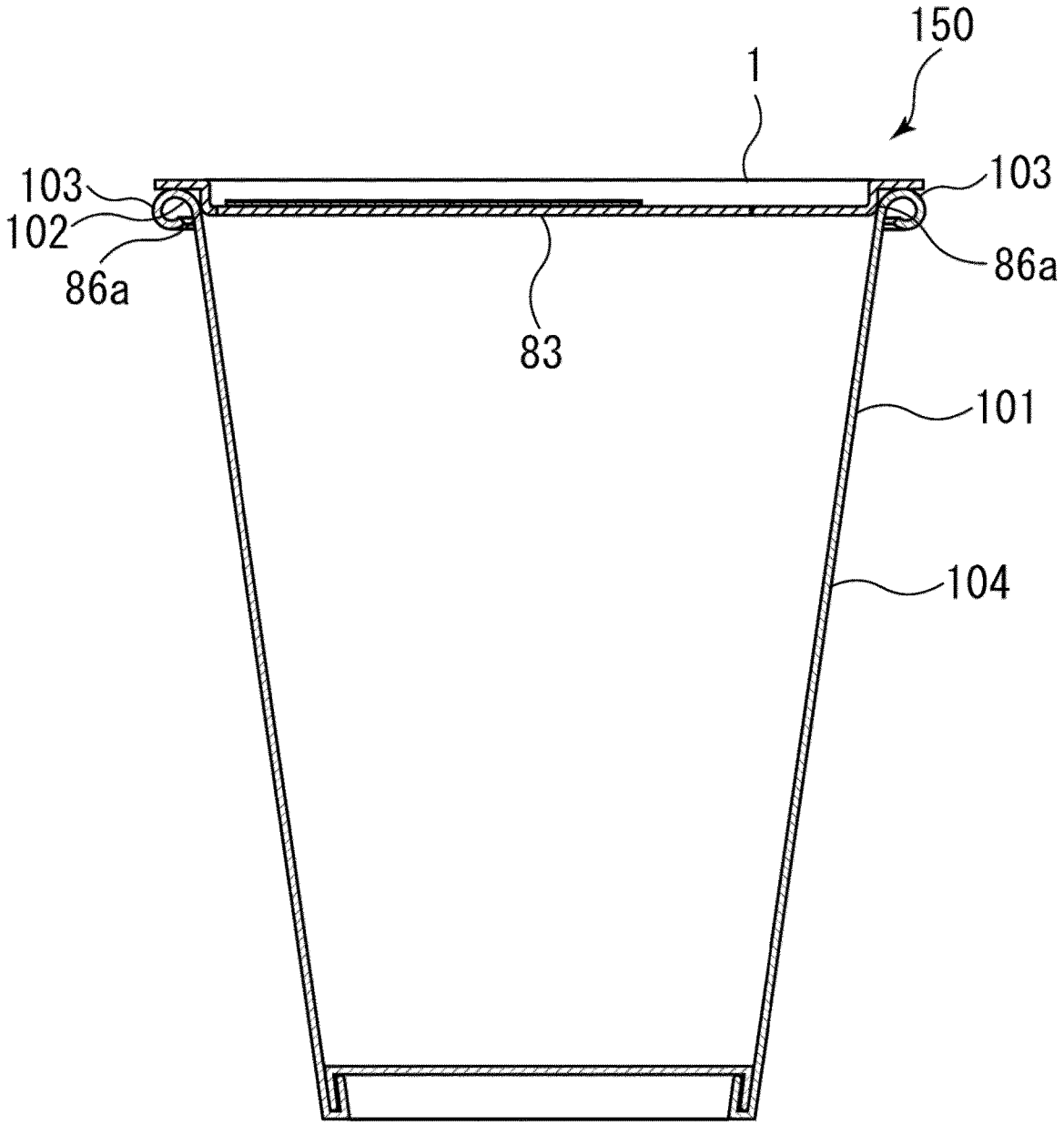
FIG. 44 is a cross-sectional view illustrating an example of the container with a lid.

In the lid 1, it is preferable that a position on a side opposite to a forming surface (exposed surface 70) of the recessed part 85 is a raised part 86. In this case, it is preferable that an outer peripheral end 86*a* of the raised part 86 is formed so as to be in contact with the inner surface side of an edge part 103 of an open mouth part 102 of a container 101. In addition, it is preferable that the height of the raised part 86 is secured to such an extent that deviation from the open mouth part 102 of the container 101 is less likely to occur. Such a raised part 86 can be achieved by embossing the lid 1. By embossing, the recessed part 85 is formed on the exposed surface 70 side of the lid 1, and the raised part 86 having a height corresponding to the depth of the recessed part 85 is formed at a position on the opposite surface side corresponding to the formation position of the recessed part 85. Then, by forming the recessed part 85 so that the contour shape of the recessed part 85 is along the open mouth part 102 of the container 101, as illustrated in FIG. 44, the raised part 86 can be formed so as to be in contact with the inner surface side of the edge part 103 of the open mouth part 102 of the container 101. Note that FIG. 44 is a cross-sectional view illustrating an example in which the lid 1 is disposed on the container 101.

Forming such a raised part 86 facilitates alignment of the lid with respect to the container 101 when the lid 1 is disposed so as to cover the open mouth part 102 of the container 101.

Modification 5

Figure 41:
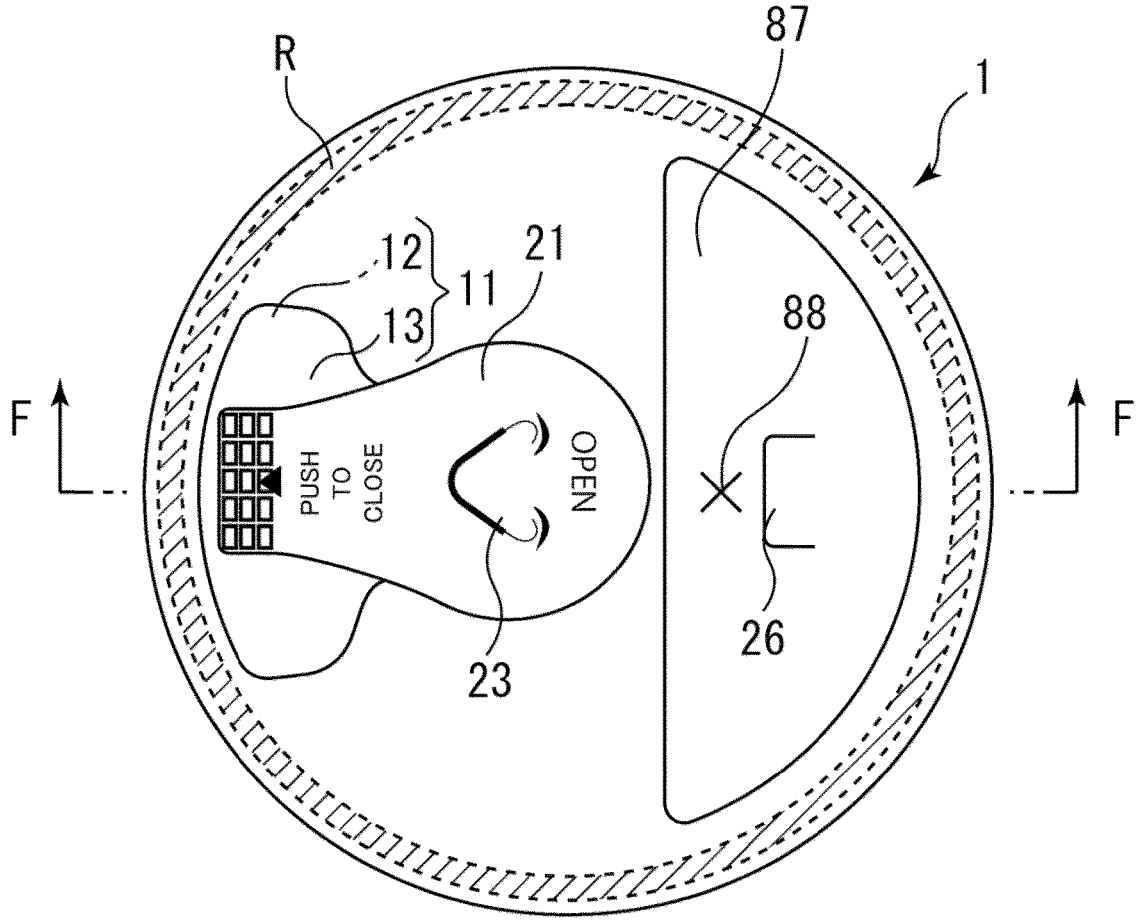
FIG. 41(*a*) is a plan view for explaining an example of a lid according to Modification 5 of the second embodiment of the present invention.
Figure 41:
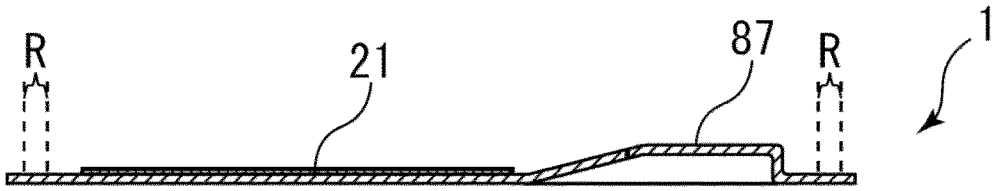

In the lid 1 according to the second embodiment, as illustrated in FIGS. 41(*a*) and 41(*b*), an upper raised part 87 may be formed inside a joining region R (Modification 5). FIGS. 41(*a*) and 41(*b*) are diagrams illustrating an example of a lid 1 according to Modification 5. The upper raised part 87 is preferably formed in a region avoiding a small lid piece 13. In this case, a liquid is stored in a container 101, and even if the liquid leaks onto an exposed surface 70 of the lid 1, the liquid easily flows toward the small lid piece 13 formed on the downstream side of the upper raised part 87. Therefore, by opening the small lid piece 13 to expose an opening part 12, the leaked liquid can be easily returned into the container 101. In addition, a slit 88 penetrating the lid 1 may be formed in the upper raised part 87. The slit 88 is formed to have such a size that a rod-like body such as a straw can be inserted from the outside. Since the slit 88 is formed, the liquid in the container can be sucked out with a straw or the like. In the example of FIG. 41(*a*), the slit 88 is formed as a structural part in which a cross-shaped cut is made in a member constituting the lid 1, but the structure of the slit 88 is not limited thereto.

Modification 6

Figure 46:
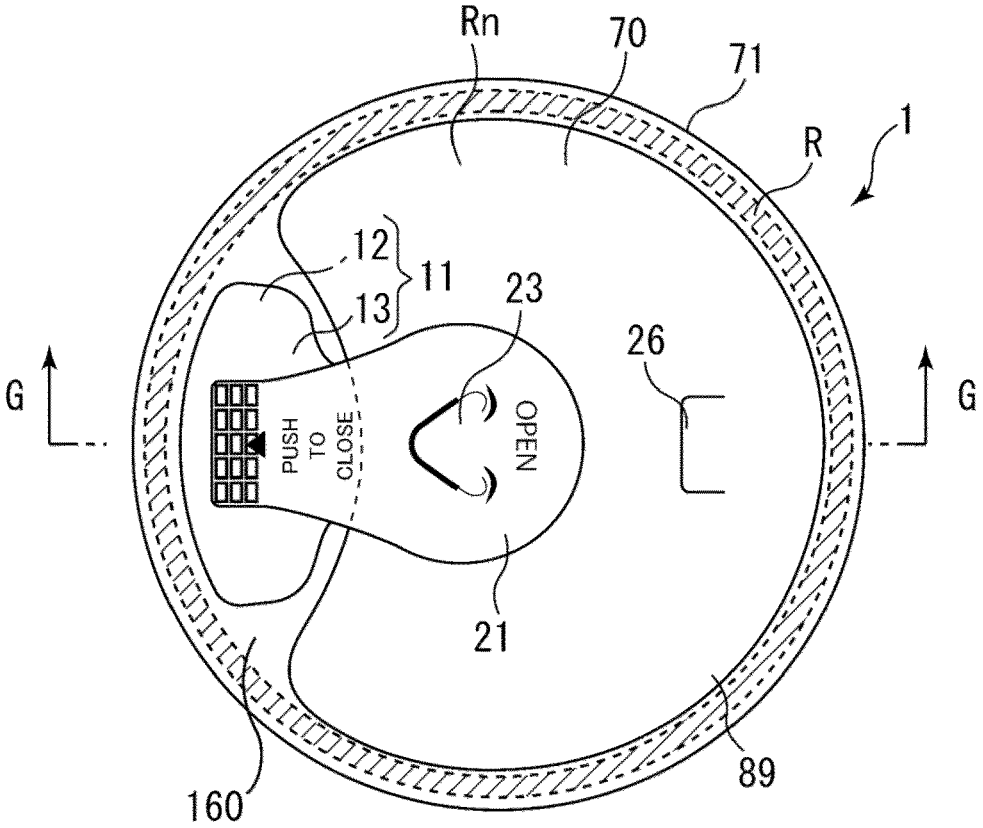
FIG. 46(*a*) is a plan view for explaining an example of a lid according to Modification 6 of the second embodiment of the present invention.
Figure 46:
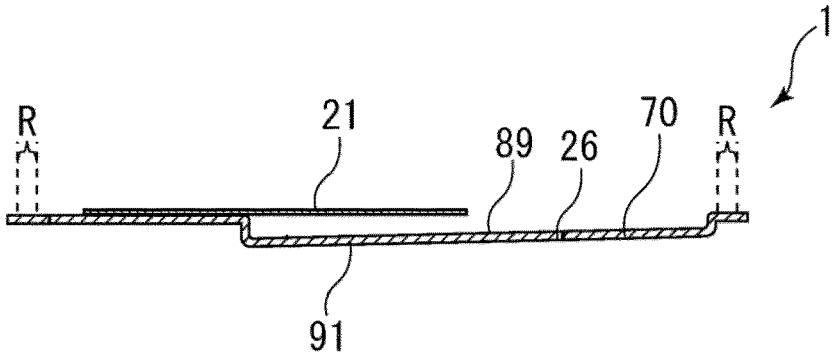

In an example of FIG. 44, the recessed part 85 entirely recesses the region inside the joining region R. However, in the lid 1 according to the second embodiment, as illustrated in FIGS. 46(*a*) and 46(*b*), a partially recessed part 89 in which a region inside a joining region R is partially recessed may be formed (Modification 6). FIG. 46(*a*) is a plan view for explaining an example of a lid 1 according to Modification 6 of the second embodiment. FIG. 46(*b*) is a cross-sectional view schematically illustrating a state of a longitudinal cross section taken along line G-G in FIG. 46(*a*). The partially recessed part 89 is formed outside an opening part 12 and in an inner region Rn. In this example, the partially recessed part 89 has a shape recessed so as to form an inclined surface inclined downward toward the opening part 12. Further, in this example, on a side opposite to the exposed surface of the lid 1, a partially raised part 91 is formed in a shape corresponding to the part where the partially recessed part 89 is formed. Since the partially raised part 91 is formed, positioning when the lid 1 is disposed in an open mouth part 102 of a container 101 becomes easy.

As illustrated in FIG. 46, in a case where the partially recessed part 89 is formed outside the opening part 12 so as to avoid the position of the opening part 12, when a pressing step or the like for forming the partially recessed part 89 is performed, a pressing force is less likely to be applied to a part 160 near the opening part 12, so that there is no possibility that a dotted joint part 17 at the peripheral edge of an opening forming part 11 is cut to open the opening part 12.

Modification 7

Figure 51:
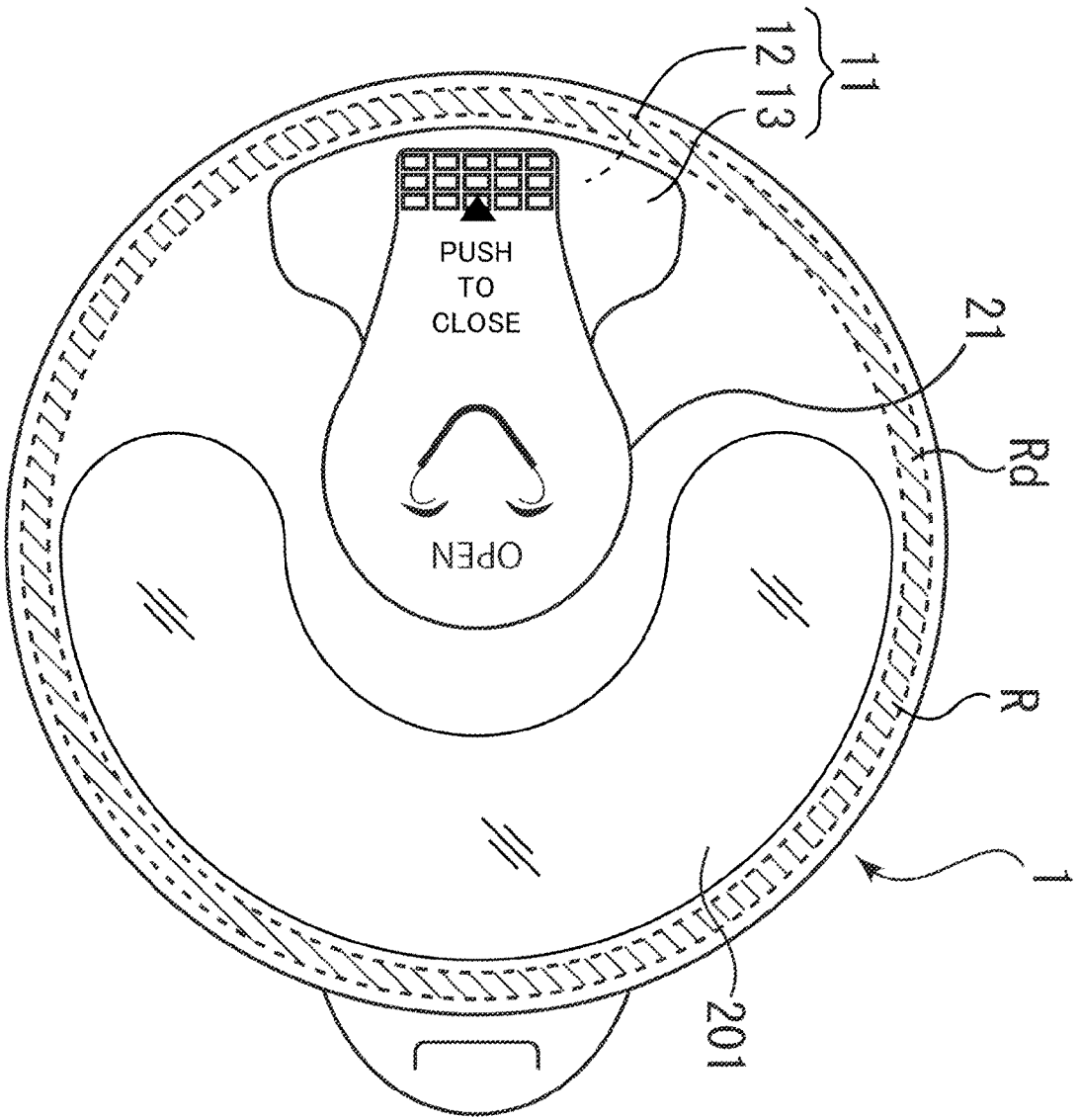
FIG. 51 is a plan view for explaining an example of a lid according to Modification 7 of the second embodiment of the present invention.

As illustrated in FIG. 51, in a lid 1, a window part 201 may be formed inside a joining region R. By forming the window part 201, when the lid 1 is joined and sealed to a container 101, the content of the container 101 can be visually recognized, and what the content is can be easily checked to give a sense of security. Note that examples of a film material used for the window part 201 include those using a synthetic resin, a biodegradable resin, or the like as a raw material. Examples of the synthetic/natural resin include olefin-based resins such as polyethylene (PE) and polypropylene (PP), styrene-based resins such as polystyrene (PS), acryl-based resins such as polyacrylate and polymethacrylate, vinyl-based resins such as polyvinyl chloride (PVC) and polyvinyl acetate, polyamide-based resins, polyimide-based resins, polyester-based resins such as polyethylene terephthalate (PET), fluorine-based resins, polyether-based resins such as polycarbonate-based resins (PC), polyether ether ketone (PEEK) and polyether sulfone (PES), and the like.

Examples of the biodegradable resin include biodegradable resins produced by microorganisms such as polyhydroxyalkanoate (PHA) and PHA-based copolymers; natural product-based biodegradable resin such as starch-based resin mainly composed of cellulose derivatives such as cellulose acetate or starch such as corn starch; lactic acid-based resins such as polylactic acid (PLA), a polylactic acid/polycaprolactone copolymer, and a polylactic acid/polyether copolymer; succinate-based resins such as polybutylene succinate (PBS), polybutylene succinate adipate (PBSA), and polyethylene terephthalate succinate (PETS); chemically synthetic biodegradable resins such as polycaprolactone and polyvinyl alcohol (PVA); and polyglycolic acid (PGA), polybutylene adipate/terephthalate, and biodegradable polyolefins (product surface: Biorecover, product name; Cra Drop and the like).

Among them, a biodegradable resin having less problems of environmental pollution is preferable. When the in-container storage product is a liquid or the like, a material having excellent water resistance, oil resistance, and the like is preferable.

Modification 8

Figure 52:
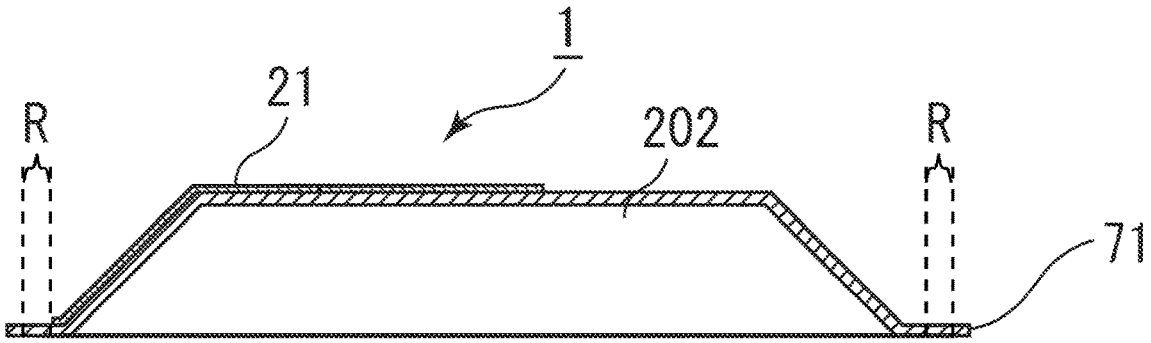
FIG. 52 is an explanatory view for explaining an example of a lid according to Modification 8 of the second embodiment of the present invention.

As illustrated in FIG. 52, a lid 1 may raise the inside of a joining region R. By forming a raised part 202 raised in this manner, it is possible to increase the space in which the content is accommodated in a container 101. For example, in a case where the content is liquid such as coffee, it is possible to greatly reduce the contact with the back surface of the lid 1 even when a cream-like material is placed on the liquid, for example. Note that the height of the raised part 202 may be arbitrarily determined.

Note that each mode of the second embodiment of the lid of the present invention may be applied to each mode of the first embodiment. For example, the configurations of the window part and the raised part described in Modifications 7 and 8 of the second embodiment can be applied to the lid of the first embodiment, and configurations other than the window part and the raised part may be appropriately applied to the lid of the first embodiment.

Application Example

Figure 38:
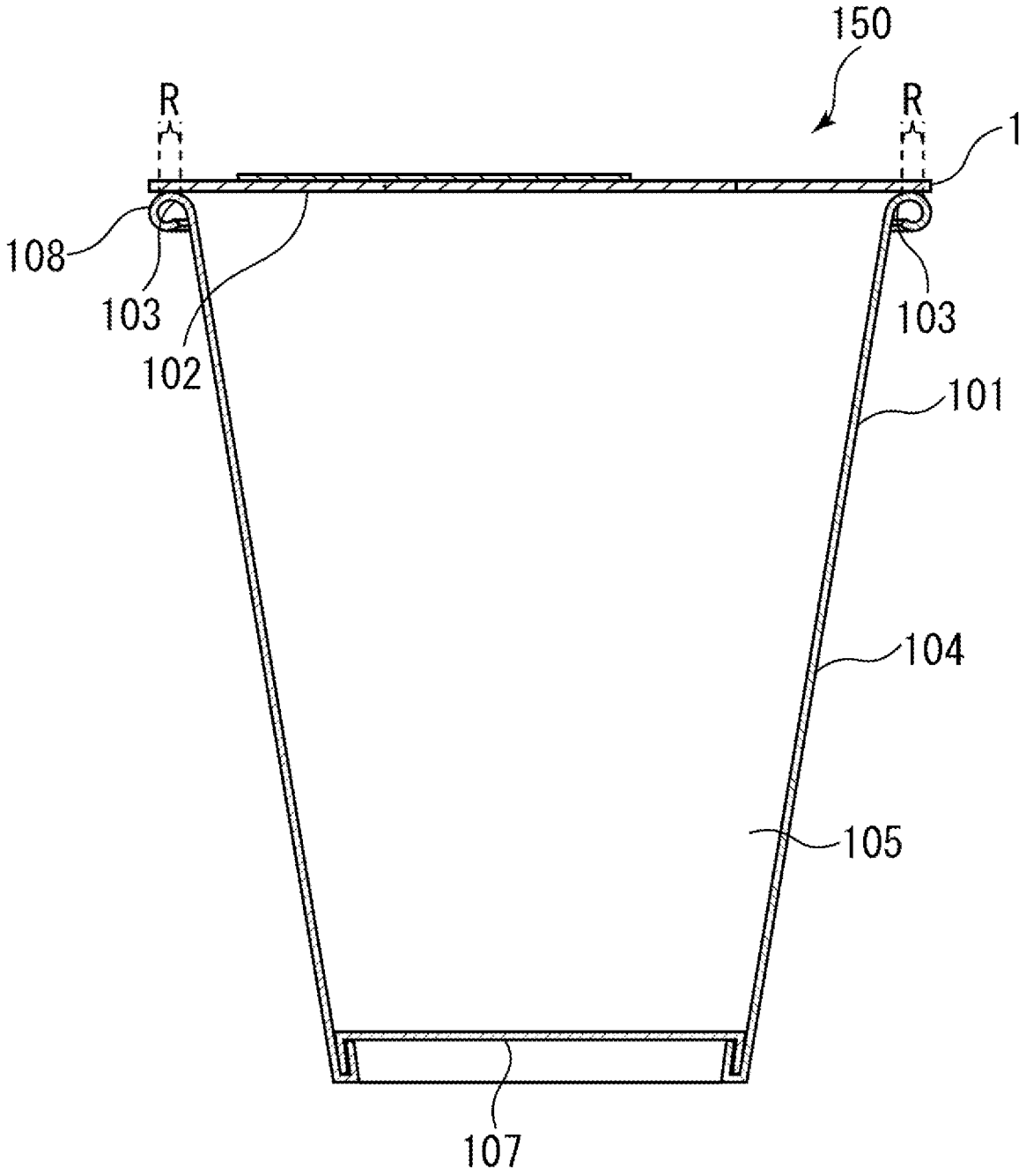
FIG. 38 is a cross-sectional view illustrating an example of the container with a lid.

The lid 1 according to the second embodiment can be used for a container with a lid 150 as illustrated in FIG. 38. FIG. 38 is a cross-sectional view illustrating an example in which the lid 1 according to the second embodiment is joined to an edge part 103 of an open mouth part 102 of a container 101 having the open mouth part 102. A method of joining the lid 1 and the container 101 is not particularly limited, and a joining method such as pressure bonding or heat sealing can be appropriately used.

The container 101 includes: a main body having a cylindrical side wall 104 whose diameter increases in the upward direction and a bottom surface part 107 and forming a space part 105 therein; and an open mouth part 102 opened at the upper end of the main body (upper end of side wall 104). Although not illustrated, the open mouth part 102 of the container 101 is formed in a circular shape. Note, however, that the container 101 illustrated here is an example, and the configuration of the container 101 is not limited. For example, the container may have a rectangular open mouth part. The container may be any container as long as the open mouth part can be covered with the lid. In addition, a material to be stored inside the container is not particularly limited, and examples thereof include a liquid material, a solid material, or a combination thereof.

Figure 42:
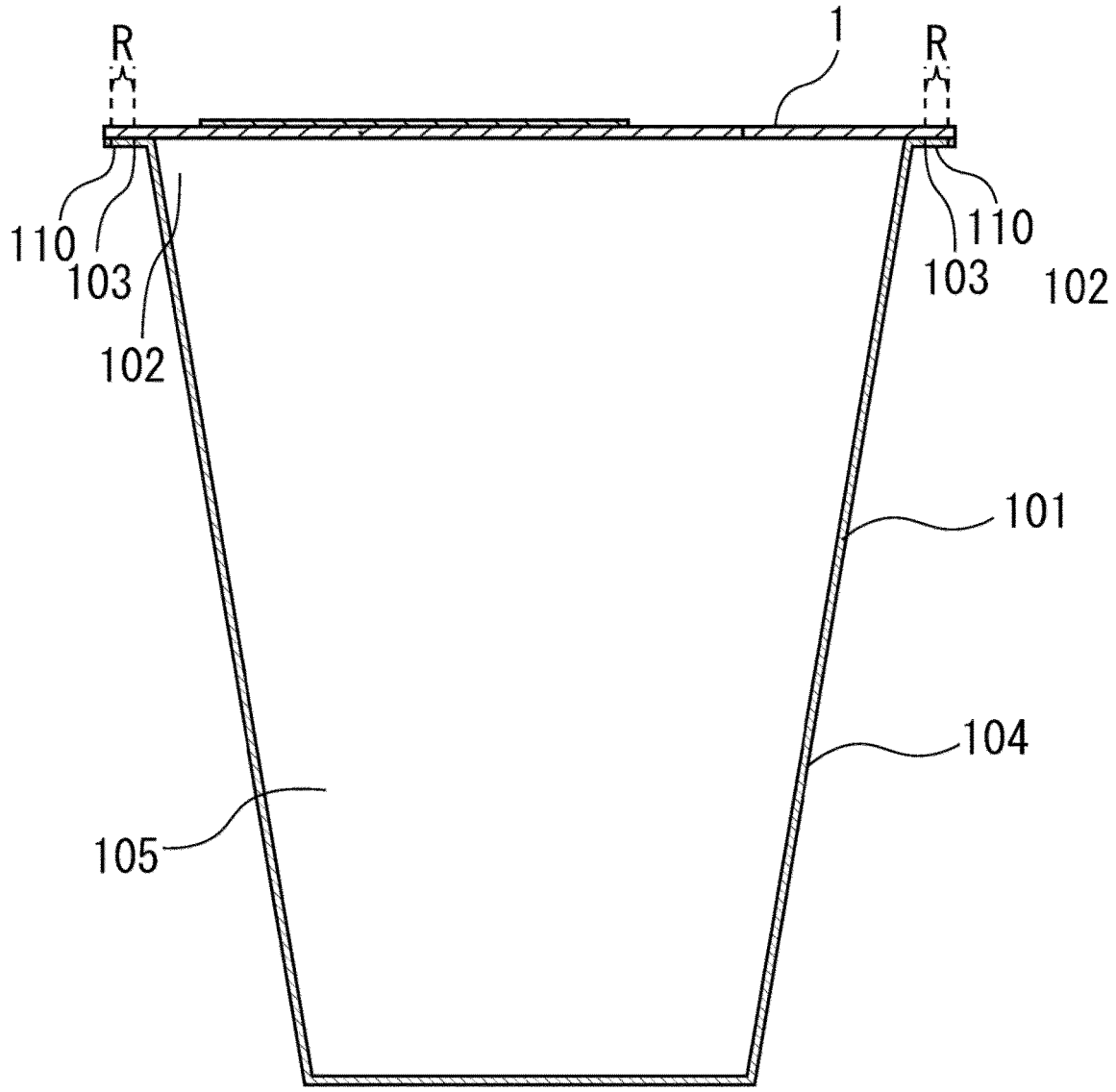
FIG. 42 is a cross-sectional view illustrating an example of the container with a lid.

In the container illustrated in FIG. 38, a curled part 108 in which a member forming the main body of the container is wound outward is formed at the edge part 103 of the open mouth part 102, but the container 101 is not limited thereto. The end surface of the side wall 104 may be exposed at the edge part 103 of the open mouth part 102, or a flange part 110 extending toward the outside of the open mouth part 102 of the container 101 may be formed at the edge part 103 of the open mouth part 102 as illustrated in FIG. 42. In the example of FIG. 41, the container 101 and the lid 1 are joined by the flange part 110.

In addition, the lid according to the second embodiment may be combined with a container having an open mouth part.

What has been described in the description of the second embodiment may be applied to the lid of the first embodiment as long as the effects of the invention are not ignored. The application example may also be applied to the lid of the first embodiment. Note that what has been described in the description of the first embodiment may also be applied to the lid of the second embodiment as long as the effects of the invention are not ignored.

As described above, the lid 1 according to the present invention can be applied to the lid 1 of such many modes. The present invention can also be applied to the lid 1 according to a mode other than the above. Although the lid according to the present invention has been described in detail above, the above description is merely an example of the lid according to the present invention, and the lid is not limited thereto. Therefore, the present invention may be appropriately modified without departing from the gist of the present invention. In addition, in the above-described configuration of the lid, the configurations of the lid bodies of the respective examples may be independently used, or the configurations of the lid bodies of the respective examples may be appropriately combined and applied.

The present invention described above includes the following technical ideas.

The present invention described above includes the following technical ideas.

(1) A lid formed for opening and closing an open mouth part of a container, wherein the lid comprises a top surface part formed to cover the open mouth part when the lid is closed, the top surface part includes a small lid piece and an opening part formed when the small lid piece is lifted;

a joint part joined to one end part of a tab member is formed in the small lid piece;

the joint part is formed in a part of the small lid piece;

the tab member includes a knob part formed at the other end part and a holding piece formed between the joint part and the knob part;

an insertion part into which the holding piece is to be inserted is formed in the top surface part; and the holding piece is formed so as to protrude from the tab member when being inserted into the insertion part, and is formed so as to be inserted into the insertion part to keep the small lid piece open.

(2) The lid according to (1) above, in which:

the top surface part has an edge part;

the small lid piece has a base end part located near a center of the top surface part and a tip end part located on the side of the edge part; and the joint part is formed near the tip end part.

(3) The lid according to (1) or (2) above, in which a non-joint part is formed between the small lid piece and the tab member.

(4) The lid according to any one of (1) to (3) above, in which a position where the non-joint part is formed is located closer to a center of the top surface part than a position where the joint part is formed.

(5) The lid according to any one of (1) to (4) above, in which the tab member has a bending part formed at an end part on the other end part side of the joint part.

(6) The lid according to any one of (1) to (5) above, in which the tab member includes a main body part between the joint part and the knob part, and the holding piece is formed in the main body part, and is formed so as to protrude from the main body part.

(7) The lid according to any one of (1) to (6) above, in which the knob part is formed so as to rise with respect to the main body part when the holding piece protrudes from the main body part.

(8) The lid according to any one of (1) to (7) above, in which the holding piece is formed so as to protrude from the knob part side toward the joint part side.

(9) The lid according to any one of (1) to (8) above, in which the insertion part includes a main part into which the holding piece is to be inserted and an auxiliary part intersecting with the main part.

(10) The lid according to (9) above, in which the main part and the auxiliary part are continuously formed, and the auxiliary part is formed in a direction different from a direction of an end part on a side opposite to a continuous part continuous with the main part.

(11) The lid according to any one of (1) to (10) above, in which the tab member is provided with a pattern imitating an expression of a person on the knob part.

(12) The lid according to (11) above, in which the expression of the pattern changes before and after the holding piece is protruded.

(13) The lid according to any one of (1) to (12) above, in which the tab member has a display part for performing predetermined display.

(14) The lid according to (13) above, in which the display part has a display indicating a type of content stored in the container.

(15) The lid according to (13) or (14) above, in which the display part is formed in the main body part, and is formed to be bendable with respect to the main body part.

(16) The lid according to any one of (13) to (15) above, in which the display part has a front surface and a back surface, and the display is provided on the front surface and the back surface.

(17) The lid according to any one of (13) to (16) above, in which the display part has a bending assisting part formed at a bending part with respect to the main body part.

(A1) A lid formed for opening and closing an open mouth part of a container, wherein the lid comprises a top surface part formed to cover the open mouth part in a state of being attached to the container to close the container, in which:

the top surface part includes a small lid piece and an opening part formed when the small lid piece is lifted;

a tab member is joined to the small lid piece;

a joint part joined to one end part of the tab member is formed in the small lid piece; and the tab member forms a knob part at the other end part of the tab member.

(A2) A lid having a joining region joined to a peripheral edge of an open mouth part of a container, wherein the lid has a shape that covers the open mouth part at the time being joined to the container, the lid comprises a small lid piece, a tab member joined to the small lid piece, and an opening part formed when the small lid piece is lifted, the small lid piece is provided inside the joining region;

one end part of the tab member and the small lid piece are joined to each other; and when a joining part between the one end part and a part close to a tip end is defined as a joint part, a knob part is formed at the other end of the tab member.

(A3) The lid according to (A1) above, in which:

the tab member has a holding piece formed between the joint part and the knob part, and is formed such that the holding piece protrudes from the tab member when the knob part is pinched to open the small lid piece;

an insertion part into which the protruding holding piece is to be inserted is formed in the top surface part; and the holding piece is configured for being inserted into the insertion part to keep the small lid piece open.

(A4) The lid according to (A2) above, in which:

the tab member has a holding piece formed between the joint part and the knob part, and is formed such that the holding piece protrudes from the tab member when the knob part is pinched to open the small lid piece;

an insertion part into which the protruding holding piece is to be inserted is formed; and the holding piece is configured for being inserted into the insertion part to keep the small lid piece open.

(A5) The lid according to (A3) or (A4) above, in which the knob part is formed so as to rise when the holding piece is inserted into the insertion part.

(A6) The lid according to any one of (A3) to (A5) above, in which the holding piece is formed so as to protrude from the knob part side toward the joint part side.

(A7) The lid according to any one of (A3) to (A6) above, in which the insertion part includes a main part into which the holding piece is to be inserted and an auxiliary part intersecting with the main part.

(A8) The lid according to any one of (A3) to (A7) above, in which the tab member is provided with a pattern imitating an expression of a person on the knob part.

(A9) The lid according to (A8) above, in which the pattern changes three-dimensionally before and after the holding piece is protruded.

(A10) The lid according to (A2) above further comprising, in a state of being joined to the container, an exposed surface, in which at least a part of an outer peripheral edge of the small lid piece extends along an inner edge of the joining region, and is formed outside an intersection position between the exposed surface in a state of being joined to the container and an extended surface of an inner peripheral surface of the container.

(A11) The lid according to any one of (A1) to (A10) above further comprising, in a state of being joined to the container, a facing surface facing an outer peripheral end surface of the small lid piece, in which at least a part of the outer peripheral end surface and the facing surface rub against each other when the small lid piece is opened from the closed lid state.

(A12) The lid according to any one of (A1) to (A11) above, in which a window part is formed in the top surface part.

(A13) The lid according to any one of (A1) to (A12) above, in which the top surface part has a raised part in which at least a part of the top surface part is raised.

(A14) The lid according to any one of (A1) to (A13) above, in which the lid is formed of a paper-based material.

(A15) A combination of a container and a lid, comprising a container having an open mouth part and the lid according to any one of (A1) to (A14) above.

(A16) A container with a lid, comprising a container having an open mouth part and the lid according to any one of (A1) to (A14) above, in which the open mouth part of the container is covered with the lid.

REFERENCE SIGNS LIST

1 Lid
2 Top lid part
2*a* Top surface part
2*b* Front surface
2*c* Back surface
3 Side wall
3*a* Outer wall
3*b* Upper end
3*c* Lower end
3*d* Step
4 Rising part
4*a* Inner surface
5 Upper wall
5*a* Inner surface
6 Lower wall
7 Engaging part
8 Lower end part
9 Folded part
9*a* Facing surface
10 Lower joining point
11 Opening forming part
12 Opening part
12*a* One end-side end part
13 Small lid piece
13*a* One end part
13*b* Other end part
14 Hinge part
15 Bending line
16 Cut line
17 Dotted joint part
18 Stress relieving part
21 Tab member
21*a* One end part
21*b* Other end part
22 Joint part
23 Holding piece (holding part)
23*a* Cut line
23*b* Tip end
23*c* Folding line
24 Knob part
24*a* Display part
24*b* Pattern
26 Insertion part
26*a* Main part
26*b* Auxiliary part
31 Bending line
41 Curled part
51 Inclined part
52 Guide part
61 Falling part
70 Exposed surface
71 Outer peripheral end
72 Peripheral part
73 Outer peripheral edge
73*a* End surface
74 Hinge connecting part
75 Front end edge part
76 Side end edge part
77 Facing surface
78 Contact part
79 Compressed part
80 Groove
81 Half-cut part
82 Protruding part
83 Knob
84 Label
85 Recessed part
86 Raised part
86*a* Outer peripheral end
87 Upper raised part
88 Slit
101 Container
102 Open mouth part
103 Edge part
104 Side wall
105 Space part
106 Inner wall
107 Bottom surface part
108 Curled part
110 Flange part
121 Protruding wall
150 Container with a lid
160 Part near opening part
F Force
M1 Extended surface
M2 Surface
R Joining region
RA Inner edge
Rn Inner region
X Broken line region
α Arrow
θ Angle

The invention claimed is:

1. A lid formed for opening and closing an open mouth part of a container, wherein the lid comprises a top surface part formed to cover the open mouth part in a state of being attached to the container to close the container, the top surface part includes a small lid piece and an opening part formed when the small lid piece is lifted;

a tab member is joined to the small lid piece;

a joint part joined to a first end part of the tab member is formed in the small lid piece; and a knob part is formed at a second end part of the tab member, wherein the tab member has a holding piece formed between the joint part and the knob part, and is formed such that the holding piece protrudes from the tab member when the knob part is pinched to open the small lid piece.

2. The lid according to claim 1, wherein:

an insertion part into which the holding piece that protrudes is to be inserted is formed in the top surface part; and the holding piece is configured for being inserted into the insertion part to keep the small lid piece open.

3. The lid according to claim 1 further comprising, in a closed lid state in which the small lid piece is closed, a facing surface facing an outer peripheral end surface of the small lid piece, wherein at least a part of the outer peripheral end surface and the facing surface rub against each other when the small lid piece is opened from the closed lid state.

4. The lid according to claim 1, wherein a window part is formed in the top surface part.

5. The lid according to claim 1, wherein the top surface part has a raised part in which at least a part of the top surface part is raised.

6. The lid according to claim 1, wherein the lid is formed of a paper-based material.

7. A lid having a joining region for being joined to a peripheral edge of an open mouth part of a container, wherein the lid has a shape that covers the open mouth part at the time of being joined to the container, the lid comprises a small lid piece, a tab member joined to the small lid piece, and an opening part formed when the small lid piece is lifted, the small lid piece is provided inside the joining region;

a first end part of the tab member and the small lid piece are joined to each other; and when a joining part between the first end part and a part close to a tip end is defined as a joint part, a knob part is formed at a second end part of the tab member, wherein the tab member has a holding piece formed between the joint part and the knob part, and is formed such that the holding piece protrudes from the tab member when the knob part is pinched to open the small lid piece.

8. The lid according to claim 7, wherein:

an insertion part into which the holding piece that protrudes is to be inserted is formed; and the holding piece is configured for being inserted into the insertion part to keep the small lid piece open.

9. The lid according to claim 8, wherein the knob part is formed so as to rise when the holding piece is inserted into the insertion part.

10. The lid according to claim 9, wherein the holding piece is formed so as to protrude from the knob part toward the joint part.

11. The lid according to claim 8, wherein the insertion part includes a main part into which the holding piece is to be inserted and an auxiliary part intersecting with the main part.

12. The lid according to claim 8, wherein the tab member is provided with a pattern imitating an expression of a person on the knob part.

13. The lid according to claim 12, wherein the pattern changes three-dimensionally before and after the holding piece is protruded.

14. The lid according to claim 7 further comprising, in a state of being joined to the container, an exposed surface, wherein at least a part of an outer peripheral edge of the small lid piece extends along an inner edge of the joining region, and is formed outside an intersection position between the exposed surface in a state of being joined to the container and an extended surface of an inner peripheral surface of the container.

15. The lid according to claim 7 further comprising, in a closed lid state in which the small lid piece is closed, a facing surface facing an outer peripheral end surface of the small lid piece, wherein at least a part of the outer peripheral end surface and the facing surface rub against each other when the small lid piece is opened from the closed lid state.

16. The lid according to claim 7, wherein a window part is formed in a top surface part of the lid.

17. The lid according to claim 7, wherein a top surface part of the lid has a raised part in which at least a part of the top surface part is raised.

18. The lid according to claim 7, wherein the lid is formed of a paper-based material.

19. A combination of a container and a lid, comprising a container having an open mouth part and the lid according to claim 7.

20. A container with a lid, comprising a container having an open mouth part and the lid according to claim 7, wherein the open mouth part of the container is covered with the lid.

* * * * *